US012103749B2

(12) United States Patent
Naumann et al.

(10) Patent No.: US 12,103,749 B2
(45) Date of Patent: Oct. 1, 2024

(54) CLOSURE DEVICE FOR A CONTAINER

(71) Applicant: Husky Injection Molding Systems Ltd., Bolton (CA)

(72) Inventors: Tobias Naumann, Merzig (DE); Stephan Scherer, Trierweiler (DE); Christophe Halter, Arlon (BE); Christophe Simon Pierre Beck, Terville (FR)

(73) Assignee: Husky Injection Molding Systems Ltd., Bolton (CA)

( * ) Notice: Subject to any disclaimer, the term of this patent is extended or adjusted under 35 U.S.C. 154(b) by 0 days.

(21) Appl. No.: 18/601,863

(22) Filed: Mar. 11, 2024

(65) Prior Publication Data

US 2024/0208702 A1 Jun. 27, 2024

Related U.S. Application Data

(63) Continuation of application No. 17/608,726, filed as application No. PCT/CA2020/050533 on Apr. 23, 2020.

(Continued)

(51) Int. Cl.

| | |
|---|---|
| ***B65D 55/16*** | (2006.01) |
| ***B65D 41/34*** | (2006.01) |
| ***B65D 47/08*** | (2006.01) |

(52) U.S. Cl.

CPC ..... *B65D 55/16* (2013.01); *B65D 41/3428* (2013.01); *B65D 41/3447* (2013.01);

(Continued)

(58) Field of Classification Search

CPC ..... B65D 41/3428; B65D 55/16; B65D 2401/30; B65D 2401/50; B65D 41/3447; B65D 47/0823

(Continued)

(56) References Cited

U.S. PATENT DOCUMENTS

| | | | |
|---|---|---|---|
| 1,806,479 | A | 5/1931 | Lory |
| 2,852,054 | A | 9/1958 | Motley |

(Continued)

FOREIGN PATENT DOCUMENTS

| | | | |
|---|---|---|---|
| CA | 2676854 | A1 | 2/2011 |
| CA | 3082235 | A1 | 6/2019 |

(Continued)

OTHER PUBLICATIONS

Extended European Search Report dated May 15, 2024 for European Application No. EP 24151979.2.

*Primary Examiner* — J. Gregory Pickett
*Assistant Examiner* — Niki M Eloshway
(74) *Attorney, Agent, or Firm* — Wolf, Greenfield & Sacks, P.C.

(57) ABSTRACT

A closure device for a container having a neck including an annular flange, the closure device comprising: a cap body; a tamper evident (TE) band positioned below the annular flange when assembled in the container; a first hinge and a second hinge defined on the cap body; a leash connected to the TE band, the first hinge and the second hinge; the leash allowing for the cap body to be separated from the TE band during opening, but to remain connected thereto via the leash; a tongue protruding from the cap body between the first and second hinges; when the cap body is actuated from a closed configuration relative to the neck to a fully open position: the leash is configured to retain the cap body to the TE band; an interaction of the tongue and the neck is configured to retain the cap body in the fully open position.

16 Claims, 23 Drawing Sheets

Related U.S. Application Data

(60) Provisional application No. 62/981,067, filed on Feb. 25, 2020, provisional application No. 62/913,377, filed on Oct. 10, 2019, provisional application No. 62/846,801, filed on May 13, 2019.

(52) U.S. Cl.
CPC ..... *B65D 47/0823* (2013.01); *B65D 2251/1008* (2013.01); *B65D 2401/30* (2020.05); *B65D 2401/50* (2020.05)

(58) Field of Classification Search
USPC ..... 215/252
See application file for complete search history.

(56) References Cited

U.S. PATENT DOCUMENTS

| | | | | |
|---|---|---|---|---|
| 2,864,521 | A | 12/1958 | Kundert | |
| 3,016,168 | A | 1/1962 | Larson | |
| 3,904,062 | A | 9/1975 | Grussen | |
| 3,986,627 | A | 10/1976 | Zapp | |
| 4,394,918 | A | 7/1983 | Grussen | |
| 4,505,401 | A | 3/1985 | Berglund | |
| 4,513,870 | A | 4/1985 | Zaltsman | |
| 4,557,393 | A | 12/1985 | Boik | |
| 4,564,114 | A | 1/1986 | Cole | |
| 4,565,293 | A | 1/1986 | Jonas | |
| 4,805,792 | A | 2/1989 | Lecinski, Jr. | |
| 4,892,208 | A | 1/1990 | Sledge | |
| 5,078,296 | A | 1/1992 | Amidzich | |
| 5,215,204 | A | 6/1993 | Beck et al. | |
| 5,246,125 | A * | 9/1993 | Julian | B65D 41/3447 215/252 |
| 5,307,948 | A | 5/1994 | Blackburn et al. | |
| D350,482 | S | 9/1994 | Hu et al. | |
| 5,360,126 | A * | 11/1994 | Snyder | B65D 41/3447 215/252 |
| D353,328 | S | 12/1994 | Nuffer | |
| 5,395,006 | A | 3/1995 | Verma | |
| 5,653,353 | A | 8/1997 | Otto et al. | |
| 5,725,115 | A | 3/1998 | Bösl et al. | |
| 5,765,705 | A | 6/1998 | Deubel | |
| D402,202 | S | 12/1998 | Sherman et al. | |
| 6,264,051 | B1 | 7/2001 | Reidenbach | |
| 6,474,491 | B1 * | 11/2002 | Benoit-Gonin | B65D 41/3428 220/263 |
| D475,923 | S | 6/2003 | Renz | |
| 6,648,158 | B1 | 11/2003 | Lawrence | |
| 6,745,900 | B2 | 6/2004 | Lambert | |
| 6,931,821 | B2 | 8/2005 | Wong | |
| 7,051,888 | B2 | 5/2006 | Antier et al. | |
| 7,073,679 | B1 | 7/2006 | Lagler et al. | |
| D540,670 | S | 4/2007 | Moribata et al. | |
| D585,277 | S | 1/2009 | Beauplan | |
| D593,856 | S | 6/2009 | Kubler | |
| D606,399 | S | 12/2009 | Scuturio | |
| D613,599 | S | 4/2010 | Khubani | |
| D621,260 | S | 8/2010 | Brannon et al. | |
| 7,823,736 | B1 | 11/2010 | Pugne et al. | |
| 7,857,155 | B2 | 12/2010 | Roberts et al. | |
| 8,443,994 | B1 | 5/2013 | Desselle | |
| 8,469,213 | B2 * | 6/2013 | Ishii | B65D 41/3428 220/837 |
| 8,613,372 | B2 | 12/2013 | Porter | |
| 8,636,160 | B2 | 1/2014 | Park | |
| 8,695,822 | B2 * | 4/2014 | Kwon | B65D 55/16 215/258 |
| 8,720,716 | B2 | 5/2014 | Campbell | |
| 8,919,546 | B2 | 12/2014 | Wada et al. | |
| 9,010,555 | B2 * | 4/2015 | Luzzato | B65D 41/48 220/837 |
| 9,108,774 | B2 | 8/2015 | Kwon | |
| 9,327,883 | B2 | 5/2016 | Groubert et al. | |
| 9,493,283 | B2 | 11/2016 | Tuyn | |
| 9,643,762 | B2 | 5/2017 | Maguire | |
| 9,828,146 | B2 | 11/2017 | Loukov | |
| 9,850,044 | B2 | 12/2017 | Mühlemann | |
| 9,932,159 | B2 | 4/2018 | Maguire | |
| 9,975,677 | B2 | 5/2018 | Maguire | |
| 10,647,486 | B2 | 5/2020 | Maguire | |
| 10,654,625 | B2 * | 5/2020 | Migas | B65D 55/16 |
| 10,800,581 | B2 * | 10/2020 | Berroa Garcia | B65D 55/16 |
| 10,836,544 | B2 | 11/2020 | Kim | |
| 10,836,549 | B2 * | 11/2020 | Maguire | B65D 41/3428 |
| 11,040,806 | B2 * | 6/2021 | Naumann | B65D 41/485 |
| 11,485,550 | B2 | 11/2022 | Naumann et al. | |
| 2006/0096987 | A1 | 5/2006 | Wry | |
| 2006/0201904 | A1 * | 9/2006 | Comeau | B65D 35/08 220/254.5 |
| 2008/0197135 | A1 | 8/2008 | Berman | |
| 2009/0236304 | A1 | 9/2009 | Watson | |
| 2009/0236341 | A1 | 9/2009 | McKinney et al. | |
| 2009/0255962 | A1 | 10/2009 | Dressel | |
| 2010/0206879 | A1 | 8/2010 | Lin | |
| 2011/0000871 | A1 | 1/2011 | Bernard et al. | |
| 2011/0062159 | A1 | 3/2011 | Khubani | |
| 2011/0114593 | A1 | 5/2011 | Ishii et al. | |
| 2011/0278216 | A1 | 11/2011 | Hull et al. | |
| 2011/0297682 | A1 | 12/2011 | Kwon | |
| 2012/0024815 | A1 | 2/2012 | Kwon | |
| 2012/0285921 | A1 | 11/2012 | Kwon | |
| 2012/0298666 | A1 | 11/2012 | Kwon | |
| 2013/0001185 | A1 | 1/2013 | Antier et al. | |
| 2016/0243735 | A1 | 8/2016 | Cerveny | |
| 2017/0203896 | A1 | 7/2017 | Maguire | |
| 2017/0210516 | A1 | 7/2017 | Tebbe et al. | |
| 2017/0354289 | A1 | 12/2017 | Marina et al. | |
| 2017/0362003 | A1 | 12/2017 | Maguire | |
| 2018/0170625 | A1 | 6/2018 | Sung | |
| 2018/0370701 | A1 | 12/2018 | Maguire | |
| 2019/0375555 | A1 | 12/2019 | Edie et al. | |
| 2020/0207525 | A1 | 7/2020 | Sung | |
| 2022/0267052 | A1 | 8/2022 | Dreyer et al. | |
| 2022/0340339 | A1 | 10/2022 | Naumann et al. | |
| 2022/0371795 | A1 | 11/2022 | Naumann et al. | |

FOREIGN PATENT DOCUMENTS

| | | | |
|---|---|---|---|
| CN | 1631740 | A | 6/2005 |
| CN | 1830730 | A | 9/2006 |
| CN | 101790447 | A | 7/2010 |
| DE | 1 586 727 | A1 | 11/1970 |
| DE | 93 18 243 | U1 | 3/1994 |
| DE | 10 2010 028 521 | A1 | 11/2011 |
| EP | 0 810 952 | B1 | 12/1997 |
| EP | 1 406 820 | B1 | 4/2004 |
| EP | 1 529 736 | A2 | 5/2005 |
| EP | 1 951 590 | B1 | 8/2008 |
| EP | 1 961 669 | A2 | 8/2008 |
| EP | 2 331 418 | B1 | 6/2011 |
| EP | 2 308 772 | A1 | 5/2012 |
| EP | 2 574 182 | B1 | 4/2013 |
| EP | 2 504 249 | B1 | 3/2015 |
| EP | 3 135 600 | A1 | 3/2017 |
| EP | 3 277 598 | B1 | 2/2018 |
| EP | 3 336 003 | A1 | 6/2018 |
| ES | 2712094 | A1 | 5/2019 |
| FR | 2 499 519 | A1 | 8/1982 |
| FR | 2 777 542 | A1 | 10/1999 |
| FR | 2 785 264 | A1 | 5/2000 |
| GB | 103 000 | A | 1/1917 |
| GB | 809 398 | A | 2/1959 |
| GB | 2 228 474 | A | 8/1990 |
| JP | H10-194316 | A | 7/1998 |
| JP | 2001-072120 | A | 3/2001 |
| JP | 2003-191993 | A | 7/2003 |
| JP | 2005-059876 | A | 3/2005 |
| JP | 2005-289488 | A | 10/2005 |
| JP | 2006-016072 | A | 1/2006 |
| JP | 2006-143321 | A | 6/2006 |
| JP | 2011-111192 | A | 6/2011 |
| JP | 4906441 | B2 | 3/2012 |
| JP | 5215798 | B2 | 6/2013 |

(56) References Cited

FOREIGN PATENT DOCUMENTS

| | | | |
|---|---|---|---|
| JP | 5330921 | B2 | 10/2013 |
| JP | 5330922 | B2 | 10/2013 |
| JP | 5341729 | B2 | 11/2013 |
| JP | 2014-031202 | A | 2/2014 |
| JP | 5520768 | B2 | 6/2014 |
| JP | 5552346 | B2 | 7/2014 |
| JP | 5574582 | B2 | 8/2014 |
| JP | 5590913 | B2 | 9/2014 |
| JP | 5600418 | B2 | 10/2014 |
| JP | 5600461 | B2 | 10/2014 |
| JP | 5697505 | B2 | 4/2015 |
| JP | 5948181 | B2 | 7/2016 |
| JP | 6068899 | B2 | 1/2017 |
| JP | 6081738 | B2 | 2/2017 |
| KR | 10-0855086 | B1 | 8/2008 |
| KR | 10-0855087 | B1 | 8/2008 |
| KR | 10-0872159 | B1 | 1/2009 |
| KR | 10-0880006 | B1 | 1/2009 |
| KR | 10-0894341 | B1 | 4/2009 |
| KR | 10-0942642 | B1 | 2/2010 |
| KR | 10-2010-029797 | A | 3/2010 |
| KR | 10-0981240 | B1 | 9/2010 |
| TW | 201704106 | A | 2/2017 |
| WO | WO 90/14286 | A1 | 11/1990 |
| WO | WO 1990/014286 | A1 | 11/1990 |
| WO | WO 94/04426 | A1 | 3/1994 |
| WO | WO 96/26122 | A1 | 8/1996 |
| WO | WO 1996/026122 | A1 | 8/1996 |
| WO | WO 00/26108 | A1 | 5/2000 |
| WO | WO 2007/057659 | A1 | 5/2007 |
| WO | WO 2007/058440 | A1 | 5/2007 |
| WO | WO 2008/147104 | A1 | 12/2008 |
| WO | WO 2009/002057 | A2 | 12/2008 |
| WO | WO 2010/004919 | A1 | 1/2010 |
| WO | WO 2010/040961 | A1 | 4/2010 |
| WO | WO 2009/048273 | A2 | 7/2010 |
| WO | WO 2011/064489 | A1 | 6/2011 |
| WO | WO 2011/090278 | A2 | 7/2011 |
| WO | WO 2011/093597 | A2 | 8/2011 |
| WO | WO 2011/096647 | A2 | 8/2011 |
| WO | WO 2011/138137 | A1 | 11/2011 |
| WO | WO 2012/121385 | A1 | 9/2012 |
| WO | WO 2015/046889 | A1 | 4/2015 |
| WO | WO 2015/061834 | A1 | 5/2015 |
| WO | WO 2016/182305 | A1 | 11/2016 |
| WO | WO 2017/068151 | A1 | 4/2017 |
| WO | WO 2014/200165 | A1 | 12/2017 |
| WO | WO 2018/088723 | A1 | 5/2018 |
| WO | WO 2018/111052 | A1 | 6/2018 |
| WO | WO 2019/031779 | A1 | 2/2019 |
| WO | WO 2019/207119 | A2 | 10/2019 |
| WO | WO 2019/207148 | A1 | 10/2019 |
| WO | WO 2019/207149 | A1 | 10/2019 |
| WO | WO 2019/207152 | A1 | 10/2019 |
| WO | WO 2019/207153 | A2 | 10/2019 |
| WO | WO 2020/037089 | A1 | 2/2020 |
| WO | WO 2020/077162 | A1 | 4/2020 |
| WO | WO 2020/212426 | A1 | 10/2020 |
| WO | WO 2021/013370 | A1 | 1/2021 |

* cited by examiner

CLOSURE DEVICE FOR A CONTAINER

CROSS-REFERENCE TO RELATED APPLICATIONS

This application is a continuation of U.S. Ser. No. 17/608,726, which is a national stage filing under 35 U.S.C. § 371 of International Application PCT/CA2020/050533, filed Apr. 23, 2020, which claims the benefit under 35 U.S.C. § 119(e) of U.S. provisional application Ser. No. 62/981,067, filed Feb. 25, 2020 and U.S. provisional application Ser. No. 62/913,377, filed Oct. 10, 2019 and U.S. provisional application Ser. No. 62/846,801, filed May 13, 2019, each of the foregoing is herein incorporated by reference in its entirety.

TECHNICAL FIELD

The present technology relates to a closure device for a container.

BACKGROUND

Containers, such as bottles, are generally provided with closure devices, such as caps, to fluidly seal the container. In recent years, it has become desirable to tether the closure device to the container in order to avoid losing the closure device. Not only is this a matter of convenience, but it is also becoming a legal requirement in certain jurisdictions.

Tethering of a closure device to its respective container includes certain mechanisms which allow an attachment of the closure device to a tamper-evidence (TE band) band at an open end of the container. Such mechanisms generally allow severing of frangible links between the closure device and the TE band during opening of the closure device yet allow the closure device to stay connected to the TE band and hence the container when in the open configuration. The typical mechanism also allows the closure device to be actuated between closed and open configurations.

In JP 5574582, there is described a cap 2 having a tongue 46 provided between two leashes. The tongue 46 abuts an annular ring 68 of the neck, allowing the cap to remain in the open position.

U.S. Pat. No. 9,010,555 describes a one-piece cap with two lines of weakness (20/34) which break when unscrewing the cap. The top portion of the cap remains attached to the TE band via the strip 36. A notch 32 separates the bridges 301 and 302. However, there is no mechanism to maintain the cap in the open position.

In U.S. Pat. No. 6,474,491, there is described a cap having a tongue 21 between the two film hinges 5. The two film hinges 5 are connected to the ring 3 via a respective arm 4. The tongue can abut the neck of the container when the cap is in the open position, allowing the cap to remain in the open position.

US 2012/0024815 describes a one piece cap comprising a cut line 34 under a hinge 35 to extend a coupling length of the support ring 33 with the cap body 31. In some embodiments, the cap body 31 includes a wedge k1, which when opened, is retained between the support step 15 and the support ring 33.

In JP 49096441, a cap is described with two bands 40 acting as a hinge between the TE band 20 and the cap body 10. A hook 11 is provided between the bands 40. When the cap body 10 is removed, the hook 11 engages the TE band 20 and the jaw A of the neck portion.

SUMMARY

Embodiments of the present technology have been developed based on inventors' appreciation of at least one shortcoming associated with the prior art solutions and approaches to retaining a closure device on a container and allowing retention of an open position of the closure device relative to the container. Inventors have noted that prior art solutions which do attempt to retain the cap relative to the container are not able to achieve this at an angle which allows comfortable access to the container for the user. In the case of the drinking bottles, for example, the cap when open interferes with the user drinking from the bottle.

Accordingly, in certain aspects and embodiments of the present disclosure, there is provided a closure device which can actuate between a closed configuration and an open configuration, the open configuration enabling a number of open positions of the cap relative to the container. A retaining mechanism of the closure device enables retention of the cap in a fully open position.

From one aspect, there is provided a closure device for a container, the container having a neck including an annular flange along an exterior surface of the neck, the closure device comprising: a cap body; a tamper evident (TE) band, the TE band defined such that, when assembled onto the container, the TE band is positioned below the annular flange for cooperation therewith; a first hinge and a second hinge defined on the cap body; a leash connected to the TE band, the first hinge and the second hinge; the leash allowing for the cap body to be separated from the TE band during opening, but to remain connected thereto via the leash; a tongue protruding from the cap body between the first hinge and the second hinge; when the cap body is actuated from a closed configuration relative to the neck to a fully open position: the leash is configured to retain the cap body to the TE band; an interaction of the tongue and the neck is configured to retain the cap body in the fully open position.

In certain embodiments, the interaction of the tongue and the neck is direct. The direct interaction may be between a lip at a free end of the tongue and the annular flange.

In certain embodiments, the interaction of the tongue and the neck is indirect via a ratchet defined on the TE band. The ratchet may be located on the TE band, between the first hinge and the second hinge.

In certain embodiments, the cap body and the TE band are implemented in a flip top arrangement via the first hinge and the second hinge.

In certain embodiments, after the cap body is actuated from the closed configuration relative to the neck to the fully open position, the cap body is configured to be actuated back to the closed configuration and be retained in the closed configuration.

In certain embodiments, the cap body is retained in the closed configuration by means of a threaded interface with the neck.

In certain embodiments, the leash is sized to allow the cap body a degree of rotational freedom sufficient to disengage the threaded interface.

In certain embodiments, the cap body is initially connected to the TE band by means of a frangible link.

In certain embodiments, the frangible link is more fragile than the leash. There may be provided a plurality of frangible links positioned outwardly of the first hinge and the second hinge.

In certain embodiments, the annular flange and the TE band are sized such that the annular flange retains the TE band after the cap body is actuated from the closed configuration relative to the neck to the fully open position.

In certain embodiments, the leash is configured to allow the cap body a rotational degree of freedom to separate the cap body from the neck while retaining the cap body to the TE band.

In certain embodiments, the interaction is an interaction of the tongue with the leash at an upper portion of the annular flange.

In certain embodiments, the first hinge and the second hinge define a first pivotal axis; the leash originates from a pivotal point on the TE band, the pivotal point defining a second pivotal axis.

From another aspect, there is provided a mold for forming the closure device by injection molding, the mold comprising a female cavity piece and a male core piece, the female cavity piece and the male core piece defining a molding cavity configured to form the closure device of claim 1.

From a yet further aspect, there is provided a closure device for a container, the container having a neck including an annular flange along an exterior surface of the neck, said closure device comprising: a cap body; a tamper evident (TE) band, the TE band defined such that, when assembled onto the container, the TE band is positioned below the annular flange for cooperation therewith; a first hinge and a second hinge defined on the cap body; a leash connected to the TE band, the first hinge and the second hinge; the leash allowing for the cap body to be separated from the TE band during opening, but to remain connected thereto via the leash; a tongue protruding from the cap body between the first hinge and the second hinge; when the cap body is actuated from a closed configuration relative to the neck to a fully open position: the leash is configured to allow the cap body a rotational degree of freedom to separate the cap body from the neck while retaining the cap body to the TE band; an interaction of the tongue and the neck is configured to retain the cap body in the fully open position.

In certain embodiments, the interaction of the tongue and the neck is direct. The interaction may be between a lip at a free end of the tongue and the annular flange.

In certain embodiments, the interaction of the tongue and the neck is indirect via a ratchet defined on the TE band. The ratchet may be located on the TE band, between the first hinge and the second hinge.

In certain embodiments, the cap body and the TE band are implemented in a flip top arrangement via the first hinge and the second hinge.

In certain embodiments, after the cap body is actuated from the closed configuration relative to the neck to the fully open position, the cap body is configured to be actuated back to the closed configuration and be retained in the closed configuration.

In certain embodiments, the cap body is retained in the closed configuration by means of a threaded interface with the neck.

In certain embodiments, the leash is sized to allow the cap body a degree of rotational freedom sufficient to disengage the threaded interface.

In certain embodiments, the cap body is initially connected to the TE band by means of a frangible link.

In certain embodiments, the frangible link is more fragile than the leash. There may be provided a plurality of frangible links positioned outwardly of the first hinge and the second hinge.

In certain embodiments, the annular flange and the TE band are sized such that the annular flange retains the TE band after the cap body is actuated from the closed configuration relative to the neck to the fully open position.

In certain embodiments, the leash is configured to retain the cap body to the TE band.

In certain embodiments, the interaction is an interaction of the tongue with the leash at an upper portion of the annular flange.

In certain embodiments, the first hinge and the second hinge define a first pivotal axis; the leash originates from a pivotal point on the TE band, the pivotal point defining a second pivotal axis.

From another aspect, there is provided a closure device for a container, the container having a neck including an annular flange along an exterior surface of the neck, said closure device comprising: a cap body; a tamper evident (TE) band, the TE band defined such that, when assembled onto the container, the TE band is positioned below the annular flange; a first leash and a second leash connecting the cap body to the TE band, the first leash and the second leash originating from separate locations on the cap body and converging towards a pivot region on the TE band, the pivot region defining a pivotal axis; a tongue protruding from the cap body; when said cap body is actuated from a closed configuration relative to the neck to a fully open position about the pivotal axis: the first leash and the second leash are configured to retain the cap body to the TE band; an interaction of the tongue and the neck is configured to retain the cap body in the fully open position.

In certain embodiments, the interaction of the tongue and the neck is direct.

The interaction may be between the tongue and an interaction region of the neck, the interaction region of the neck including the annular flange.

In certain embodiments, interaction of the tongue and the neck is indirect via a ratchet defined on the TE band. The ratchet may be wedge-shaped and has a free end which is thinner than a portion of the ratchet connected to the TE band.

In certain embodiments, the cap body and the TE band are implemented in a flip top arrangement via the first hinge and the second hinge.

In certain embodiments, after the cap body is actuated from the closed configuration relative to the neck to the fully open position, the cap body is configured to be actuated back to the closed configuration and be retained in the closed configuration.

In certain embodiments, the cap body is retained in the closed configuration by means of a threaded interface with the neck.

In certain embodiments, the leash is sized to allow the cap body a degree of rotational freedom sufficient to disengage the threaded interface.

In certain embodiments, the cap body is initially connected to the TE band by means of a frangible link.

In certain embodiments, the frangible link is more fragile than the leash. There may be provided a plurality of frangible links positioned outwardly of the first hinge and the second hinge.

In certain embodiments, the annular flange and the TE band are sized such that the annular flange retains the TE band after the cap body is actuated from the closed configuration relative to the neck to the fully open position.

In certain embodiments, the leash is configured to allow the cap body a rotational degree of freedom to separate the cap body from the neck while retaining the cap body to the TE band.

In certain embodiments, the interaction is an interaction of the tongue with the leash at an upper portion of the annular flange.

In certain embodiments, the closure device further comprises a first hinge and a second hinge defined on the cap body and positioned one on either side of the tongue. a first pivotal axis; the leash originates from a pivotal point on the TE band, the pivotal point defining a second pivotal axis.

From another aspect there is provided, a closure device for a container, the container having a neck including an annular flange along an exterior surface of the neck, said closure device comprising: a cap body; a tamper evident (TE) band, the TE band defined such that, when assembled onto the container, the TE band is positioned below the annular flange for cooperation therewith; a first hinge and a second hinge defined on the cap body; a leash connected to the TE band, the first hinge and the second hinge; the leash allowing for the cap body to be separated from the TE band during opening, but to remain connected thereto via the leash; a tongue protruding from the cap body between the first hinge and the second hinge; when the cap body is actuated from a closed configuration relative to the neck to a fully open position: an interaction of the tongue with the leash at an upper portion of the annular flange maintains said cap body in the open position.

In certain embodiments, the cap body and the TE band are implemented in a flip top arrangement via the first hinge and the second hinge.

In certain embodiments, after the cap body is actuated from the closed configuration relative to the neck to the fully open position, the cap body is configured to be actuated back to the closed configuration and be retained in the closed configuration.

In certain embodiments, the cap body is retained in the closed configuration by means of a threaded interface with the neck.

In certain embodiments, the leash is sized to allow the cap body a degree of rotational freedom sufficient to disengage the threaded interface.

In certain embodiments, the cap body is initially connected to the TE band by means of a frangible link.

In certain embodiments, the frangible link is more fragile than the leash. There may be provided a plurality of frangible links positioned outwardly of the first hinge and the second hinge.

In certain embodiments, the annular flange and the TE band are sized such that the annular flange retains the TE band after the cap body is actuated from the closed configuration relative to the neck to the fully open position.

In certain embodiments, the leash is configured to allow the cap body a rotational degree of freedom to separate the cap body from the neck while retaining the cap body to the TE band.

In certain embodiments, the first hinge and the second hinge define a first pivotal axis; the leash originates from a pivotal point on the TE band, the pivotal point defining a second pivotal axis.

From a yet further aspect there is provided a closure device for a container provided with a neck comprising an annular flange along an exterior surface of the neck, said closure device comprising: a cap body; a tamper evident (TE) band, the TE band defined such that, when assembled onto the container, the TE band is positioned below the annular flange for cooperation therewith; a first hinge and a second hinge defined on the cap body defining a first pivotal axis; a leash interconnecting the first hinge and the second hinge to the TE band, the leash originating from a pivotal point on the TE band, the pivotal point defining a second pivotal axis; the leash allowing for the cap body to be separated from the TE band during opening, but to remain connected thereto via the leash; a tongue protruding from the cap body between the first hinge and the second hinge; when the cap body is actuated from a closed configuration relative to the neck to a fully open position: the tongue engages the annular flange to maintain said cap body in the open position.

In certain embodiments, the cap body and the TE band are implemented in a flip top arrangement via the first hinge and the second hinge.

In certain embodiments, after the cap body is actuated from the closed configuration relative to the neck to the fully open position, the cap body is configured to be actuated back to the closed configuration and be retained in the closed configuration.

In certain embodiments, the cap body is retained in the closed configuration by means of a threaded interface with the neck.

In certain embodiments, the leash is sized to allow the cap body a degree of rotational freedom sufficient to disengage the threaded interface.

In certain embodiments, the cap body is initially connected to the TE band by means of a frangible link.

In certain embodiments, the frangible link is more fragile than the leash. In certain embodiments, there are provided a plurality of frangible links positioned outwardly of the first hinge and the second hinge.

In certain embodiments, the annular flange and the TE band are sized such that the annular flange retains the TE band after the cap body is actuated from the closed configuration relative to the neck to the fully open position.

In certain embodiments, the leash is configured to allow the cap body a rotational degree of freedom to separate the cap body from the neck while retaining the cap body to the TE band.

In certain embodiments, the interaction is an interaction of the tongue with the leash at an upper portion of the annular flange.

From another aspect, there is provided a closure device for a container, the container having a neck including an annular flange along an exterior surface of the neck, said closure device comprising: a cap body; a tamper evident (TE) band, the TE band defined such that, when assembled onto the container, the TE band is positioned below the annular flange; a first leash and a second leash connecting the cap body to the TE band, the first leash and the second leash originating from separate locations on the cap body and converging towards a pivot region on the TE band, the pivot region defining a pivotal axis; a tongue protruding from the cap body; a ratchet provided on the TE band; wherein, when said cap body is moved from a closed configuration relative to the neck to a fully open position, an interaction of the tongue with a contact surface of the ratchet maintains said cap body in the open position.

In certain embodiments, the closure device further comprises a first hinge and a second hinge on the TE band, the ratchet being located between the first hinge and the second hinge.

In certain embodiments, the first leash and the second leash each have an expandable configuration.

In certain embodiments, the expandable configuration is elbow-shaped.

In certain embodiments, the ratchet is wedge-shaped and has a free end which is thinner than a portion connected to the TE band.

In certain embodiments, the cap body and the TE band are implemented in a flip top arrangement via the first hinge and the second hinge.

In certain embodiments, after the cap body is actuated from the closed configuration relative to the neck to the fully open position, the cap body is configured to be actuated back to the closed configuration and be retained in the closed configuration.

In certain embodiments, the cap body is retained in the closed configuration by means of a threaded interface with the neck.

In certain embodiments, the leash is sized to allow the cap body a degree of rotational freedom sufficient to disengage the threaded interface.

In certain embodiments, the cap body is initially connected to the TE band by means of a frangible link.

In certain embodiments, the frangible link is more fragile than the leash.

In certain embodiments, the closure device further comprises a frangible link between the each one of the first leash and the second leash and one or more of: the cap body and the TE band, the frangible link being more fragile than the first leash and the second leash.

In certain embodiments, the annular flange and the TE band are sized such that the annular flange retains the TE band after the cap body is actuated from the closed configuration relative to the neck to the fully open position.

In certain embodiments, the leash is configured to allow the cap body a rotational degree of freedom to separate the cap body from the neck while retaining the cap body to the TE band.

From another aspect, there is provided a closure device for a container, the container having a neck including an annular flange along an outer surface of the neck, the closure device comprising: a cap body; a tamper evident (TE) band, the TE band defined such that, when assembled onto the container, the TE band is positioned below the annular flange for cooperation therewith; a first hinge and a second hinge defined on the cap body; a first leash and a second leash connecting the cap body to the TE band, the first leash interconnecting the first hinge and the TE band, and the second leash interconnecting the second hinge and the TE band; the first leash and the second leash originating from separate locations on the TE band; a tongue protruding from the cap body between the first hinge and the second hinge; when the cap body is actuated from a closed configuration relative to the neck to a fully open position: the first leash and the second leash are configured to be separated from the TE band during opening, but to remain connected thereto to retain the cap body to the TE band; an interaction of the tongue and the TE band is configured to retain the cap body in the fully open position.

In certain embodiments, the closure device further comprises a protruding portion extending from the TE band towards the tongue, wherein an interaction of the tongue and the protruding portion is configured to retain the cap body in the fully open position.

In certain embodiments, the tongue comprises a lip extending outwardly from a free end of the tongue, a length of the lip being sufficient to allow rotation of the cap body by more than 180° from the closed configuration to the fully open position.

In certain embodiments, the first leash and the second leash each have a length sufficient to permit the TE band to be spaced from the neck whilst rotating the cap body from the closed configuration towards the fully open position, and to cause the protruding portion to contact the neck when the cap body is released in the fully open position to cause an audible signal. In certain embodiments, the audible signal is a click. In certain embodiments, the TE band comprises at least one rib extending along the TE band from a lower end of the TE band to an upper end of the TE band. The at least one rib stops short of the upper end of the TE band. The lip abuts an end of the at least one rib proximate the upper end of the TE band when in the open position. In certain embodiments, the end of the ribs defines a rotation point about which the lip rotates relative to the TE band.

From a yet further aspect, there is provided a closure device for a container, the container having a neck including an annular flange along an exterior surface of the neck, the closure device comprising: a cap body; a tamper evident (TE) band, the TE band defined such that, when assembled onto the container, the TE band is positioned below the annular flange for cooperation therewith; at least one hinge defined on the cap body; at least one leash connected to the TE band and the at least one hinge, the at least one leash allowing for the cap body to be separated from the TE band during opening, but to remain connected thereto via the at least one leash; a tongue protruding from the cap body adjacent the at least one hinge, the tongue having a lip extending therefrom; at least one rib on the TE band and positioned below the tongue when the cap body is in a closed configuration relative to the neck, wherein, when the cap body is actuated from the closed configuration to a fully open position: the at least one leash is configured to retain the cap body to the TE band; and the lip is arranged to interact with the at least one rib when the cap body is in the fully open position.

In certain embodiments, the at least one rib extends in a direction from the TE band to the cap body. In certain embodiments, the at least one rib extends from a lower end of the TE band and stops short of an upper end of the TE band. In certain embodiments, the at least one rib comprises two ribs, spaced from one another and extending substantially parallel to one another, on the TE band.

In certain embodiments, a connection point of the at least one leash to the TE band is circumferentially spaced from a connection point of the at least one leash to the at least one hinge.

In certain embodiments, the at least one leash has an elongate leash body extending generally circumferentially around a portion of the TE band and having a fold in the elongate leash body. In certain embodiments, the fold has a fold angle which can be increased during opening to extend a length of the leash. In certain embodiments, the fold is positioned about midway along the elongate leash body. In certain embodiments, when the cap body is in the closed configuration, a portion of the elongate leash body not including the fold extends in a manner substantially parallel to a rim of the cap body. In certain embodiments, the fold comprises a first fold arm moveably connected to a second fold arm, the first fold arm and the second fold arm being positioned substantially transversely to the portion of the elongate leash body not including the fold. In certain embodiments, when the cap body is in the closed configuration, a portion of the fold extends into a correspondingly shaped cut-out in the TE band.

In certain embodiments, the length of the leash is resiliently extendible.

In certain embodiments, the at least one leash comprises two leashes, and the at least one hinge comprises two hinges, each hinge of the two leashes being connected to the TE band and a given hinge, the tongue protruding from the cap body between the two hinges.

In certain embodiments, the closure device further comprises a groove defined in an outer surface of the cap body and extending at least partially circumferentially around the cap body and positioned above the tongue, such that when the cap body is in the fully open position, the groove is arranged to interact with a support ledge on the outer surface of the neck to retain the cap body in the fully open position. In certain embodiments, the groove extends partially around a circumference of the cap body.

In certain embodiments, a free end of the lip has a distance of extension from the tongue which is greater than a distance of extension of the rib from the TE band. In certain embodiments, the tongue protrudes downwardly from the cap body, and the lip extends substantially transversely from a free end of the tongue, such that a profile of the tongue and the lip is "L" shaped.

From another aspect, there is provided a closure device for a container, the container having a neck including an annular flange along an exterior surface of the neck, the closure device comprising: a cap body; a tamper evident (TE) band, the TE band defined such that, when assembled onto the container, the TE band is positioned below the annular flange for cooperation therewith; at least one hinge defined on the cap body; at least one leash connected to the TE band, the at least one leash allowing for the cap body to be separated from the TE band during opening, but to remain connected thereto via the at least one leash; the at least one leash having an elongate leash body extending generally circumferentially around a portion of the TE band and having a fold in the elongate leash body; wherein, when the cap body is actuated from a closed configuration to the fully open position: the at least one leash is configured to retain the cap body to the TE band; and a fold angle of the fold of the at least one leash increases to increase a distance between the cap body and the TE band.

In certain embodiments, the fold is positioned about midway along the elongate leash body. In certain embodiments, when the cap body is in the closed configuration, a portion of the elongate leash body not including the fold extends in a manner substantially parallel to a rim of the cap body. In certain embodiments, the fold comprises a first fold arm moveably connected to a second fold arm, the first fold arm and the second fold arm being positioned substantially transversely to the portion of the elongate leash body not including the fold. In certain embodiments, when the cap body is in the closed configuration, a portion of the fold extends into a correspondingly shaped cut-out in the TE band.

In certain embodiments, the leash is arranged such that the length of the leash is resiliently extendible.

In certain embodiments, a connection point of the at least one leash to the TE band is circumferentially spaced from a connection point of the at least one leash to the at least one hinge.

In certain embodiments, the at least one leash comprises two leashes, and the at least one hinge comprises two hinges, each hinge of the two leashes being connected to the TE band and a given hinge.

In certain embodiments, the closure device further comprises a tongue protruding from the cap body between the two leashes, the tongue having a lip extending therefrom.

In certain embodiments, the closure device further comprises a tongue protruding from the cap body adjacent the at least one hinge, the tongue having a lip extending therefrom.

In certain embodiments, the tongue protrudes downwardly from the cap body, and the lip extends substantially transversely from a free end of the tongue, such that a profile of the tongue and the lip is "L" shaped.

In certain embodiments, the closure device further comprises a groove defined in an outer surface of the cap body and extending at least partially circumferentially around the cap body and positioned above the tongue, such that when the cap body is in the fully open position, the groove is arranged to interact with a support ledge on the outer surface of the neck to retain the cap body in the fully open position. In certain embodiments, the groove extends partially around a circumference of the cap body.

In certain embodiments, the closure device further comprises at least one rib on the TE band and positioned below the tongue when the cap body is in the closed configuration relative to the neck, wherein, when the cap body is actuated from the closed configuration to the fully open position: the lip is arranged to interact with the at least one rib in the fully open position. In certain embodiments, the at least one rib extends in a direction from the TE band to the cap body. In certain embodiments, the at least one rib extends from a lower end of the TE band and stops short of an upper end of the TE band. In certain embodiments, the at least one rib comprises two ribs, spaced from one another and extending substantially parallel to one another, on the TE band.

In certain embodiments, a free end of the lip has a distance of extension from the tongue which is greater than a distance of extension of the rib from the TE band.

From another aspect, there is provided a closure device for a container, the container having a neck including an annular flange along an exterior surface of the neck, the closure device comprising: a cap body; a tamper evident (TE) band, the TE band defined such that, when assembled onto the container, the TE band is positioned below the annular flange for cooperation therewith; at least one hinge defined on the cap body; at least one leash connected to the TE band and the at least one hinge, the at least one leash allowing for the cap body to be separated from the TE band during opening, but to remain connected thereto via the at least one leash; a tongue protruding from the cap body adjacent the at least one hinge, the tongue having a lip extending outwardly therefrom; a groove defined in an outer surface of the cap body and extending at least partially circumferentially around the cap body and positioned above the tongue, wherein, when the cap body is actuated from a closed configuration to a fully open position: the at least one leash is configured to retain the cap body to the TE band; the lip is arranged to interact with an outer surface of the TE band when the cap body is in the fully open position; and the groove is arranged to interact with the annular flange and to retain the cap body in the fully open position. In certain embodiments, the groove extends partially around a circumference of the cap body.

In certain embodiments, the at least one leash has an elongate leash body extending generally circumferentially around a portion of the TE band and a fold is provided in the elongate leash body; wherein, when the cap body is actuated from the closed configuration to the fully open position: the at least one leash is configured to retain the cap body to the TE band; and a fold angle of the fold of the at least one leash increases such that a length of the at least one leash increases.

In certain embodiments, the leash is arranged such that the length of the leash is resiliently extendible.

In certain embodiments, the fold is positioned about midway along the elongate leash body. In certain embodiments, when the cap body is in the closed configuration, a portion of the elongate leash body not including the fold extends in a manner substantially parallel to a rim of the cap body. In certain embodiments, the fold comprises a first fold arm moveably connected to a second fold arm, the first fold arm and the second fold arm being positioned substantially transversely to the portion of the elongate leash body not including the fold. In certain embodiments, when the cap body is in the closed configuration, a portion of the fold extends into a correspondingly shaped cut-out in the TE band.

In certain embodiments, a connection point of the at least one leash to the TE band is circumferentially spaced from a connection point of the at least one leash to the at least one hinge.

In certain embodiments, the at least one leash comprises two leashes, and the at least one hinge comprises two hinges, each hinge of the two leashes being connected to the TE band and a given hinge.

In certain embodiments, the tongue protrudes downwardly from the cap body, and the lip extends substantially transversely from a free end of the tongue, such that a profile of the tongue and the lip is "L" shaped. In certain embodiments, the closure device further comprises at least one rib on the TE band and positioned below the tongue when the cap body is in the closed configuration relative to the neck, wherein, when the cap body is actuated from the closed configuration to the fully open position, the lip is arranged to interact with the at least one rib in the fully open position. In certain embodiments, the at least one rib extends in a direction from the TE band to the cap body. In certain embodiments, the at least one rib extends from a lower end of the TE band and stops short of an upper end of the TE band. In certain embodiments, the at least one rib comprises two ribs, spaced from one another and extending substantially parallel to one another, on the TE band. In certain embodiments, a free end of the lip has a distance of extension from the tongue which is greater than a distance of extension of the rib from the TE band.

From another aspect, there is provided a mold for forming a closure device by injection molding, the mold comprising a female cavity piece and a male core piece, the female cavity piece and the male core piece defining a molding cavity configured to form the closure device as described herein.

These and other aspects and features of non-limiting embodiments will now become apparent to those skilled in the art upon review of the following description of specific non-limiting embodiments in conjunction with the accompanying drawings.

DETAILED DESCRIPTION OF THE DRAWINGS

The non-limiting embodiments will be more fully appreciated by reference to the accompanying drawings, in which.

Figure 2:
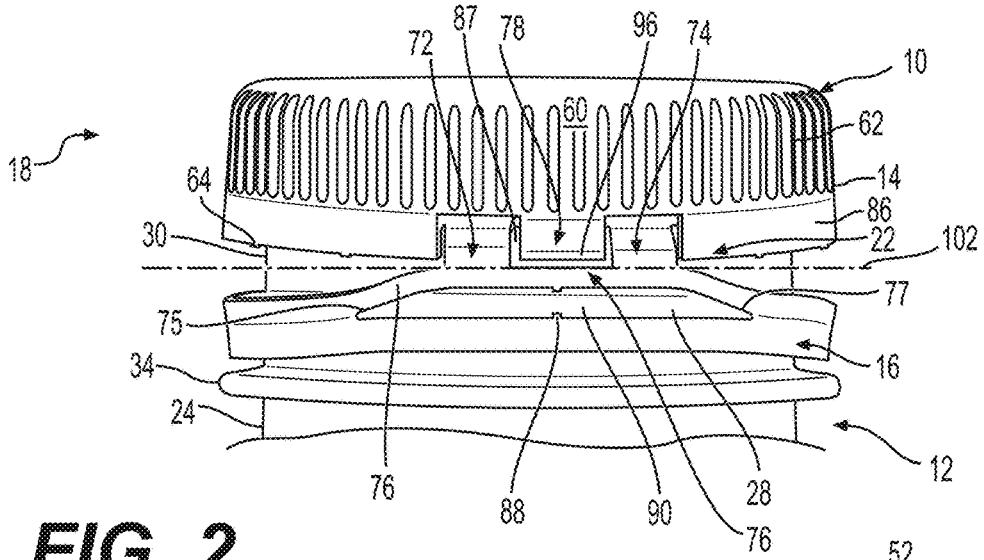
FIG. 2 is a side view of the closure device of FIG. 1 when the closure device is in the closed and unlocked configuration, in accordance with some embodiments of the present technology.
Figure 4:
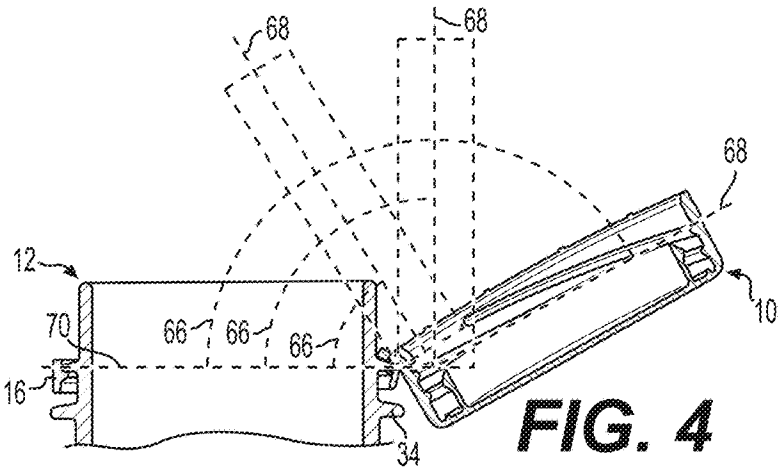
FIG. 4 is the perspective sectional view of the closure device of FIG. 3 and showing different open positions of the open configuration, in accordance with some embodiments of the present technology.
Figure 6C:
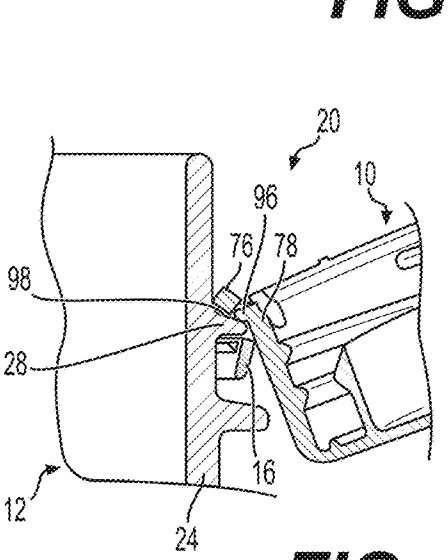
Figure 6B:
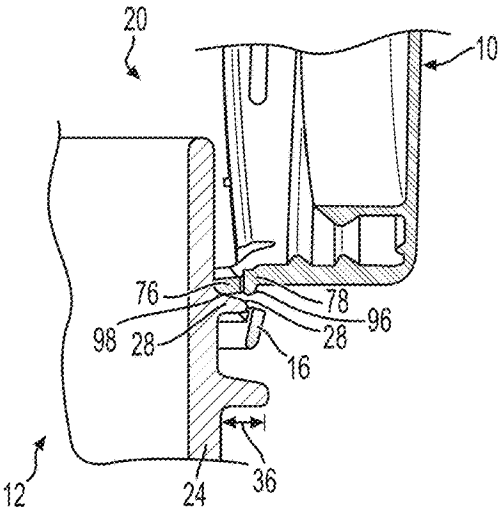
Figure 6A:
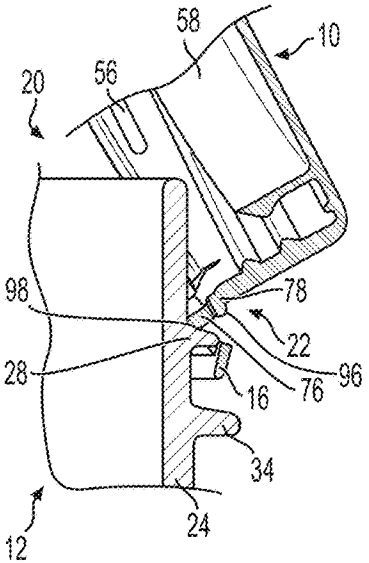
Figure 7:
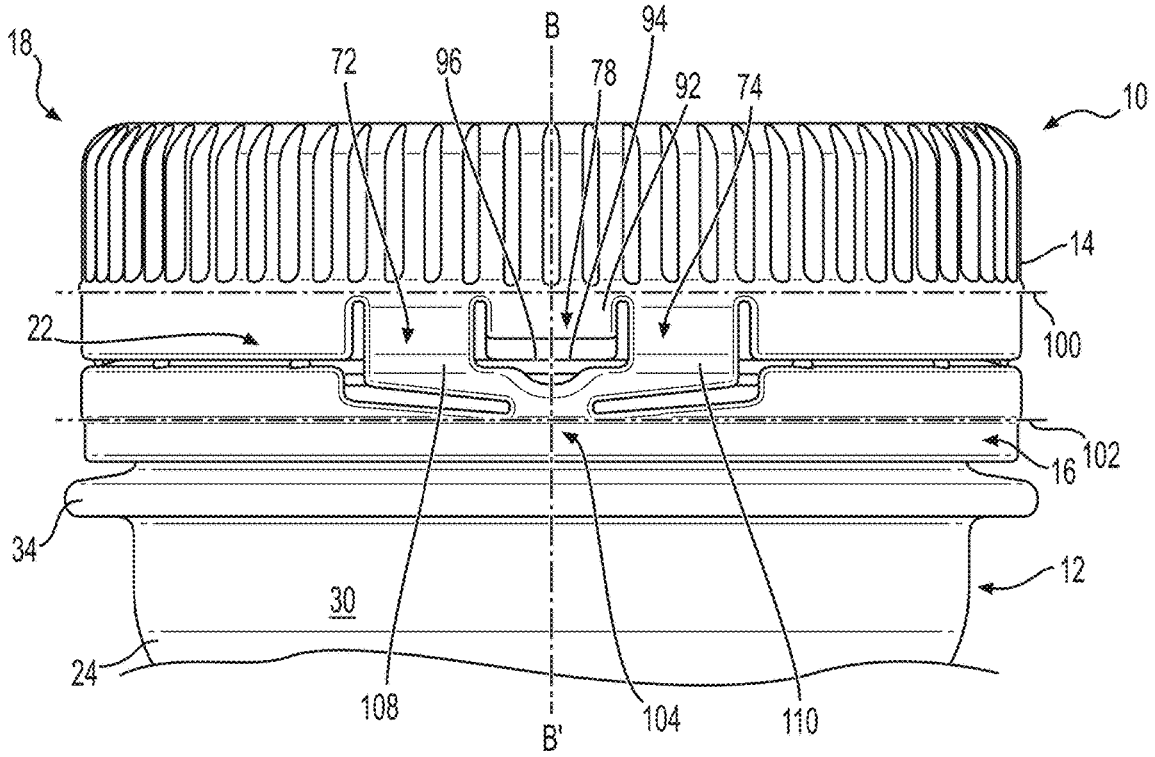
Figure 8:
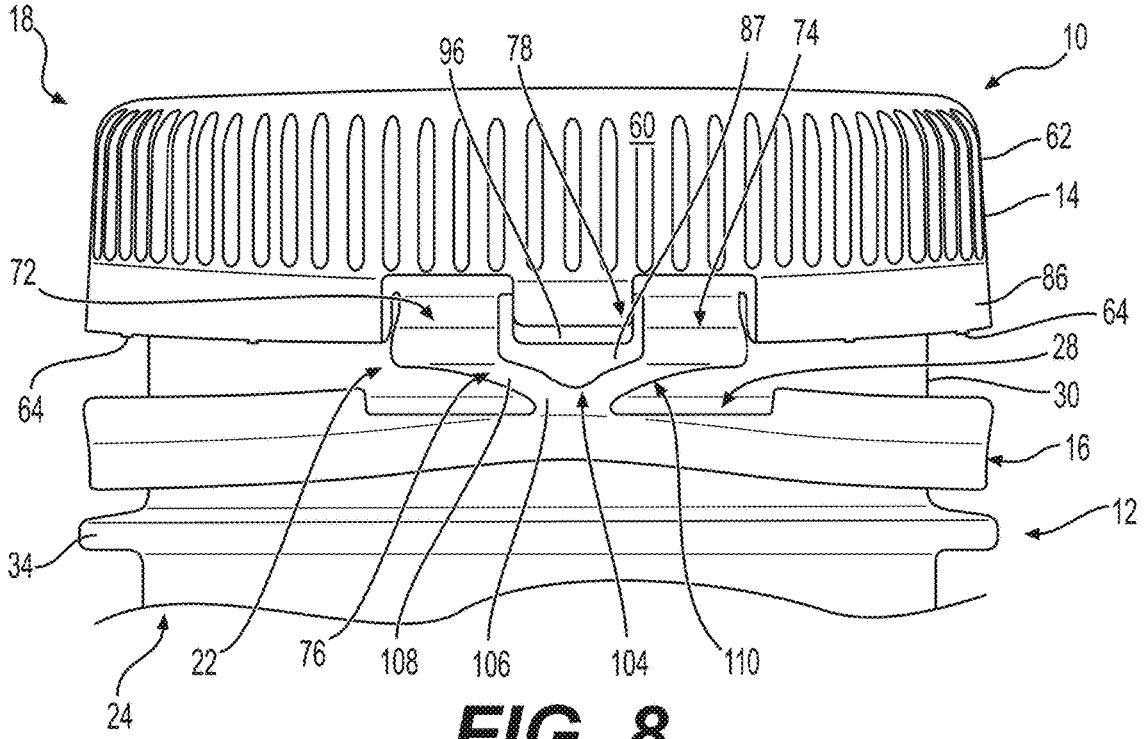
Figure 9:
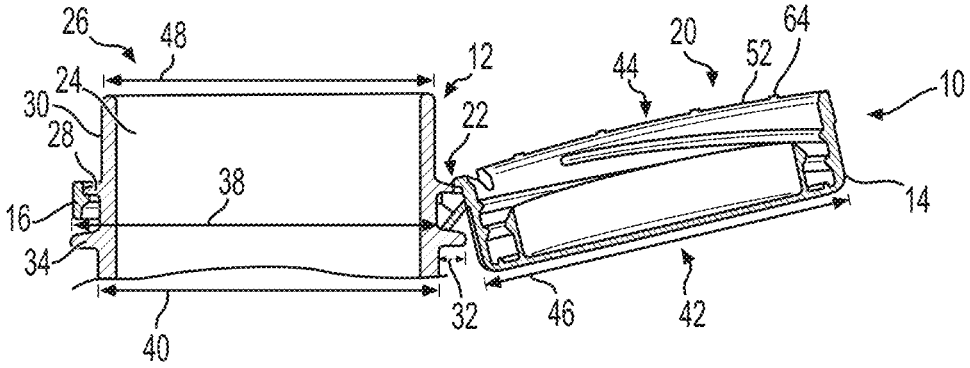
Figure 10:
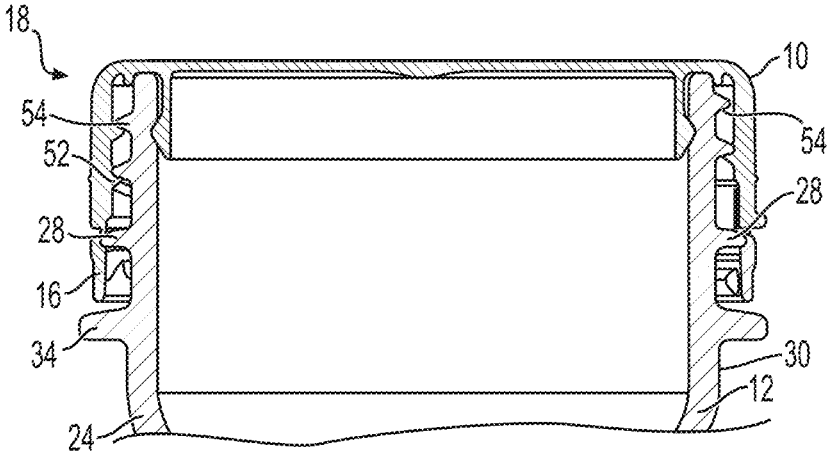
Figure 12:
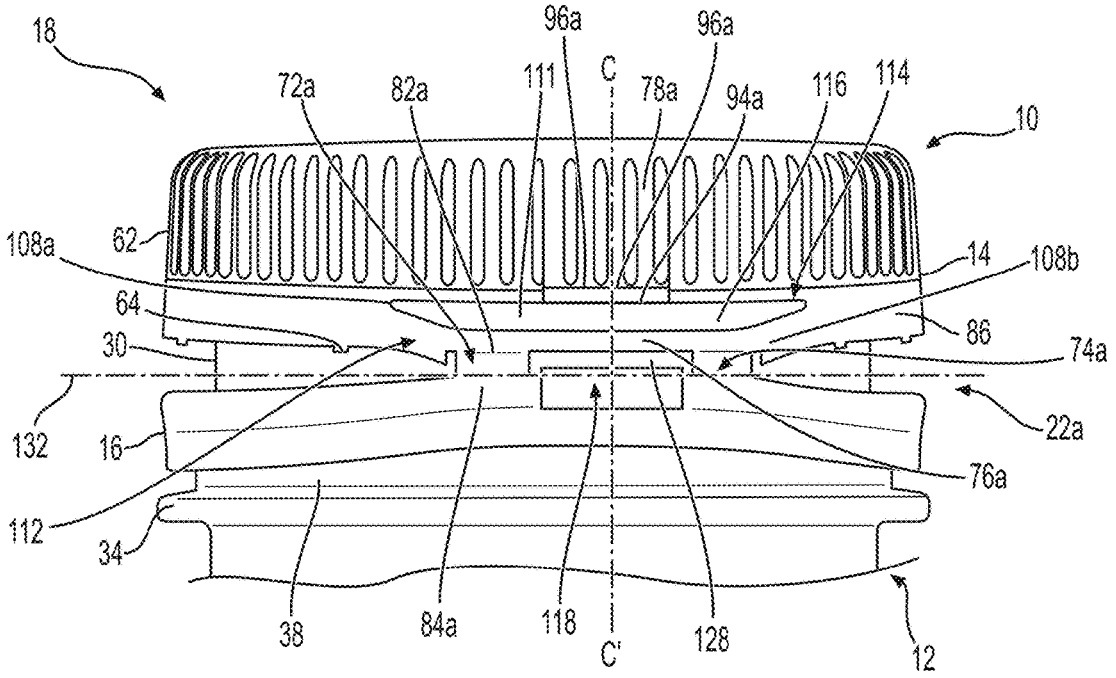
Figure 13:
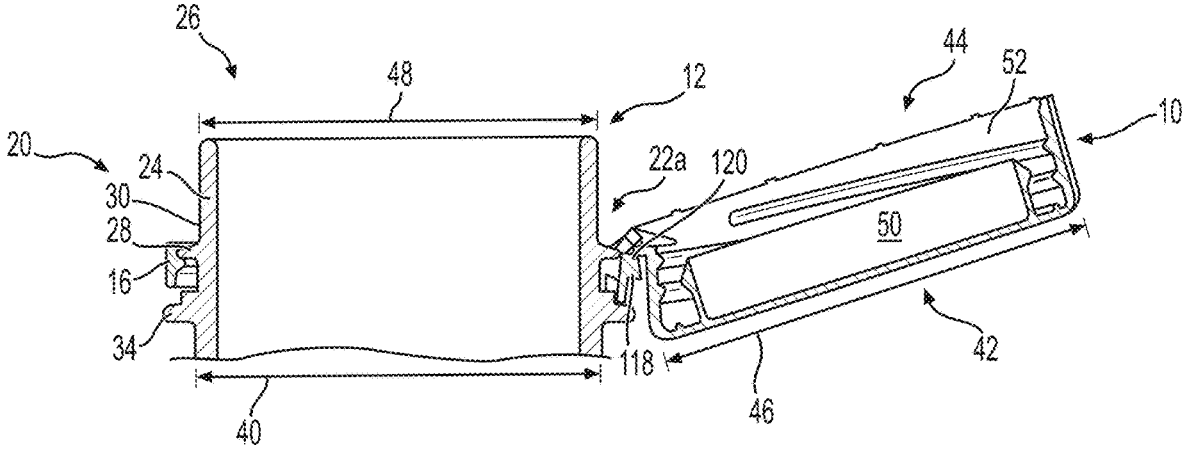
Figure 15:
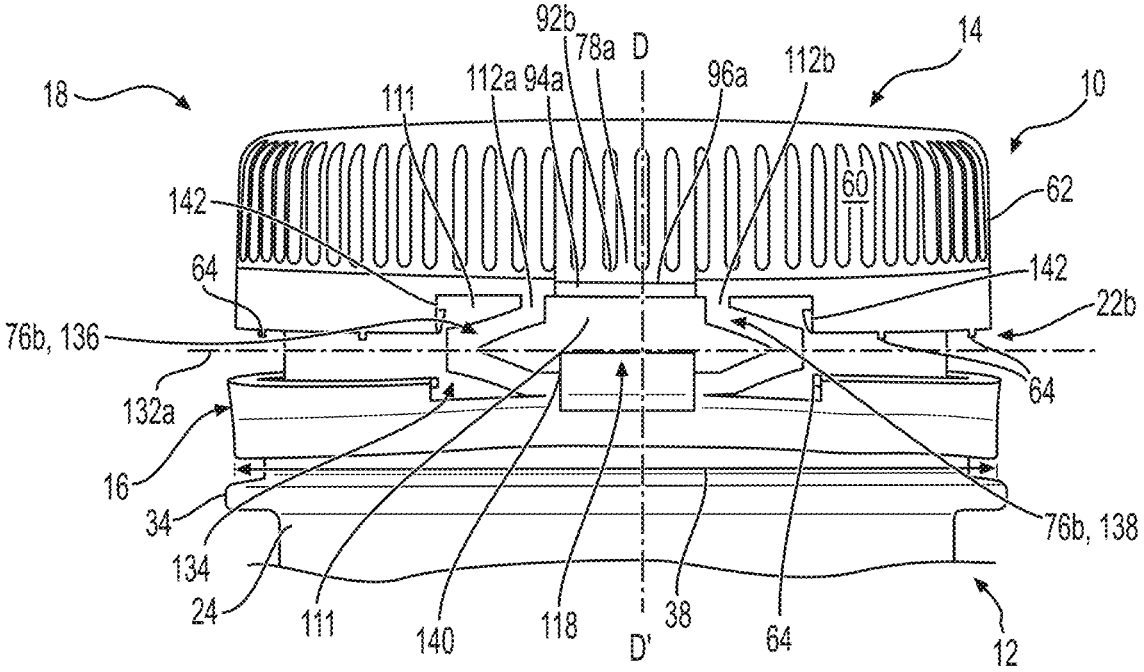
Figure 16:
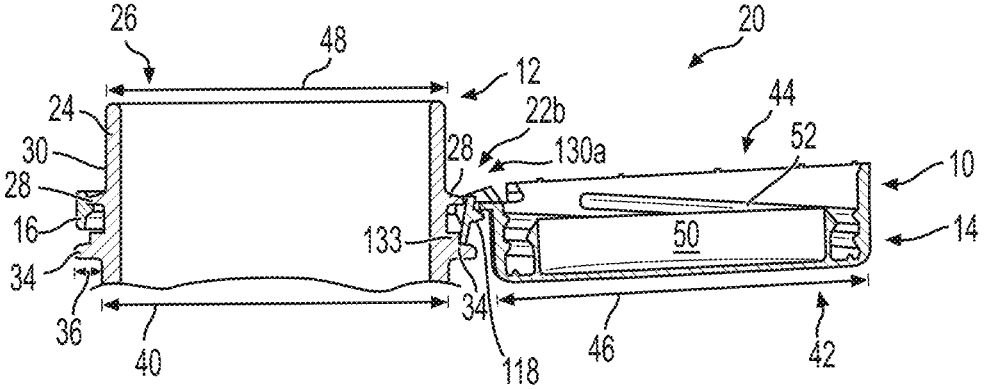
Figure 17A:
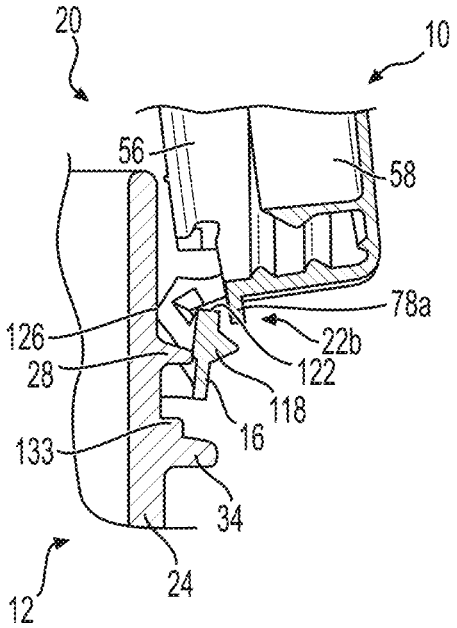
Figure 17B:
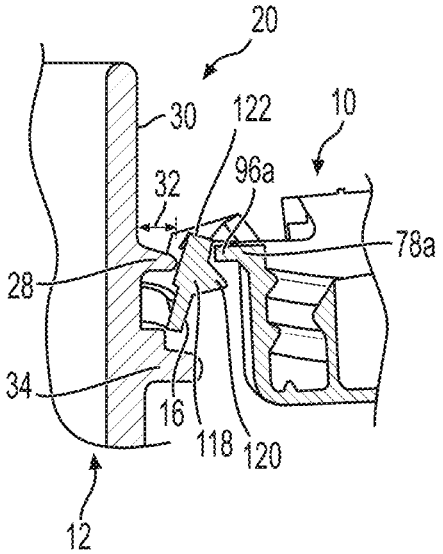
Figure 17C:
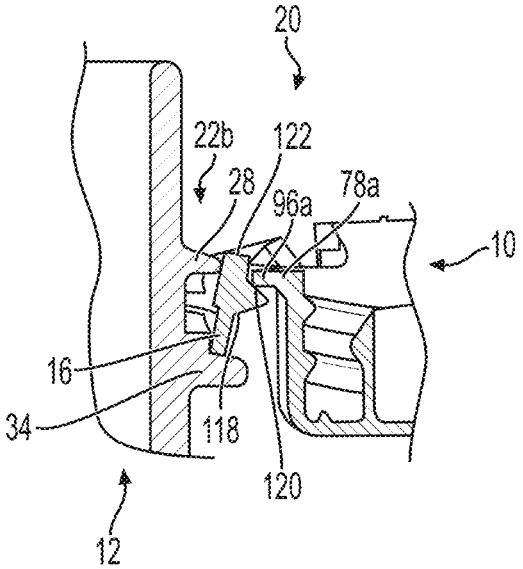
Figure 18A:
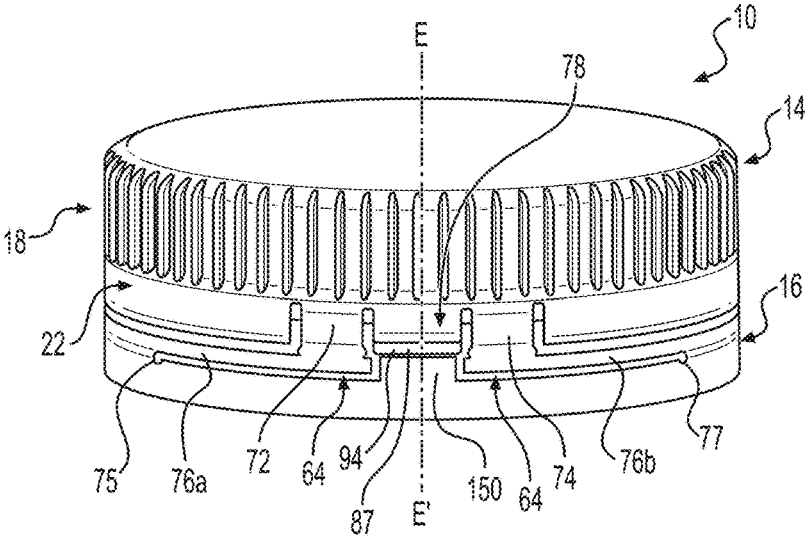
Figure 18B:
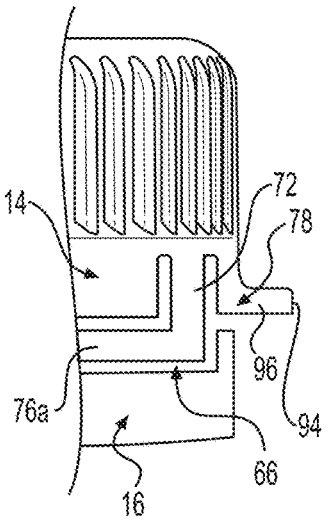
Figure 19:
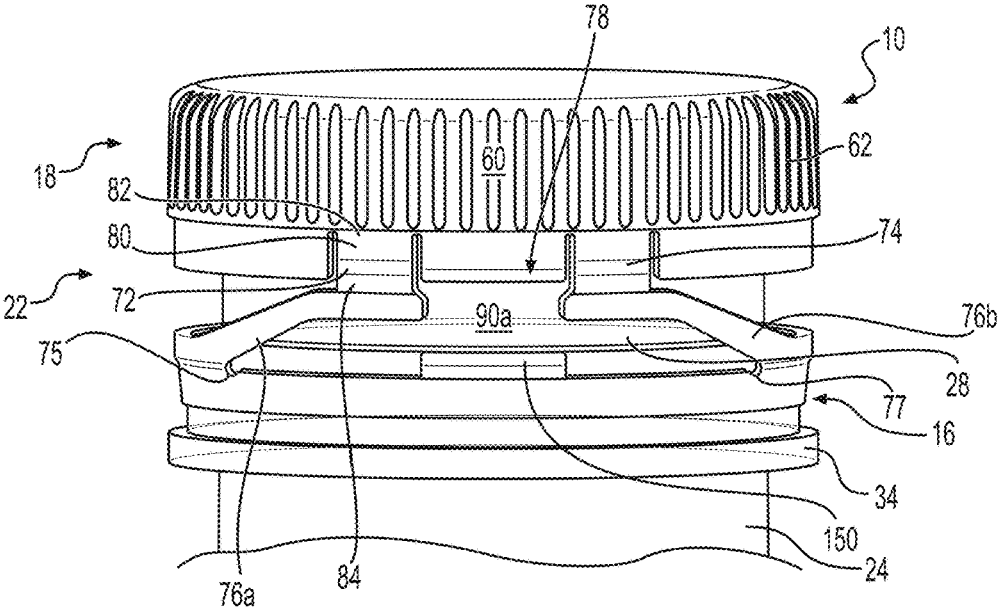
Figure 20:
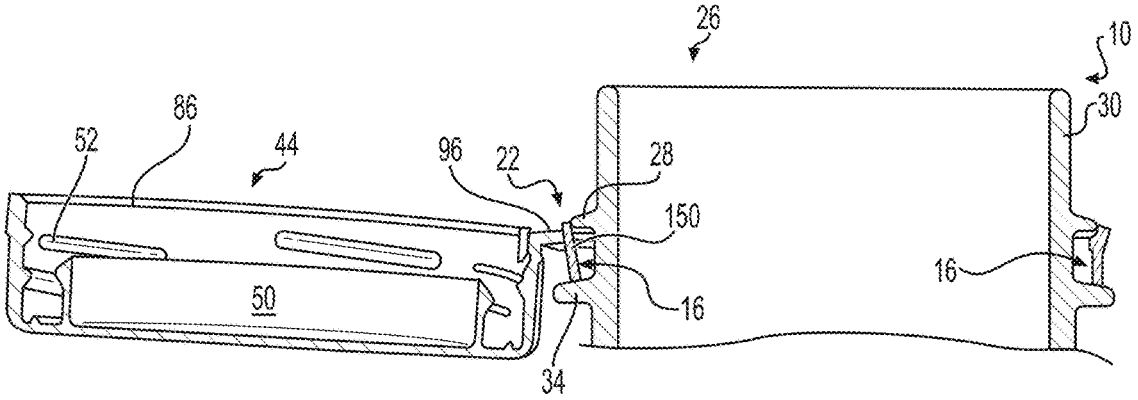
Figure 21A:
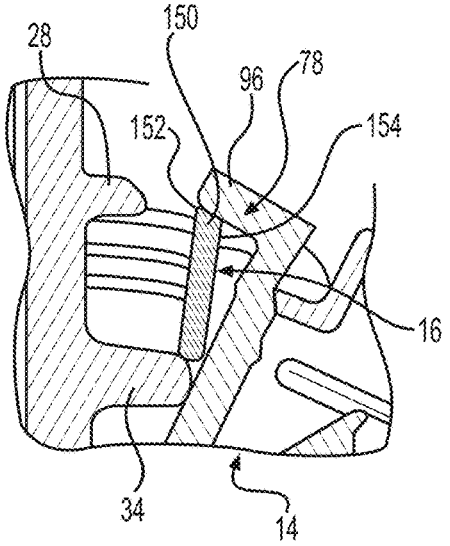
Figure 22:
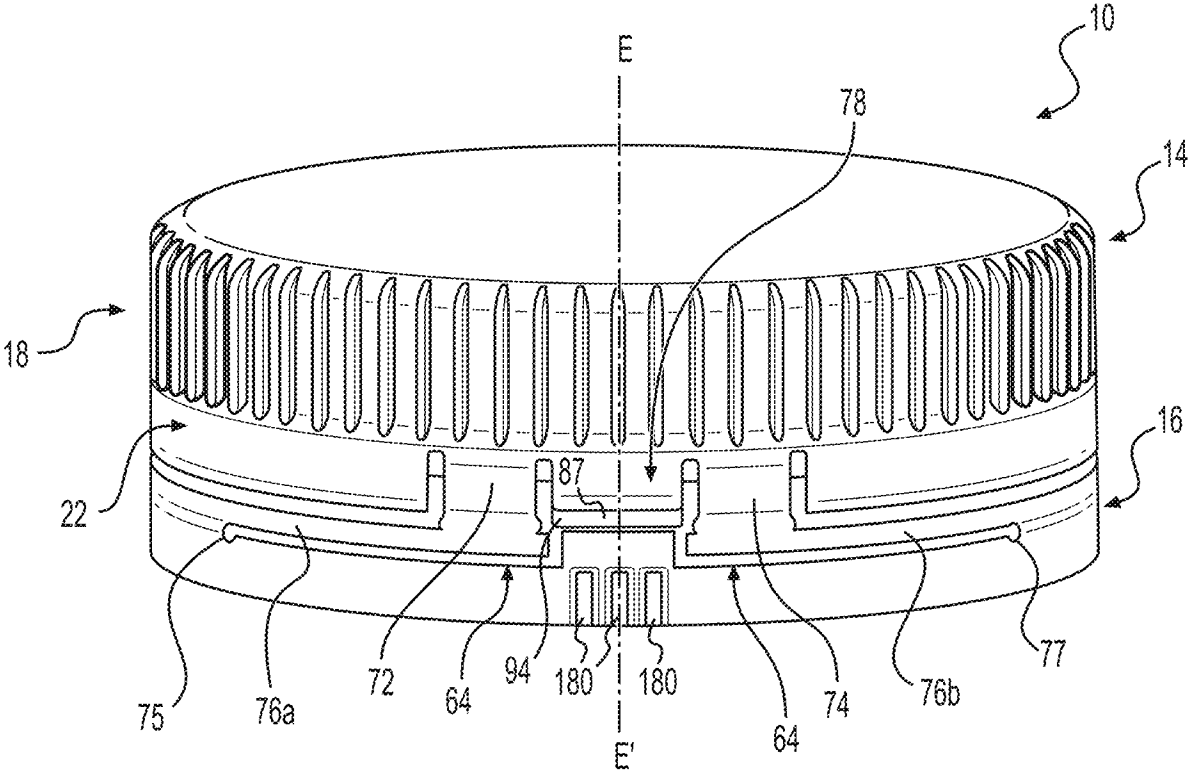
Figure 23:
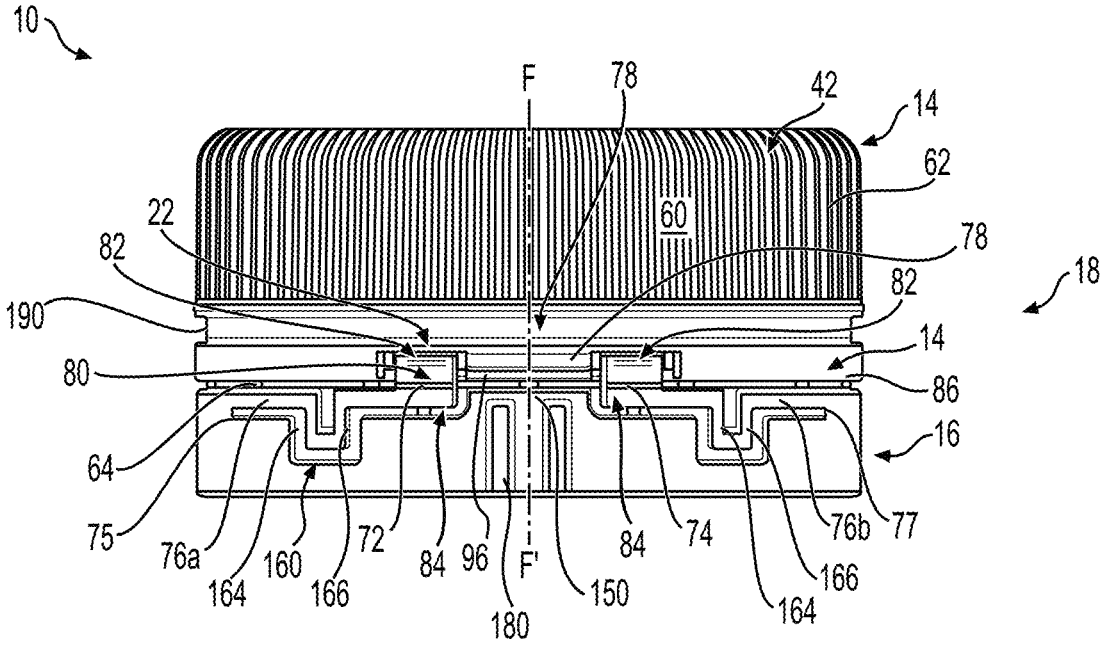
Figure 24:
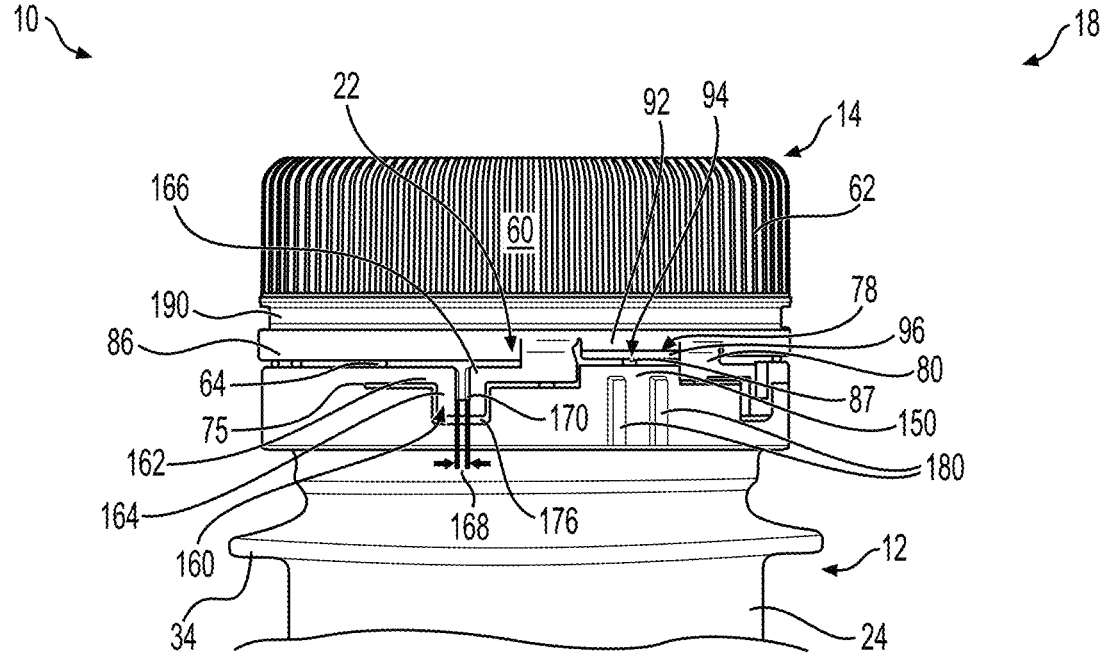
Figure 25:
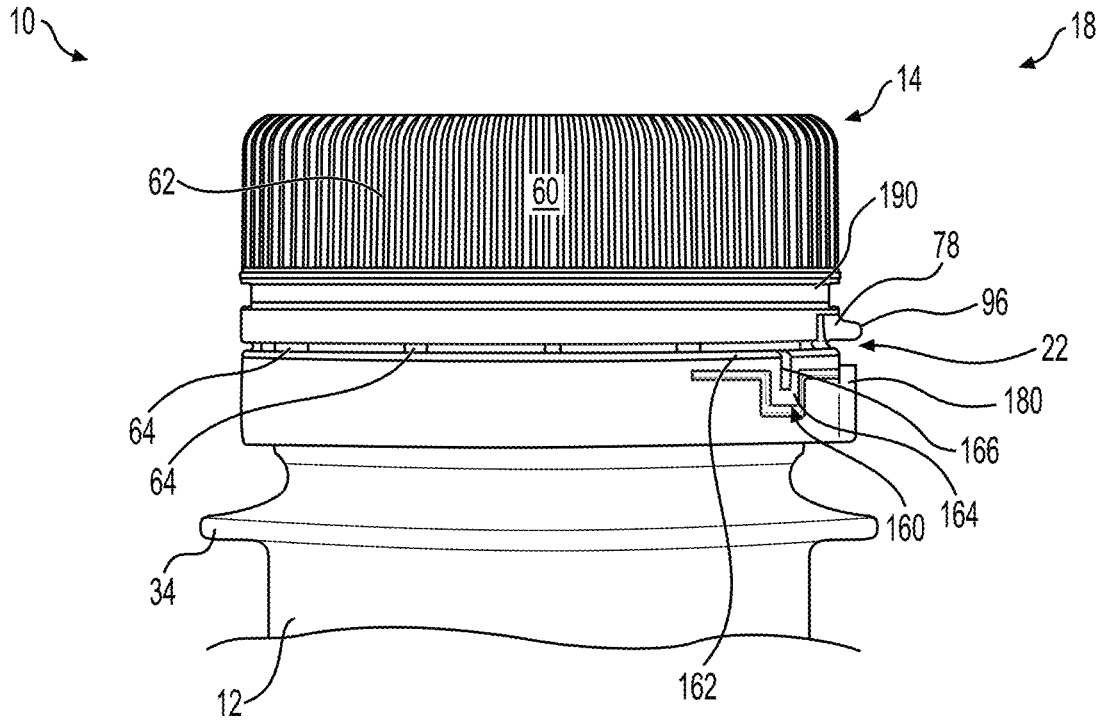
Figure 26:
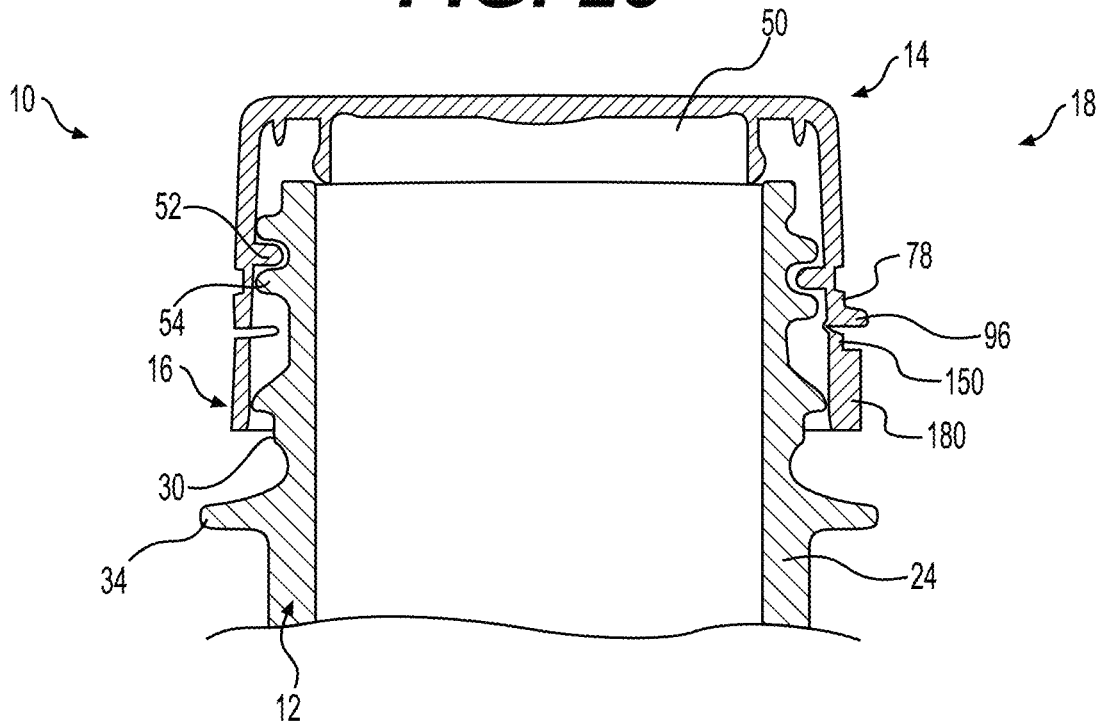
Figure 27A:
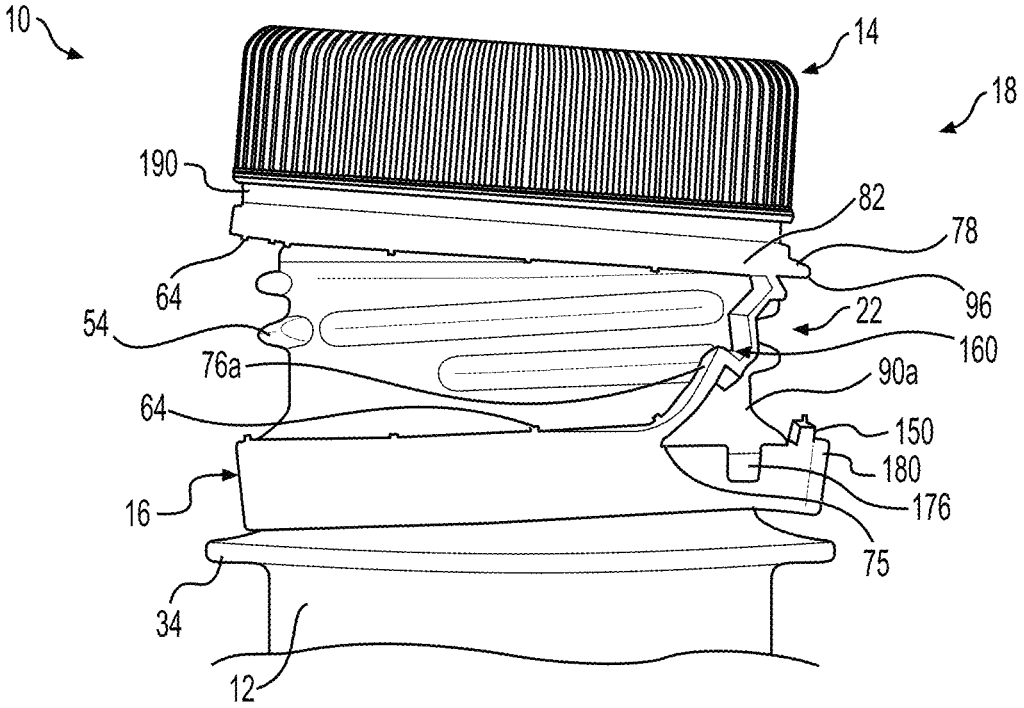
Figure 27B:
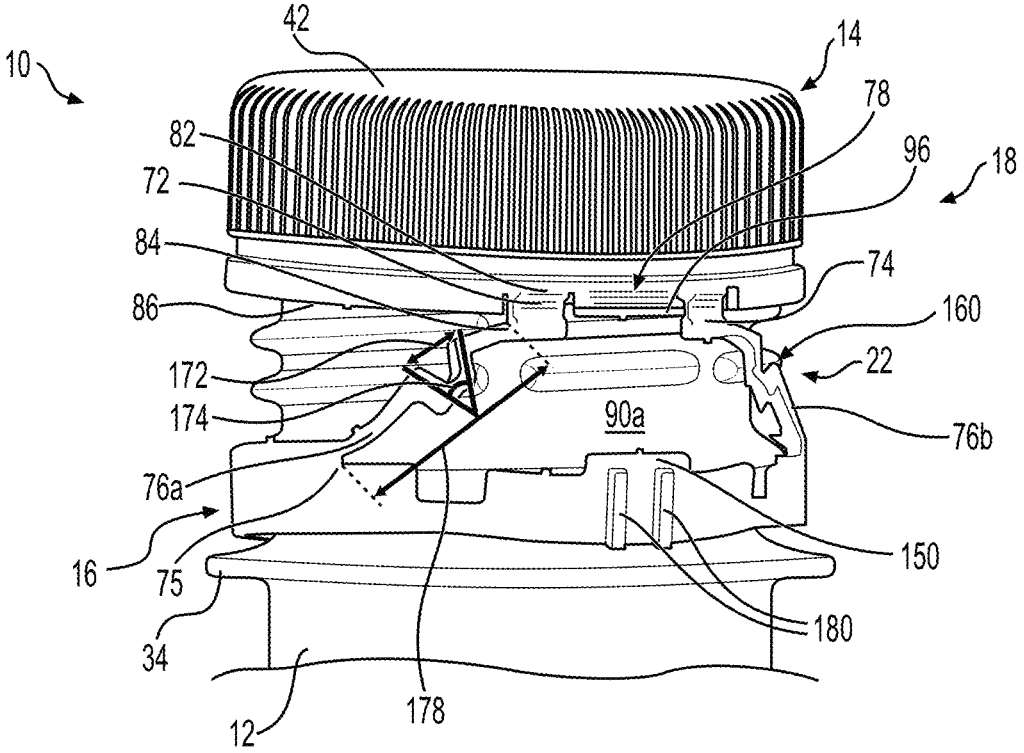
Figure 28A:
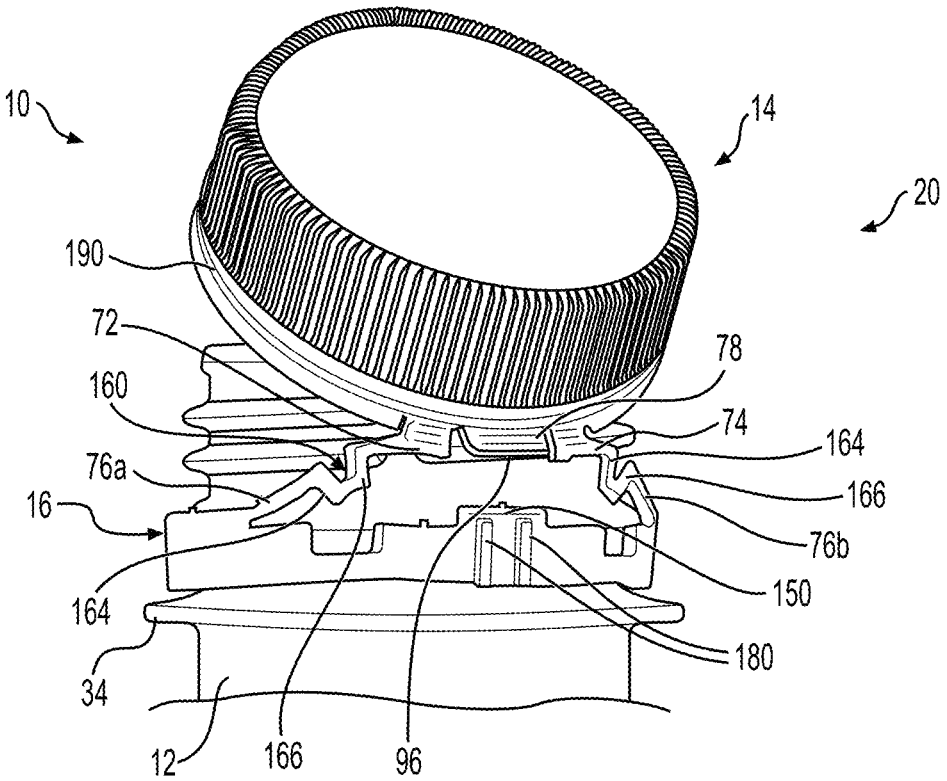
Figure 28B:
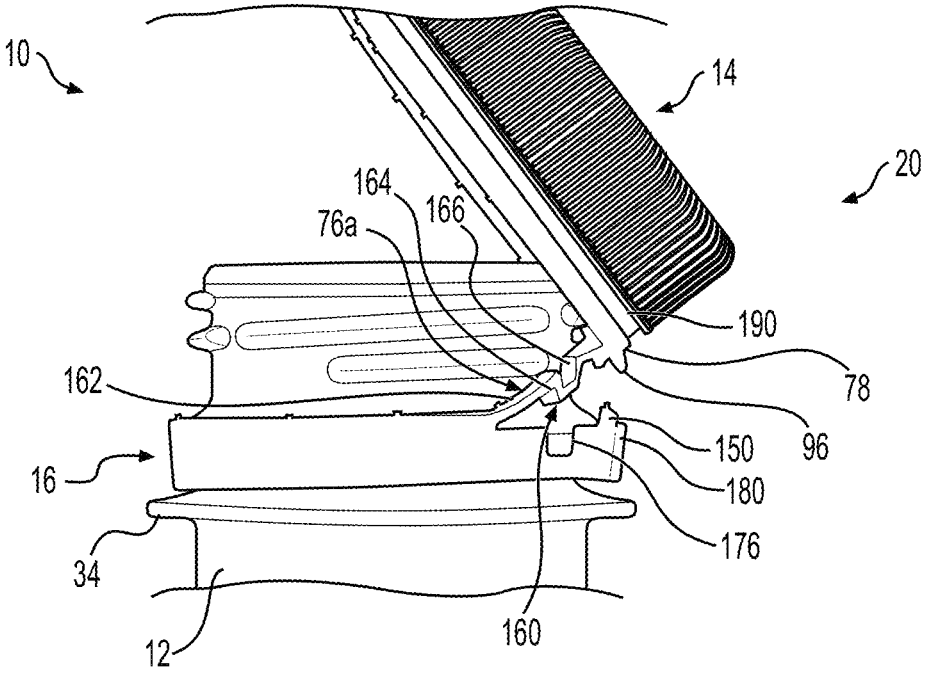
Figure 29A:
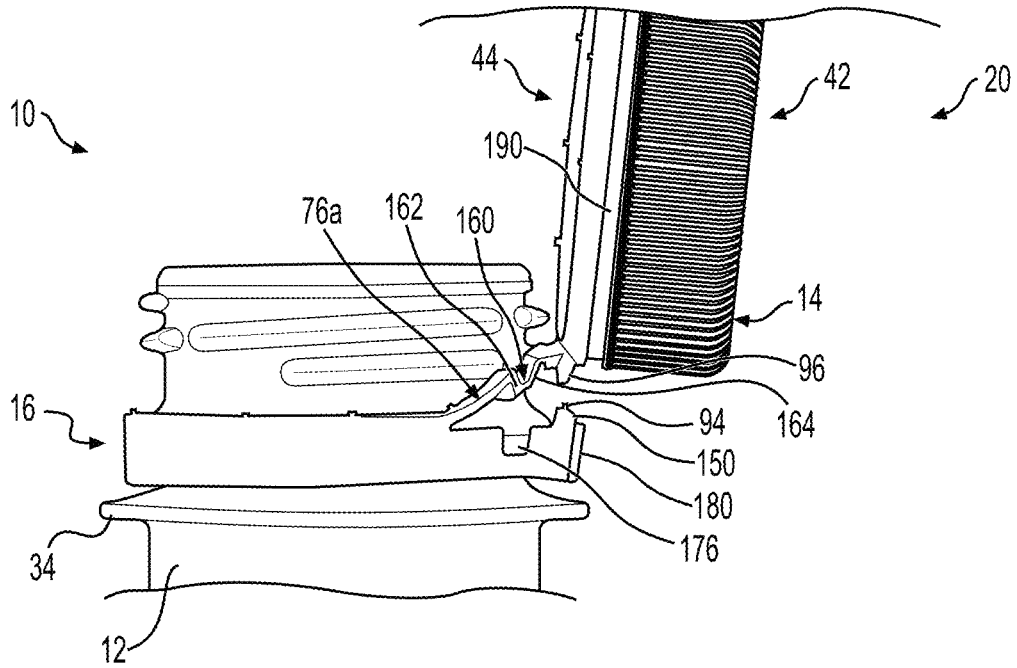
Figure 29B:
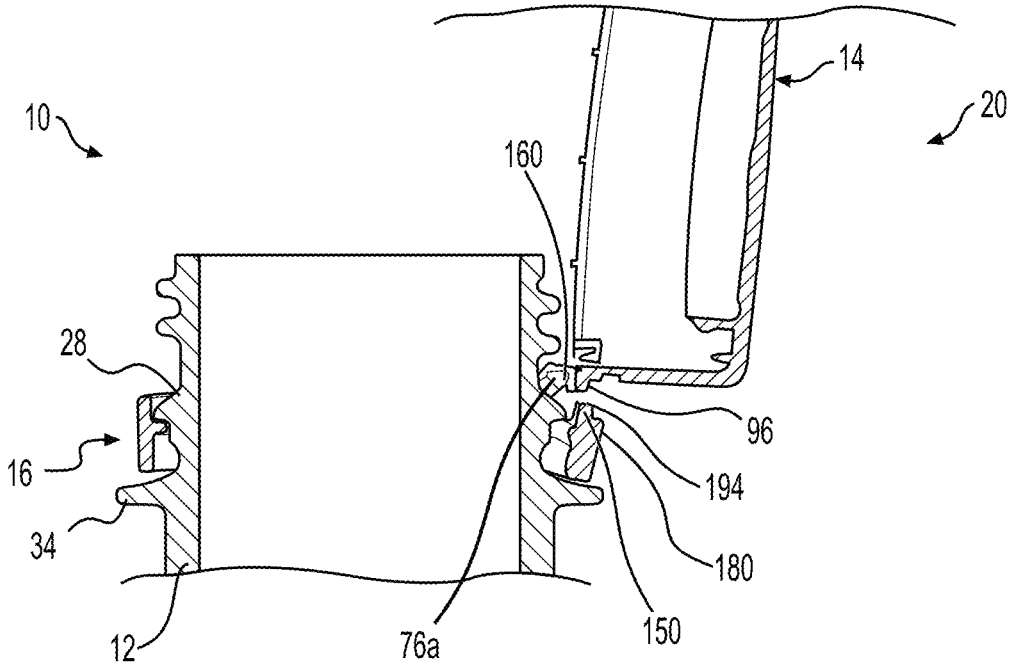
Figure 30A:
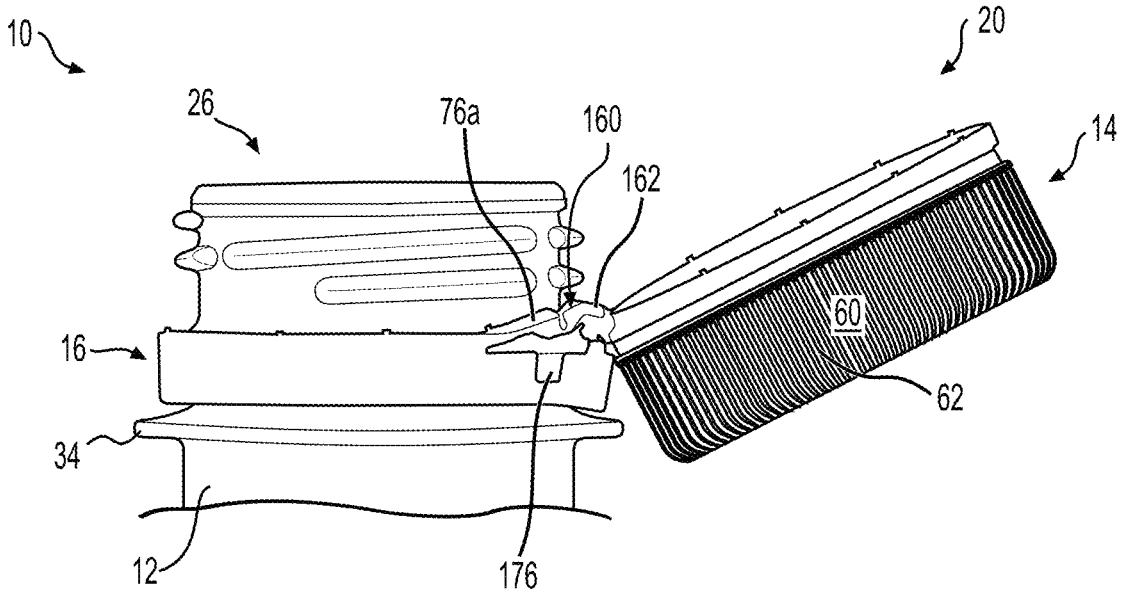
Figure 30B:
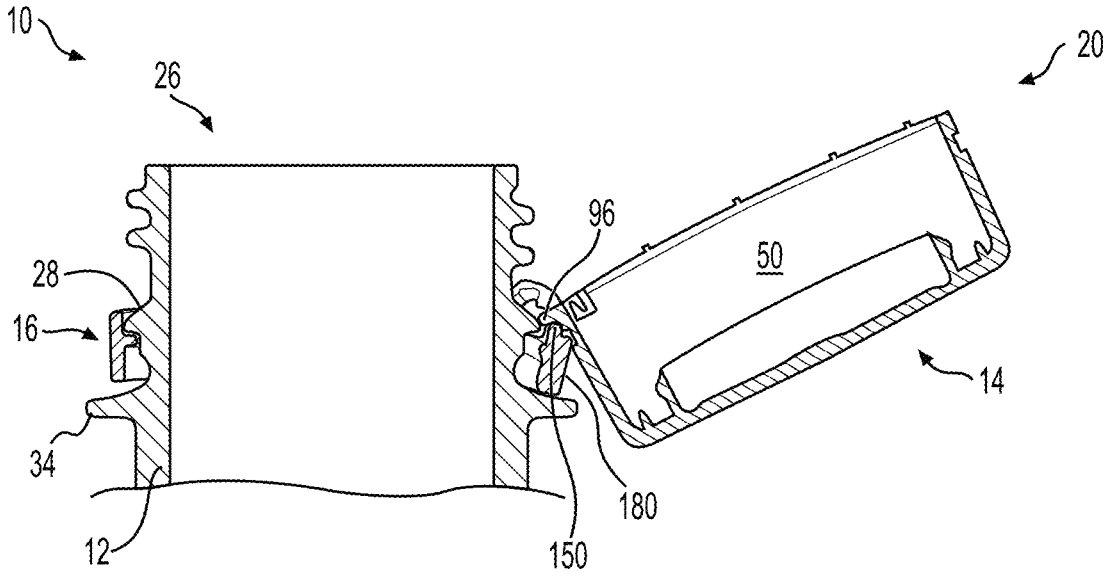
Figure 31A:
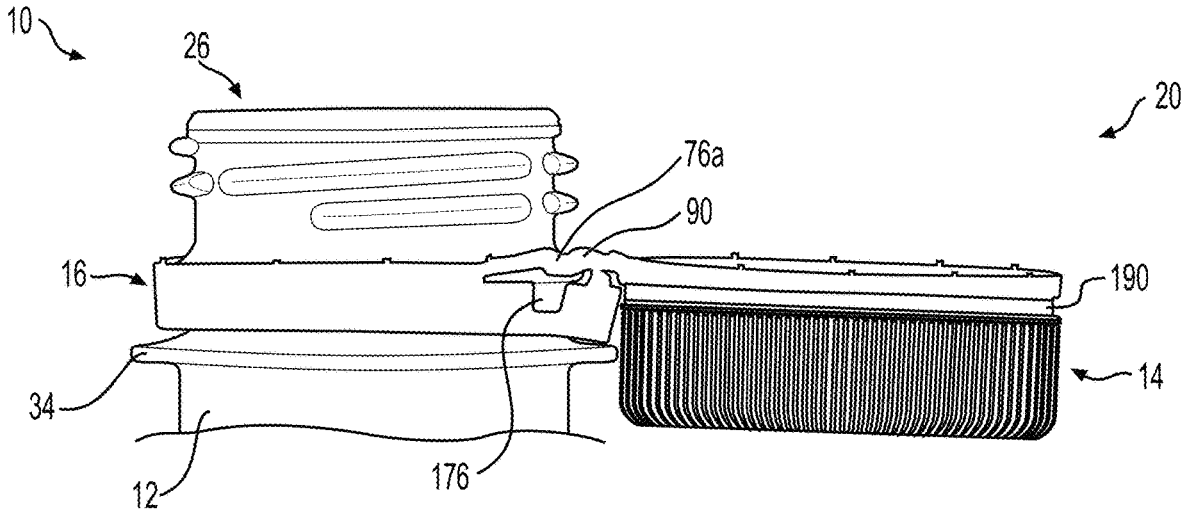
Figure 31B:
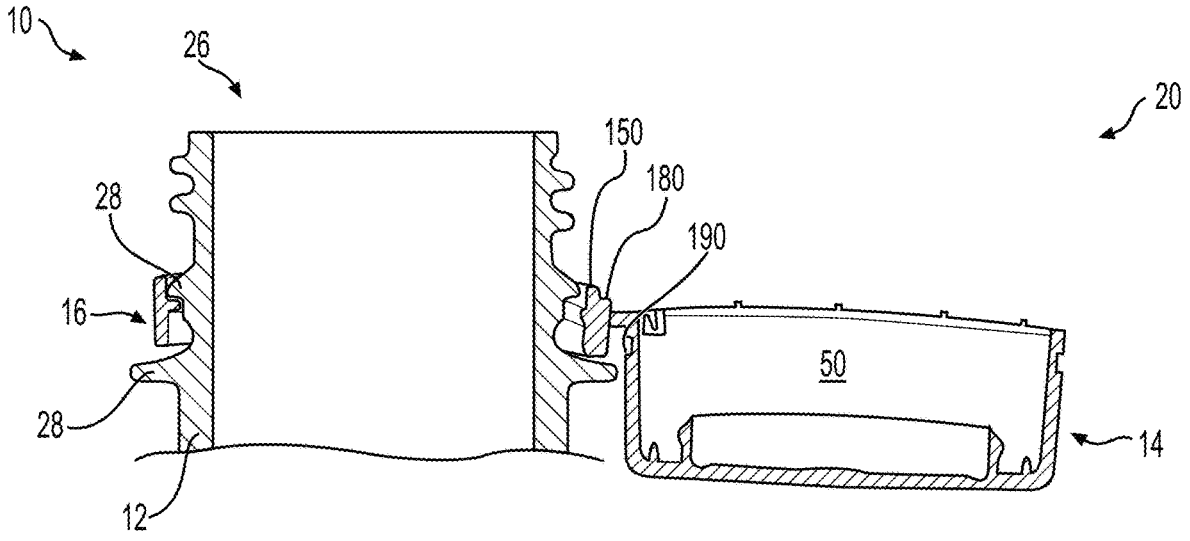
Figure 32A:
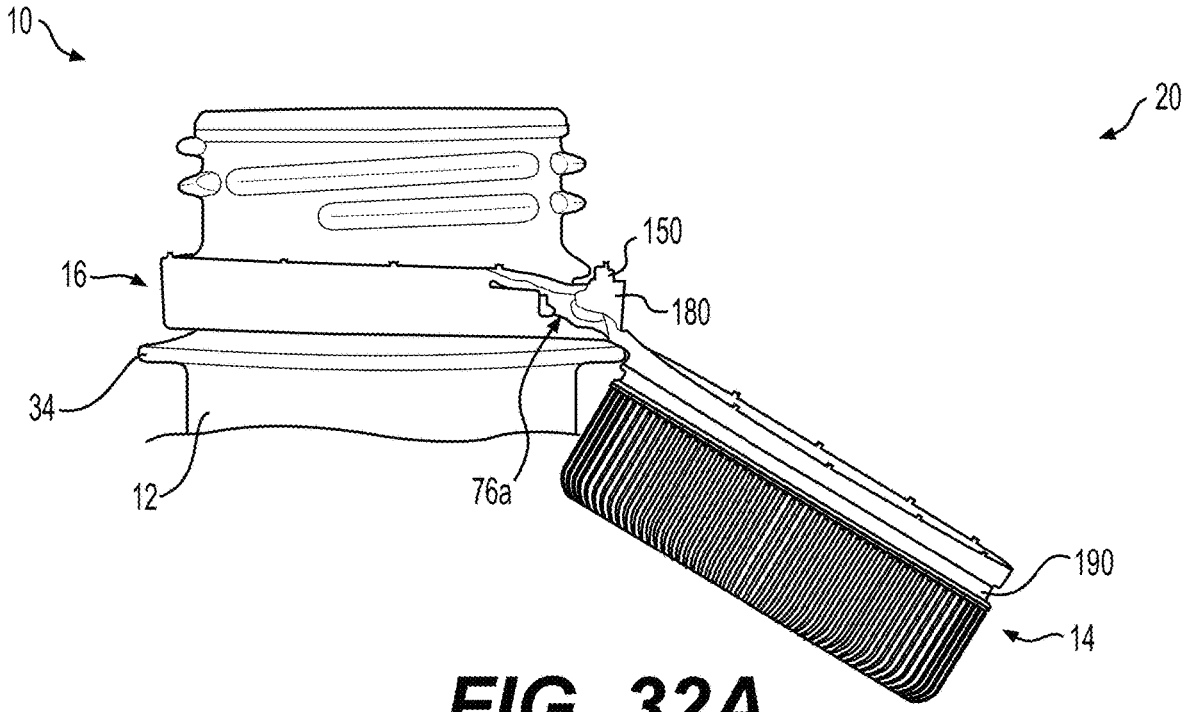
Figure 32B:
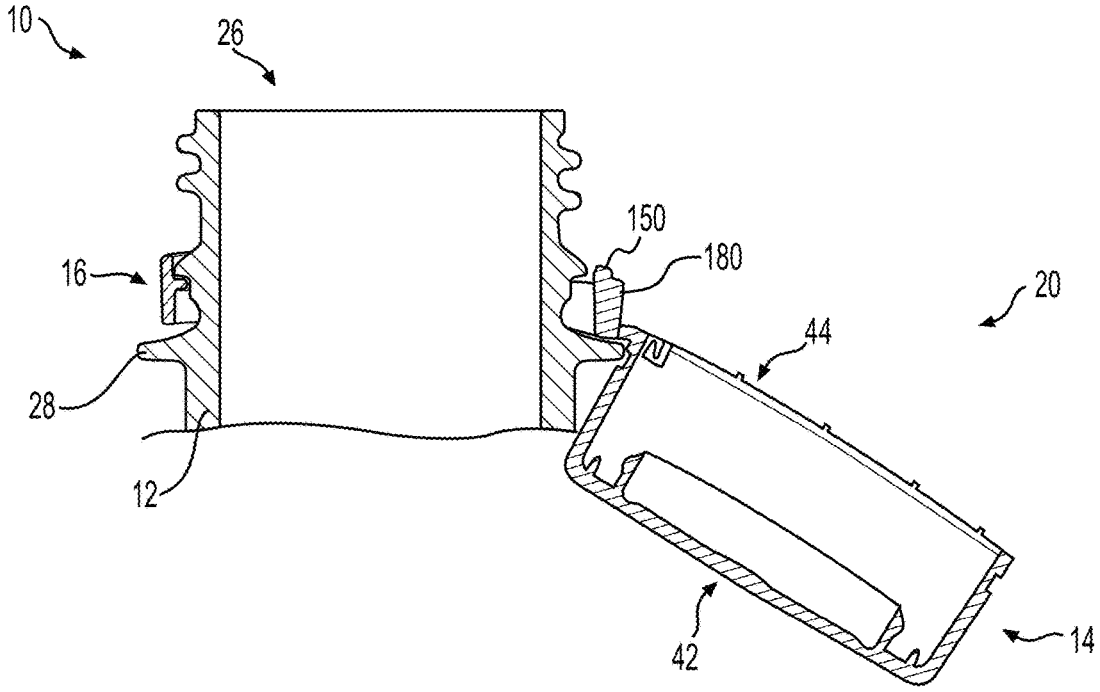
Figure 33A:
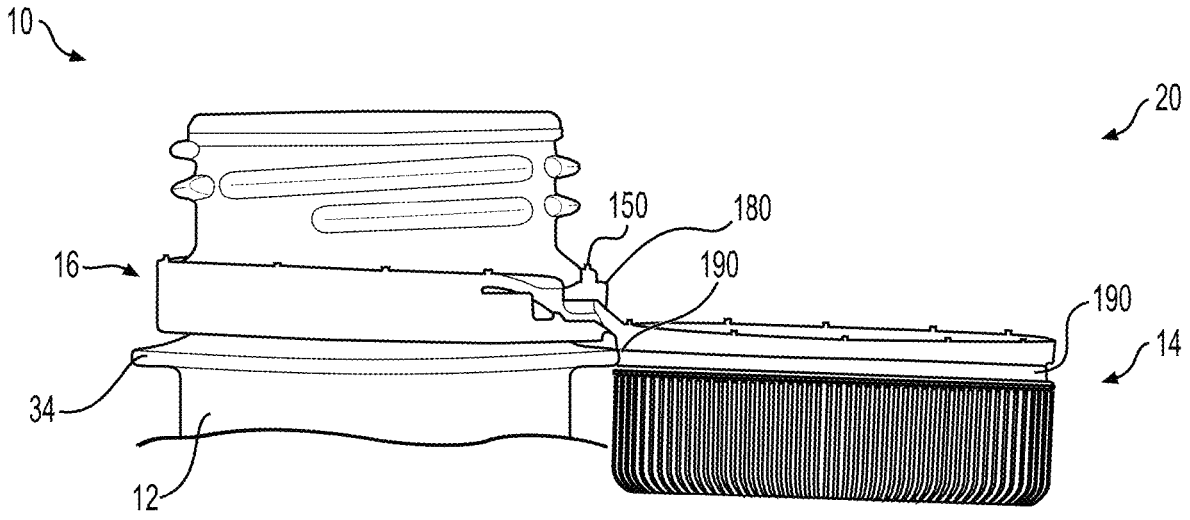
Figure 33B:
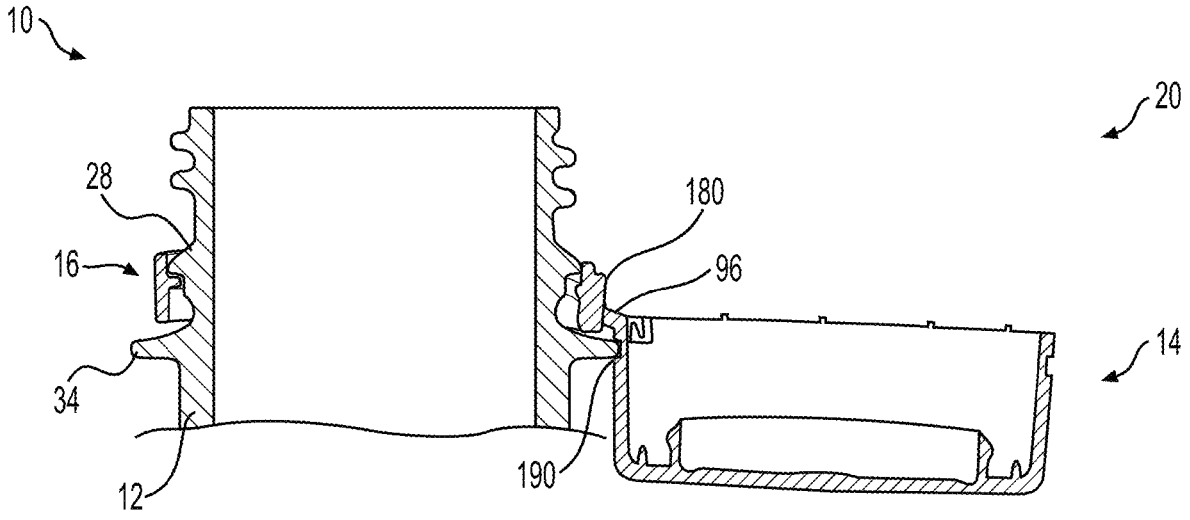
Figure 33C:
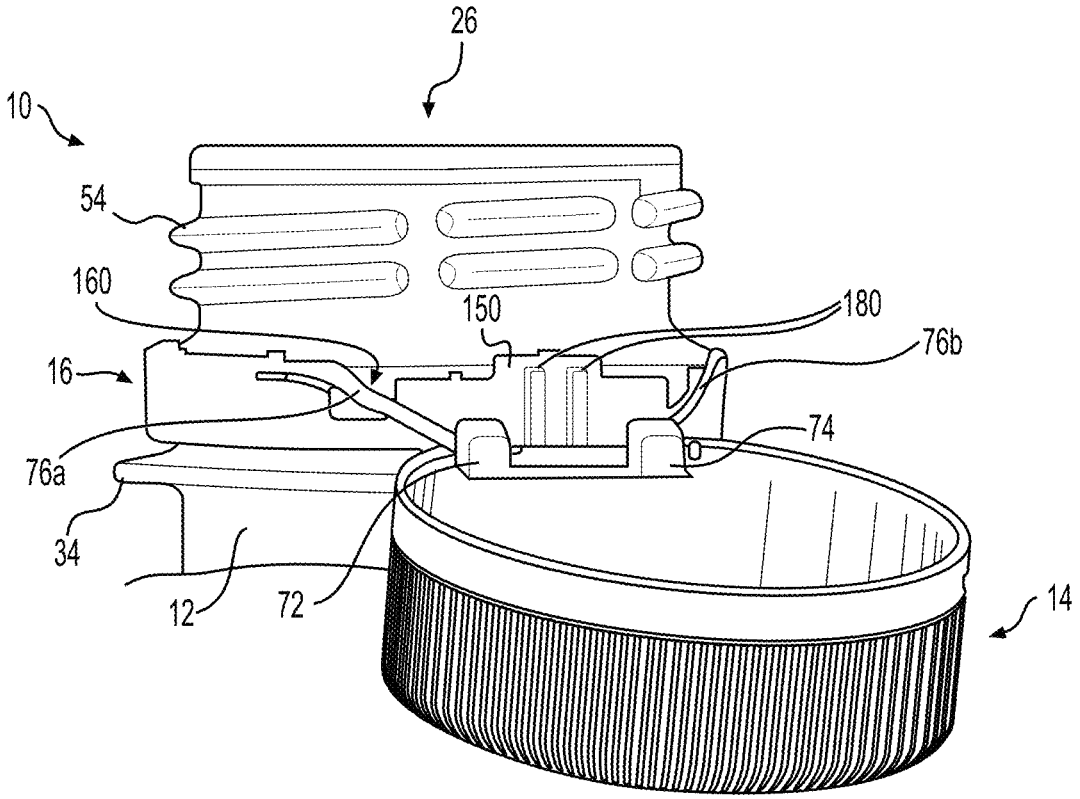
Figure 34A:
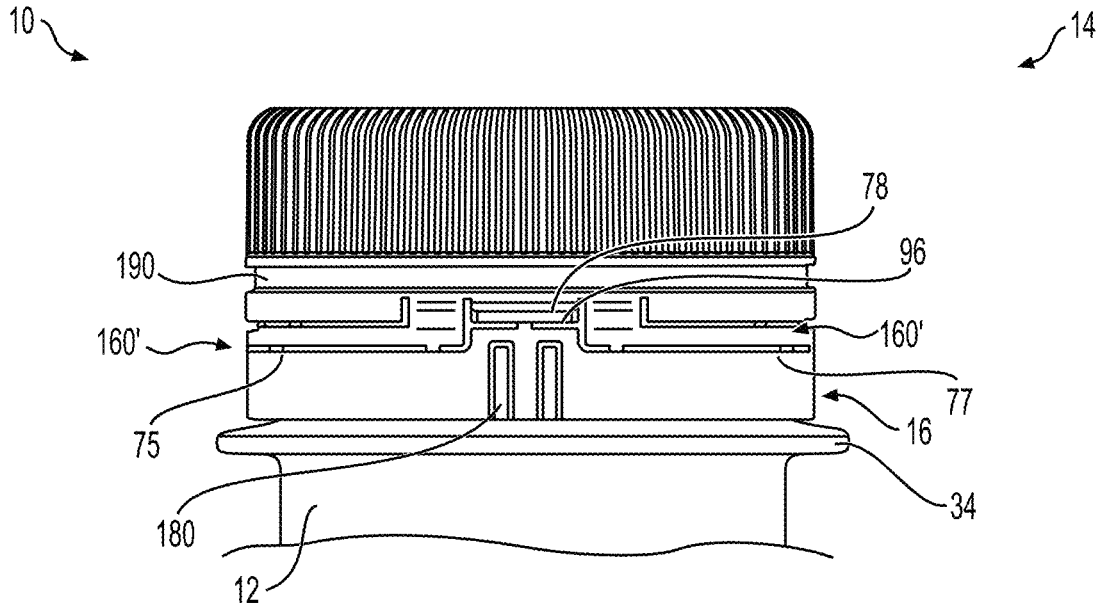
Figure 34B:
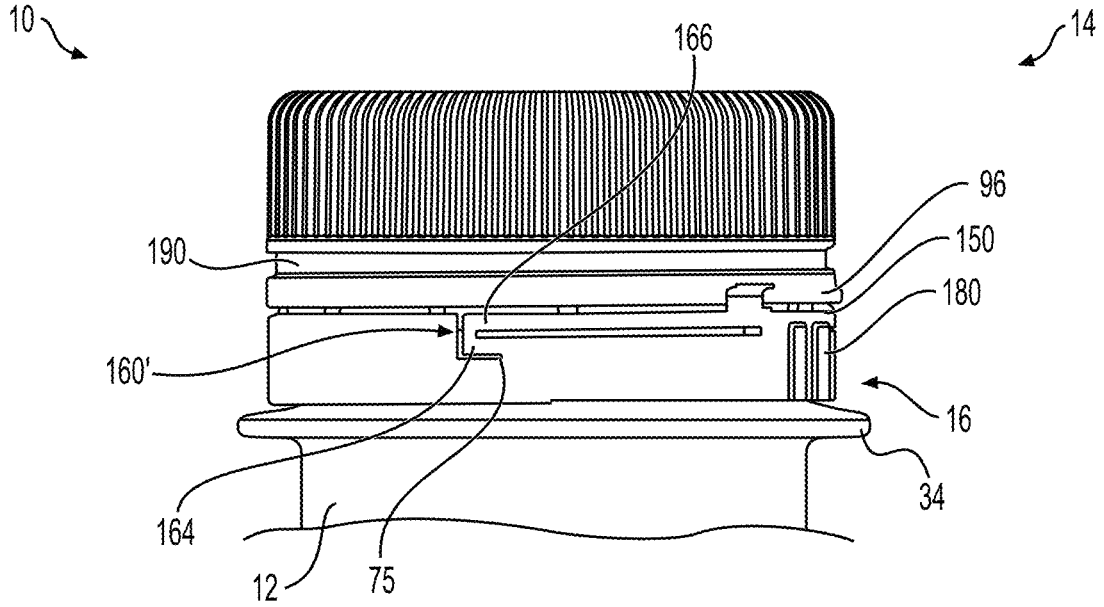

FIGS. 6A, 6B and 6C respectively depict a zoomed-in portion of the perspective sectional view of the closure device of FIG. 4 in the different open positions of the open configuration, in accordance with some embodiments of the present technology;

FIG. 7 is a side view of another embodiment of a closure device on a container when the closure device is in a closed and locked configuration, in accordance with some embodiments of the present technology;

FIG. 8 is a side view of the closure device of FIG. 7 when the closure device is in the closed and unlocked configuration, in accordance with some embodiments of the present technology;

FIG. 9 is a perspective sectional view of the closure device of FIG. 7, when the closure device is in a fully open position of an open configuration, in accordance with some embodiments of the present technology, the sectional view taken through a line B-B' of FIG. 2;

FIG. 10 is a cross-sectional view of the closure device of FIG. 7 on a different embodiment of the container, in accordance with some embodiments of the present technology;

FIGS. 11A, 11B, 11C and 11D respectively depict a zoomed-in portion of the perspective sectional view of the closure device of FIG. 9 in different open positions of the open configuration, in accordance with some embodiments of the present technology;

FIG. 12 is a side view of yet another embodiment of a closure device on a container when the closure device is in a closed and unlocked configuration, in accordance with some embodiments of the present technology;

FIG. 13 is a perspective sectional view of the closure device of FIG. 12, when the closure device is in a fully open position of an open configuration, in accordance with some embodiments of the present technology, the sectional view taken through a line C-C' of FIG. 12;

FIGS. 14A, 14B, 14C and 14D respectively depict a zoomed-in portion of the perspective sectional view of the closure device of FIG. 13 in different open positions of the open configuration, in accordance with some embodiments of the present technology;

FIG. 15 is a side view of yet further embodiment of a closure device on a container when the closure device is in a closed and unlocked configuration, in accordance with some embodiments of the present technology;

FIG. 16 is a perspective sectional view of the closure device of FIG. 15, when the closure device is in a fully open position of an open configuration, in accordance with some embodiments of the present technology, the sectional view taken through a line D-D' of FIG. 15;

FIGS. 17A, 17B, and 17C respectively depict a zoomed-in portion of the perspective sectional view of the closure device of FIG. 15 in different open positions of the open configuration, in accordance with some embodiments of the present technology;

FIG. 18A is a side view of another embodiment of a closure device on a container when the closure device is in a closed and locked configuration, in accordance with some non-limiting embodiments of the present technology;

FIG. 18B is a profile view of a zoomed in portion of the closure device showing a tongue with an extended lip;

FIG. 19 is a side view of the closure device of FIG. 18A when the closure device is in the closed and unlocked configuration, in accordance with some non-limiting embodiments of the present technology;

FIG. 20 is a perspective sectional view of the closure device of FIG. 18A, when the closure device is in a fully open position of an open configuration, in accordance with some non-limiting embodiments of the present technology, the sectional view taken through a line E-E' of FIG. 18A; and FIGS. 21A, B and C respectively depict a zoomed-in portion of the perspective sectional view of the closure device of FIG. 20 in different open positions of the open configuration, in accordance with some embodiments of the present technology;

FIG. 22 is a side view of another embodiment of the closure device of FIG. 18A when the closure device is in a closed and locked configuration, in accordance with some non-limiting embodiments of the present technology;

FIG. 23 is a side view of yet further embodiment of a closure device when the closure device is in a closed and locked configuration, in accordance with some embodiments of the present technology;

FIG. 24 is a side view of the closure device of FIG. 23 on a container, in accordance with some embodiments of the present technology;

FIG. 25 is a profile view of the closure device of FIG. 23 on a container, in accordance with some embodiments of the present technology;

FIG. 26 is a perspective sectional view of the closure device of FIG. 23, the sectional view taken through a line F-F' of FIG. 23, in accordance with some embodiments of the present technology;

FIGS. 27A and 27B are profile view and side views, respectively, of the closure device of FIG. 23 when the closure device is in a closed and unlocked configuration, in accordance with some embodiments of the present technology;

FIGS. 28A and 28B are side and profile views, respectively, of the closure device of FIG. 23 during opening when the closure device is in an open configuration, in accordance with some embodiments of the present technology;

FIGS. 28A and 28B are side and profile views, respectively, of the closure device of FIG. 23 during opening when the closure device is in an open configuration, in accordance with some embodiments of the present technology;

FIGS. 29A and 29B are profile views and sectional views, respectively, of the closure device of FIG. 23 during opening when the closure device is in a more open configuration than the closure device of FIGS. 28A and 28B, in accordance with some embodiments of the present technology;

FIGS. 30A and 30B are profile views and sectional views, respectively, of the closure device of FIG. 23 during opening when the closure device is in a yet more open configuration than the closure device of FIGS. 29A and 29B, in accordance with some embodiments of the present technology;

FIGS. 31A and 31B are profile views and sectional views, respectively, of the closure device of FIG. 23 during opening when the closure device is in a yet more open configuration than the closure device of FIGS. 30A and 30B, in accordance with some embodiments of the present technology;

FIGS. 32A and 32B are profile views and sectional views, respectively, of the closure device of FIG. 23 during opening when the closure device is in a yet more open configuration than the closure device of FIGS. 31A and 31B, in accordance with some embodiments of the present technology;

FIGS. 33A, 33B and 33C are profile, sectional and side views, respectively, of the closure device of FIG. 23 when the closure device is in a fully open configuration, in accordance with some embodiments of the present technology; and FIGS. 34A and 34B are side and profile views, respectively, of another embodiment of the closure device of FIG. 23, in accordance with some embodiments of the present technology.

The drawings are not necessarily to scale and may be illustrated by phantom lines, diagrammatic representations and fragmentary views. In certain instances, details that are not necessary for an understanding of the embodiments or that render other details difficult to perceive may have been omitted.

DETAILED DESCRIPTION OF THE NON-LIMITING EMBODIMENT(S)

Reference will now be made in detail to various non-limiting embodiment(s) of a closure device for a container. It should be understood that other non-limiting embodiment(s), modifications and equivalents will be evident to one of ordinary skill in the art in view of the non-limiting embodiment(s) disclosed herein and that these variants should be within scope of the appended claims.

Furthermore, it will be recognized by one of ordinary skill in the art that certain structural and operational details of the non-limiting embodiment(s) discussed hereafter may be modified or omitted (i.e. non-essential) altogether. In other instances, well known methods, procedures, and components have not been described in detail.

According to non-limiting embodiments of the present technology, there is provided a closure device 10 for a container 12. The container 12 with which the closure device 10 is useable is not limited in its use, configuration or material. In the embodiments illustrated herein, the container 12 is a bottle, such as a drink bottle made of polyethylene terephthalate (PET). For example, the container 12 can be a blow-molded bottle for containing still water beverage or another flat beverage. Alternatively, the container 12 can be for a carbonated beverage. In yet further embodiments, the container 12 can be for a hot fill type of beverage (such as a drinkable yogurt, a fruit juice, or the like). However, the closure device 10 can be used with other types of containers.

Figure 1:
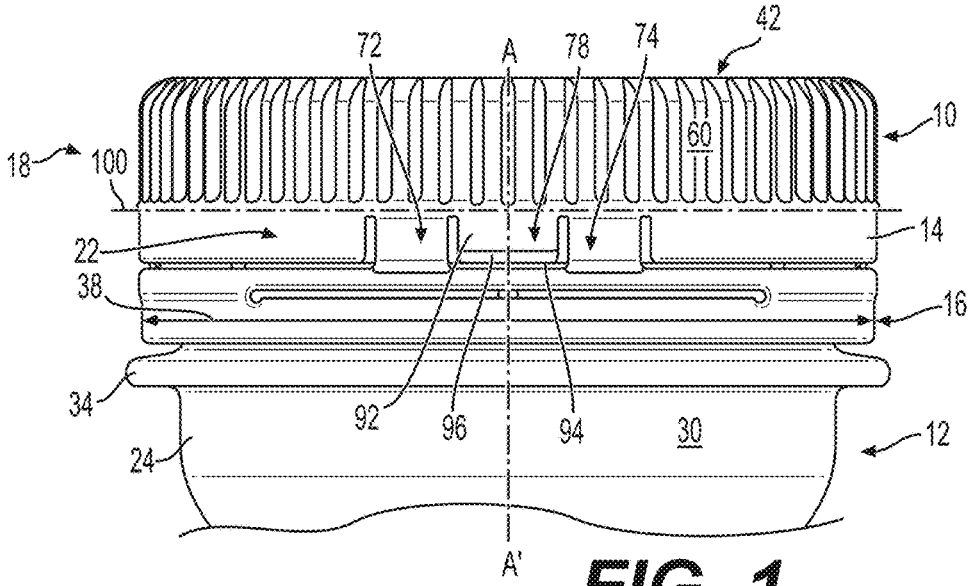
FIG. 1 is a side view of a closure device on a container when the closure device is in a closed and locked configuration, in accordance with some embodiments of the present technology.
Figure 3:
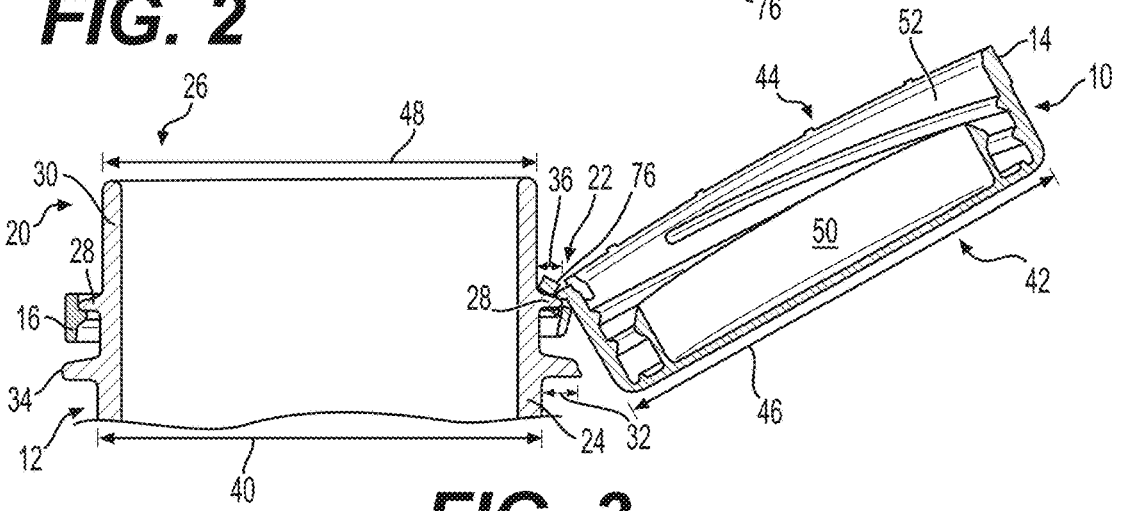
FIG. 3 is a perspective sectional view of the closure device of FIG. 1, when the closure device is in a fully open position of an open configuration, in accordance with some embodiments of the present technology, the sectional view taken through a line A-A' of FIG. 2.

Referring initially to FIGS. 1 and 2, the closure device 10 comprises a cap body 14 frangibly attached to a tamper evidence band (TE band) 16 and moveable between a closed configuration 18 (also referred to as "closed position") (FIGS. 1 and 2) and an open configuration 20 (FIGS. 3, 4 and 6). The cap body 14 is configured to be actuated between the closed configuration 18 to the open configuration 20, and to the open configuration 20 to the closed configuration 18. The closed configuration 18 has a locked mode (FIG. 1) and an unlocked mode (FIG. 2). In the open configuration, a number of different open positions are possible, as best illustrated in FIG. 4 and FIGS. 6A, 6B and 6C, including a fully open position illustrated in FIG. 6C. The actuation of the cap body 14 between any one of: the locked closed configuration, the unlocked closed configuration, and the open configuration, is generally referred to herein as an action of "opening" the closure device 10. The actuation of the cap body 14 from the open configuration to the unlocked closed configuration, is generally referred to herein as an action of "closing" the closure device 10.

A retaining mechanism 22, associated with one or both of the cap body 14 and the tamper evidence band 16, is provided to retain the closure device 10 in the fully open position.

The cap body 14 and the TE band 16 are sized and shaped to be received around a neck 24 of the container 12, the neck 24 defining an open end 26 of the container 12, and the cap body 14 being arranged to close and to fluidly seal the open end 26 when in the closed configuration 18. The TE band 16 and the cap body 14 are arranged to be at least partially separated from one another. As is known in the art, the separation (partial in this case) of the TE band 16 and the cap body 14, allows for a "tamper indication"—i.e. an indication that the container 12 has been opened.

The container 12 also includes an annular flange 28 (also referred to as a "tamper-evident bead") extending around an outer surface 30 of the neck 24 and spaced from the open end 26 of the container 12. The tamper evident bead 28 protrudes by a first distance 32 from the outer surface of the neck 24. The TE band 16 of the closure device 10 is arranged to engage with the tamper evident bead 28 of the container 12, to retain the TE band 16 on the container 12, in use. The first distance 32 of the TE bead 28 relative to a size of the TE band 16 is such that the TE bead 28 retains the TE band after the cap body 14 is actuated from the closed configuration 18 to the fully open position.

The retaining mechanism 22 is arranged to engage with a portion of a neck 24 of the container 12, in use, to retain the cap body 14 in the open configuration 20. This interaction is a direct interaction in certain non-limiting embodiments. In one non-limiting embodiment of the present technology specifically illustrated in FIG. 2, the portion of the neck 24 is the tamper evident bead 28. The manner of engagement of the TE band 16 and the retaining mechanism 22 with the tamper evident bead 28, will be described in more detail below.

The container 12 also has a support ledge 34 extending around the outer surface 30 of the neck 24 and spaced from the tamper evident bead 28. The support ledge 34 is spaced further from the open end 26 of the container 12 than the tamper evident bead 28. The support ledge 34 protrudes by a second distance 36 from the outer surface 30 of the neck 24 of the container 12, the second distance 36 of the support ledge 34 being larger than the first distance 32 of the tamper evident bead 28. A diameter 38 of the TE band 16 of the closure device 10 is less than a diameter 40 of the neck 24 at the support ledge 34, which serves to retain the closure device 10 above the support ledge 34 at the neck 24 of the container 12. In other words, a movement of the TE band 16 away from the open end 26 of the container 12 is delimited by the support ledge 34, in use.

The cap body 14 is generally cylindrical in shape and has a closed first end 42 and an open second end 44. The cap body 14 is arranged to be received over the open end 26 of the container 12. In this respect, at least the second end 44 of the cap body 14 has a diameter 46 wider than a diameter 48 of the container 12 at the open end 26, to allow retention of the cap body 14 on the neck 24.

Figure 5:
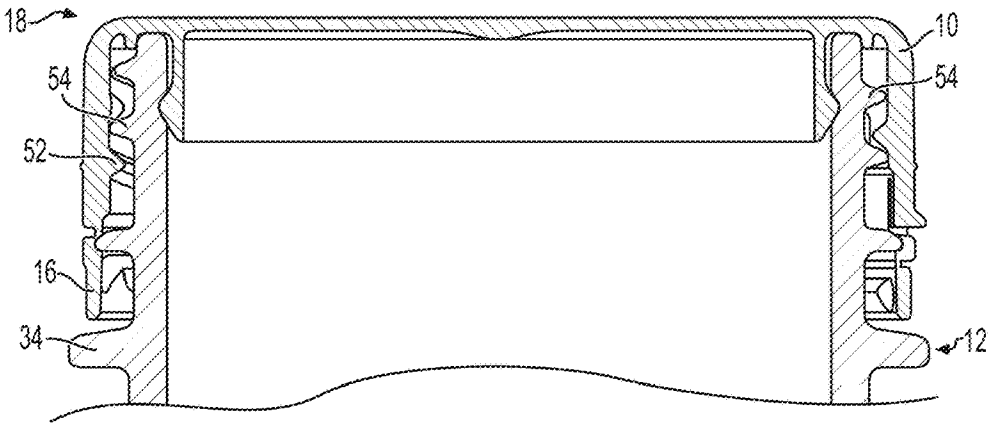
FIG. 5 is a cross-sectional view of the closure device of FIG. 1 on a different embodiment of the container, in accordance with some embodiments of the present technology.

The closure device 10 is arranged to be retained in the closed configuration 18 by means of a threaded interface with the neck. An inner surface 50 of the cap body 14 has threads 52 defined therein which are arranged to cooperate with threads 54 (FIG. 5) on the outer surface 30 of the neck 24 of the container 12. The threads 54 have been omitted from FIGS. 1-4, and 6A-6B. As best seen in FIGS. 3 and 4, in certain embodiments, the inner surface 50 of the cap body 14 has a threaded annular portion 56 which includes the threads 52, and a non-threaded annular portion 58 which does not include any threads 52. The threaded annular portion 56 is proximate the open second end 44 of the cap body 14. The cap body 14 is retained in the closed configuration 18 by means of the threaded interface with the neck 24 of the container 12.

In alternative embodiments (not shown), one or both of the cap body 14 and the neck 24 does not include the threads 54 and is sized and shaped to snap-fit onto the neck 24 to close the open end 26 of the container 12.

An outer surface 60 of the cap body 14 is textured to facilitate gripping of the cap body 14. As seen in FIG. 1, the texturing comprises a plurality of ribs 62 (also known as "knurls") extending in a direction between the first and second ends 42, 44 of the cap body 14. It should be noted that the sizing and the pattern of the plurality of ribs 62 is not limited to those depicted herein. It is also noted that in alternative embodiments of the present technology, the plurality of ribs 62 can be omitted altogether.

The cap body 14 is frangibly connected to the TE band 16 by a plurality of links 64 which are frangible. The links 64 are arranged to be severed when the cap body 14 and the TE band 16 are rotatably moved relative to one another. A tensile strength of the links 64 are lower than a tensile strength of the TE band 16, which means that the links 64 will be severed before tensile damage to the TE band 16.

In use, in the closed configuration (FIG. 1), the cap body 14 is retained over the open end 26 of the container 12, adjacent the TE band 16, and connected thereto by one or more of the links 64 when they are intact, and the retaining mechanism 22.

As noted earlier, the closed configuration 18 of the closure device 10 has the locked closed configuration (FIG. 1), and the unlocked closed configuration (FIG. 2). In the locked closed configuration, the links 64 are intact and connect the cap body 14 to the TE band 16 (together with the retaining mechanism 22). In the unlocked closed configuration, the links 64 are severed and the cap body 14 is connected to the TE band 16 by means of the retaining mechanism 22 only. The links 64 are arranged to be severed by a rotary movement of the cap body 14 relative to the TE band 16. In this respect, the retaining mechanism 22 is arranged to permit sufficient rotary movement of the cap body 14 relative to the TE band 16 to sever the links 64.

The cap body 14 is moveable between the closed configuration 18 (in the unlocked mode) to the open configuration 20 through a hinged movement about a pivot region of the retaining mechanism 22. The plurality of open positions of the cap body 14 are defined by a positioning angle 66 between an axis 68 of the cap body 14 along a diametric plane of the cap body 14, and an axis 70 of the neck 24 of the container 12 along a diametric plane of the neck 24. The open positions represented in FIG. 4, as well as in FIGS. 6A, 6B and 6C, respectively, have positioning angles 66 which are less than 90 degrees (e.g. about 45 degrees), 90 degrees, and between about 90 degrees and about 180 degrees (e.g. about 120 degrees). In certain embodiments, the fully open position is defined by a positioning angle 66 of more than 90 degrees, such as about 120 degrees.

Turning now to the retaining mechanism 22, best seen in FIGS. 1 and 2, which enables retention of the cap body 14 on the container 12 in the closed and open configurations 18, 20, and enables retention of the cap body 14 at the fully open position of the open configuration.

As best seen in FIGS. 6A, 6B and 6C, the retaining mechanism 22 comprises a first hinge 72 and a second hinge 74 defined on the cap body 14. A leash 76 is provided connected to the TE band 16, the first hinge 72 and the second hinge 74. The leash 76 is connected to the TE band 16 at a first connection point 75 and a second connection point 77. The first and second connections points 75, 77 are positioned one on either side of the first and second hinges 72, 74. A tongue 78 extends from the cap body 14 between the first hinge 72 and the second hinge 74.

The first and second hinges 72, 74 are spaced from one another circumferentially around the second end 44 of the cap body 14. Each of the first and second hinges 72, 74 comprise a hinge body 80 extending from the second end 44 of the cap body 14. Each hinge body 80 has a hinged end 82 which is hingedly connected to the cap body 14, and a leash end 84 which is connected to the leash 76.

By hingedly connected is meant that the hinge body 80 is moveably connected to the cap body 14 in a manner that allows relative axial movement. This is also referred to as a "flip-top" arrangement. The connection between the leash end 84 of the hinge body 80 and the leash 76 is not a hinged connection.

The hinged end 82 of each of the first and second hinges 72, 74 are positioned inwardly of a rim 86 of the second open end 44 of the cap body 14, towards the first closed end 42 of the cap body 14. The leash end 84 of each of the first and second hinges 72, 74 protrude further than the rim 86 of the cap body 14, such that the leash end 84 of each of the first and second hinges 72, 74 are respectively positioned beyond the rim 86 of the second open end 44 of the cap body 14, away from the second end 44 of the cap body 14. The arrangement of the tongue 78 relative to the leash 76 defines a gap 87 allowing relative movement between the tongue 78 and the leash 76.

The leash 76 allows separation of the cap body 14 from the TE band 16 during opening (i.e. from the locked mode to the unlocked mode of the closed configuration 18), whilst remaining connected to the TE band 16. The leash 76 is sized and shaped to allow the cap body 14 a degree of rotational freedom sufficient to disengage the threaded interface (52, 54).

A frangible bridge 88 is provided between the leash 76 and the TE band 16, which is severed during rotational actuation from the locked mode to the unlocked mode of the closure device 10. A tensile strength of the frangible bridge 88 is lower than a tensile strength of the leash 76. The severing of the bridge 88 causes a separation between the leash 76 and the TE band 16, defining therein a foothold opening 90 between the leash 76 and the TE band 16. More than one frangible bridge 88 may be provided. The foothold opening 90 is sized and shaped to receive at least a portion of the TE bead 28 of the container 12. The size of the leash 76 allows a degree of rotational movement of the cap body 14 to break the bridge 88 and to disengage the threads 54. As best seen in FIGS. 6A-6C, the engagement of the TE bead 28 in the foothold opening 90 serves to retain the position of the TE band 16 relative to the neck 24 of the container 12, during movement of the cap body 14 between the different open positions.

The tongue 78 comprises a tongue body 92 having a free end 94 extending from the cap body 14 between the first hinge 72 and the second hinge 74. The free end 94 of the tongue 78 does not protrude further than the rim 86 of the cap body 14 and is aligned with the rim 86 of the cap body 14. In the closed configuration, the free end 94 of the tongue 78 is spaced from the leash 76. At the free end 94 of the tongue 78 is provided a lip 96. When the cap body 14 is actuated from the closed configuration 18 to the open configuration 20 in the fully open position, an interaction of the tongue 78 and the TE bead 28 of the container 12 is configured to retain the cap body 14 in the fully open position. More specifically, an interaction of the lip 96 of the tongue 78 with the leash 76 and an upper portion 98 (FIG. 6A) of the TE bead 28, enables retention of the cap body 14 in the fully open position.

The functioning of the retaining mechanism 22 will be described in more detail with reference to FIGS. 6A to 6C. When actuating the cap body 14 towards the fully open position, movement of the cap body 14 away from the open end 26 of the container 12, causes the tongue 78 to be brought towards the leash 76 and to contact the leash 76, the leash 76 resting on the upper portion 98 of the TE bead 28. The cap body 14 hinges about the hinged end 82 of the first and second hinges 70, 72, respectively. In turn, the leash 76 is pushed against the TE bead 28 (FIGS. 6A and 6B). Movement of the cap body 14 to the fully open position (FIG. 6C), causes the lip 96 of the tongue 78 to be received between the leash 76 and the TE bead 28, thereby retaining the fully open position. In other words, direct interaction of the leash 76, the tongue 78 and the neck 24 enables retention of the cap body 14 in the fully open position. It will be appreciated that the first hinge 72 and the second hinge 74 define a first pivotal axis 100 (FIG. 1). A second pivotal axis 102 (FIG. 2) is defined by pivotal points (connection points 75, 77) where the leash 76 originates on the TE band 16.

As such, it can be said that the leash 76 functions to retain a position of the closure device 10 during opening and/or closing; and that the tongue 78 functions to maintain the closure device 10 in the fully open position.

Alternative Embodiment (Embodiment 2)

Another embodiment of the closure device 10 is illustrated in FIGS. 7-10D. This embodiment of the closure device 10 differs from that of FIGS. 1-6C in the configuration and functioning of the retaining mechanism 22, and more specifically in the manner of connection of the leash 76 to the TE band 16.

In the embodiment of FIGS. 7-11D, the leash 76 is connected to the TE band 16 by a single connection point 106 positioned between the first hinge 72 and the second hinge 74. The single connection point 106 is positioned under the tongue 78. In other words, the leash 76 comprises a first leash arm 108 extending from the first hinge 72, and a second leash arm 110 extending from the second hinge 74, both the first and second leash arms 108, 110 extending towards the TE band 16 to meet the TE band 16 at the single connection point 106. The first leash arm 108 and the second leash arm 110 originate from separate locations on the cap body 14 and converge towards a pivot region 104 on the TE band 16, the pivot region 104 defining a second pivotal axis 102. The single connection point 106 defines the pivot region 104 in certain embodiments.

Accordingly, the foothold opening 90, in this embodiment, comprises a first foothold opening 90*a* defined by the first leash arm 108 and a portion of the TE band 16 oppositely facing the first leash arm 108, and a second foothold opening 90*b* defined by the second leash arm 110 and a portion of the TE band 16 oppositely facing second leash arm 110. As best seen, during opening, the first and second foothold openings 90*a*, 90*b* are arranged to receive a portion of the TE bead 28.

The gap 87 between the tongue 78 and the leash 76 is defined by the first leash arm 108, the second leash arm 110 and the free end 94 of the tongue 78. The gap 87 is wider at a point corresponding to the single connection point 106 compared to a distance between the tongue 78 and the first leash arm 108, or the tongue 78 and the second leash arm 110 at the points where they meet the first and second hinges 72, 74 respectively.

Figure 11A:
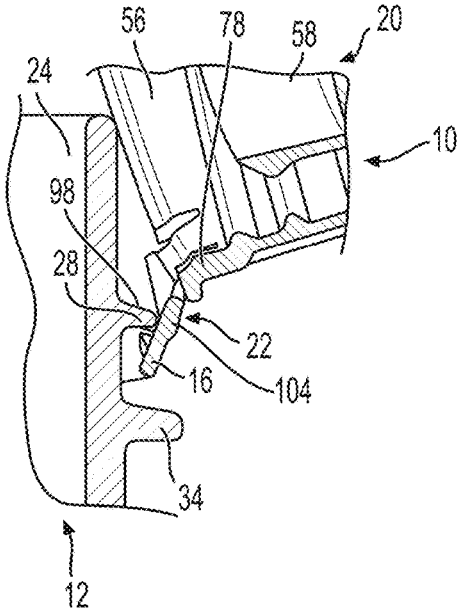
Figure 11B:
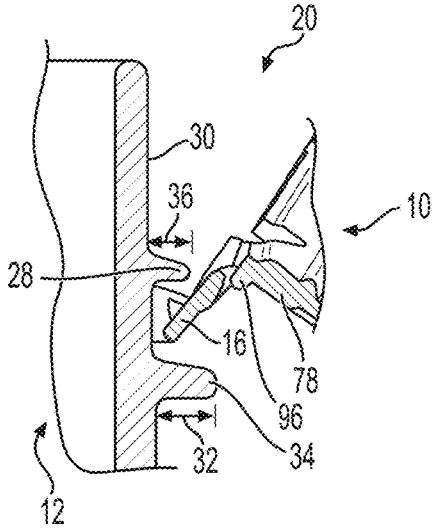
Figure 11C:
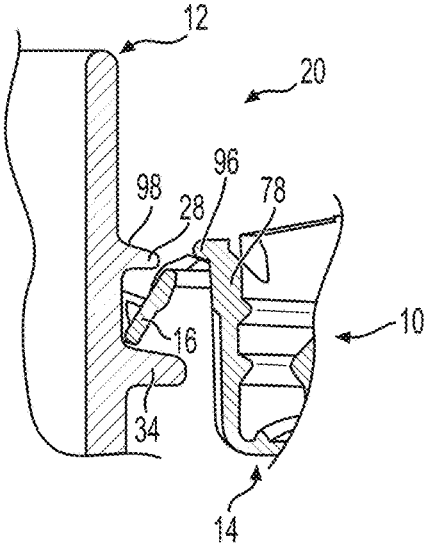

The functioning of the retaining mechanism 22 will be described in more detail with reference to FIGS. 11A to 11D. When actuating the cap body 14 towards the fully open position, the leash 76 interacts with the TE bead 28. The cap body 14 rotates with respect to the neck 24 of the container 12 about the first pivotal axis 100 (FIG. 7), defined by the first and second hinges 72, 74, and the second pivotal axis 102 (FIG. 7), which is defined in this embodiment by the pivot region 104 defined by the single connection point 106 (FIGS. 11A and 11B).

Figure 11D:
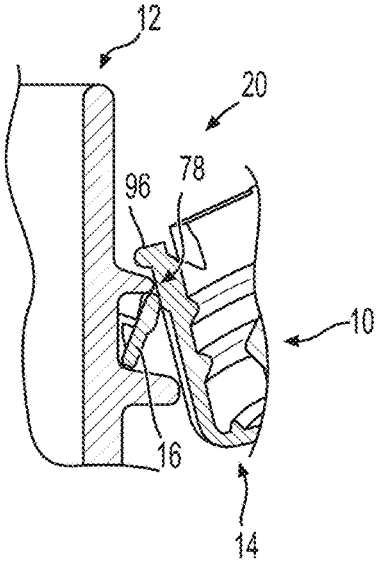

When the cap body 14 is at a position (FIG. 11C) which is beyond the fully open position of FIG. 11D, the tongue 78 is caused to extend through the gap 87 defined at least in part by the first and second leash arms 108, 110. The lip 96 of the tongue 78 is caused to face the TE bead 28 with the cap body 14 in an inverted position compared to a position of the cap body 14 when in the closed configuration. Movement of the cap body 14 towards the neck 24 of the container 12 causes engagement of the lip 96 of the tongue 78 with the upper portion 98 of the TE bead 28, thereby retaining the fully open position.

The closure device 10 of FIGS. 7-11D, as well as the closure device 10 of FIGS. 1-6C are examples of a "direct contact" between the tongue 78 and the neck 24.

Alternative Embodiment (Embodiment 3)

Another embodiment of the closure device 10 is illustrated in FIGS. 12-14D. This embodiment of the closure device 10 differs from that of FIGS. 7-11D in the configuration and functioning of a retaining mechanism 22*a* which differs from the retaining mechanism 22 of previous embodiments, as well as in the relative location of first and second hinges 72*a*, 74*a*, leash 76*a* and tongue 78*a*.

The closure device 10 comprises the cap body 14 frangibly attached to the tamper evidence band (TE band) 16, and the retaining mechanism 22*a*. The closure device 10 is moveable between the closed configuration 18 (locked and unlocked) and the open configuration (with different open positions including the fully open position). The retaining mechanism 22*a*, associated with one or both of the cap body 14 and the tamper evidence band 16, is provided to retain the closure device in the fully open position.

The retaining mechanism 22*a* is arranged to engage with a portion of the neck 24 of the container 12, specifically the TE bead 28, to retain the cap body 14 in the open configuration 20. The retaining mechanism 22*a* differs from that of FIGS. 1-6C, and that of FIGS. 7-11D, in that the engagement between the neck 24 of the container 12 and the cap body 14 is "indirect".

As best seen in FIG. 12, the cap body 14 has a cut-out portion 111 in the rim 86. The retaining mechanism 22*a* comprises a tongue 78*a* of the cap body 14 defined in the cap body 14 above the cut-out portion 111. The tongue 78*a* has a tongue body 92*a* having a free end 94*a* with a lip 96*a* at the free end 94*a*. The free end 94*a* is aligned with the cut-out portion 111.

First and second hinges 72*a*, 74*b* are provided extending from the TE band 16. The first and second hinges 72*a*, 74*a* are spaced from one another circumferentially around the TE band 16. Each one of the first and second hinges 72*a*, 74*a* comprise a hinge body 80*a* extending from the TE band 16 and having a hinged end 82*a*, hingedly connected to the TE band 16, and a leash end 84*a*, connected to a leash 76*a*. The leash 76*a* comprises first and second leash arms 108*a*, 110*a* which originate from separate locations 112, 114 on the cap body 14 and converge towards the pivot region 130.

The leash 76*a* extends from (i) a first point 112 on the cap body 14 to the first hinge 72*a* (first leash arm 108*a*), (ii) from the first hinge 72*a* to the second hinge 74*a*, and (iii) from the second hinge 74*a* to a second point 114 (second leash arm 110*a*). The leash 76*a*, and a portion of the cap body 14 between the first and second points 112, 114 on the cap body 14 from which the leash 76*a* extends defines an enclosed opening 116. The enclosed opening 116 is arranged to allow modification of a distance of the cap body 14 from the tongue 78*a* during opening and closing.

On the TE band 16, between the first and second hinges 72*a*, 74*a*, there is provided a ratchet 118 having a contact surface 120 for contacting the tongue 78*a* during opening. The ratchet 118 is wedge-shaped, with a free end 122 which is thinner than a portion 124 of the ratchet 118 connected to the TE band 16. An inner surface 126 of the ratchet is arranged to engage with the TE bead 26. The contact surface 120 of the ratchet 118 is sized and shaped to engage with the lip 96*a* of the tongue 78*a*. The portion of the leash 76*a* between the first and second hinges 72*a*, 74*a*, the first and second hinges 72*a*, 74*a*, and the ratchet 118 define a gap 128, similar to the gap 87.

Figure 14A:
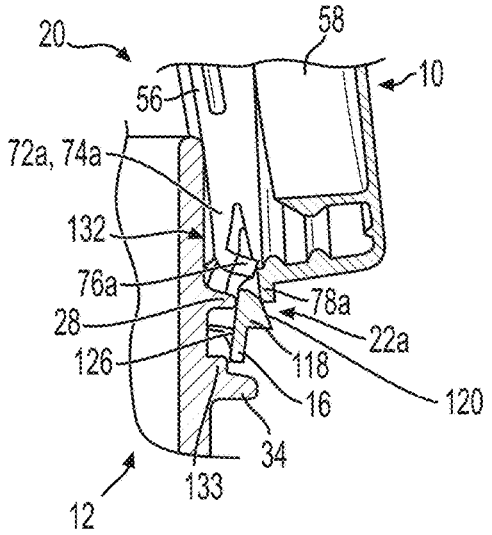
Figure 14B:
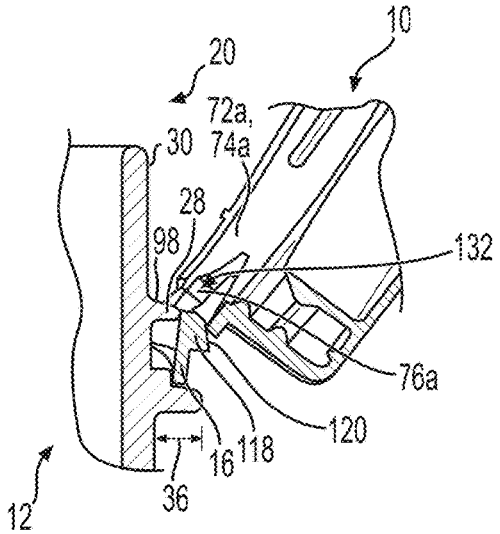
Figure 14C:
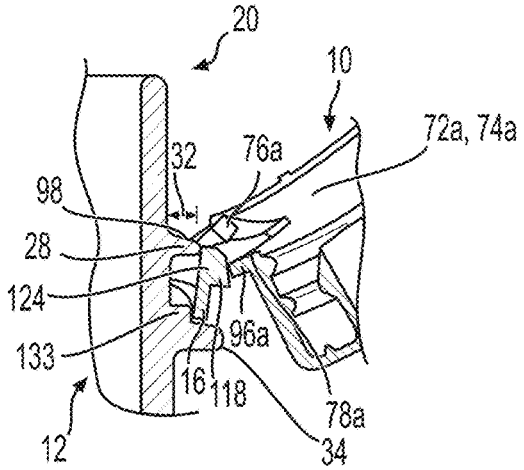
Figure 14D:
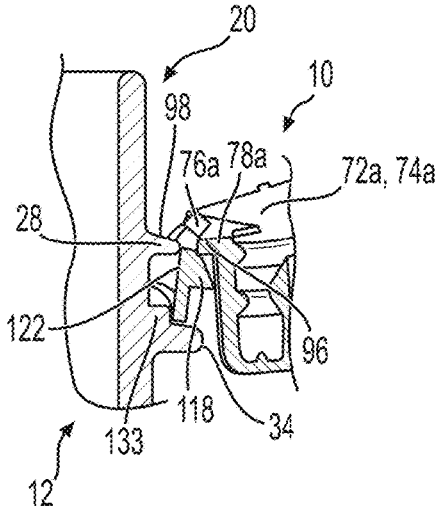

When the cap body 14 is actuated from the closed configuration 18 (FIG. 12) to the open configuration 20 (FIG. 13), the portion of the leash 76*a* between the first and second hinges 72*a*, 74*a* contacts the upper portion 98 of the TE bead 28. The lip 96*a* contacts the contact surface 120 of the ratchet 118. The lip 96*a* is positioned outwardly of the portion of the leash 76*a* between the first and second hinges 72*a*, 74*a*. The cap body 14 rotates about a pivot region 130 defining a pivotal axis 132, the pivot region 130 comprising at least a portion of the first and second hinges 72*a*, 74*a* (FIG. 14A).

As the cap body 14 is rotated about the pivotal axis 132 (FIGS. 14B and 14C), a distance of the cap body 14 from the leash 76 increases. In turn, the contact of the lip 96 with the contact surface 120 of the ratchet 118 moves towards the portion 124 of the ratchet 118 connected to the TE band 16. The TE band 16 is brought into contact with a step 133 of the support ledge 34 by a general downwards movement of the TE band 16 caused by the pivoting of the cap body 14. At the same time, the contact of the portion of the leash 76*a* between the first and second hinges 72*a*, 74*a* moves along the upper portion 98 of the TE bead 28 towards the ratchet 118. The TE band 16 with the ratchet 118 generally maintains its position between the TE bead 28 and the support ledge 133.

In the fully open position (FIG. 14D), the lip 96*a* of the tongue 78*a* is brought upwardly to the free end 122 of the ratchet 188 to contact the leash 76*a* (the portion between the first and second hinges 72*a*, 74*a*). The distance between the portion of the leash 76*a* between the first and second hinges 72*a*, 74*a* and the cap body 14 is decreased. The force of the hinges 72*a*, 74*a* and the leash 76*a* pulls the tongue 78*a* against the ratchet 118 to cause retention of the cap body 14 in the fully open position. In certain embodiments, the tongue 78*a* is positioned in between the leash 76*a* and the ratchet 118 which gives rise to a wedging effect, however this is not required for retention of the cap body 14 in the fully open position.

As such, it can be said that the enclosed opening 116 and the leash 76*a* enables the pivoting of the cap body 14 as well as the positioning of the lip 96 relative to the leash to maintain the closure device 10 in the fully open position. The retention of the cap body 14 in the fully open position is by means of an indirect contact between the tongue 78*a* and the neck 24 via the ratchet 118.

Alternative Embodiment (Embodiment 4)

Another embodiment of the closure device 10 is illustrated in FIGS. 15-17D. This embodiment of the closure device 10 differs from that of FIGS. 14-17D in the configuration and functioning of the retaining mechanism 22*b* which differs from the retaining mechanism 22*a* in the configuration of the leash and the omission of the hinges 72*a*, 74*a*.

The closure device 10 of FIGS. 15-17A comprises the cap body 14 frangibly attached to the tamper evidence band (TE band) 16, and the retaining mechanism 22*b*. The closure device 10 is moveable between the closed configuration 18 (locked and unlocked) and the open configuration (with different open positions including the fully open position). The retaining mechanism 22*b*, associated with one or both of the cap body 14 and the tamper evidence band 16, is provided to retain the closure device 10 in the fully open position.

The retaining mechanism 22*b* is arranged to engage with a portion of the neck 24 of the container 12, specifically the TE bead 28, to retain the cap body 14 in the open configuration 20. The retaining mechanism 22*b* differs from that of FIGS. 1-6C, and that of FIGS. 7-11D, in that the engagement between the neck 24 of the container 12 and the cap body 14 is indirect.

As best seen in FIG. 15, the retaining mechanism 22*b* comprises a tongue 78*a* defined in the cap body 14, above the cut-out portion 111. The tongue 78*a* has a tongue body 92*b* having a free end 94*a* with a lip 96*a* at the free end 94*a*.

On the TE band 16, there is provided a TE band cut-out region 134. Extending from the TE band 16 at the TE band cut-out region 134 there is provided a ratchet 118 having a contact surface 120 for contacting the tongue 78*a* during opening. The ratchet 118 is wedge-shaped, with a free end 122 which is thinner than a portion 124 of the ratchet 118 connected to the TE band 16. The inner surface 126 of the ratchet is arranged to engage with the TE bead 26. The contact surface 120 of the ratchet 118 is sized and shaped to engage with the lip 96*a* of the tongue 78*a*.

A leash 76*b* extends between the cap body 14, at the cut-out portion 111, to the ratchet 118. The leash 76*b* comprises a first leash elbow 136 and a second leash elbow 138. The first leash elbow 136 extends from a first point 112*a* on the cap body 14, within the cut-out portion 111, to a first side 140 of the ratchet 118 within the TE band cut-out region 134. The second leash elbow 138 extends from a second point 114*a* on the cap body 14. The first point 112*a* and the second point 114*a* are spaced apart from one another and positioned inwardly of edges 142 of the cut-out portion 111.

The first and second leash elbows 136, 138 each have a "V" shaped configuration giving them an expandable form. The first and second leash elbows 136, 138 can be considered to be arranged to resiliently bias the cap body towards the ratchet. Other expandable or resiliently biased configurations are also possible and within the scope of the present technology.

The first leash elbow 136, the second leash elbow 138, the ratchet 118 and a portion of the cap body 14 define an enclosed opening 116*a*. Frangible links 64 are provided between the TE band 16 and the rim 86 of the cap body 14, as well as between the first and second leash elbows 136, 138. The leash 76*b* is arranged to allow sufficient rotational movement between the cap body 14 and the TE band 16 to allow the frangible links 64 to sever on opening of the closure device 10.

When the cap body 14 is actuated from the closed configuration 18 (FIG. 15) to the open configuration 20 (FIG. 16), the cap body 14 rotates about a pivotal region 130*a* defining a pivotal axis 132*a*, the pivotal region 130*a* comprising at least a portion of the first and second leash elbows 136, 138 (FIG. 17A). These can be considered as two hinged areas.

As the cap body 14 is rotated about the pivotal axis 132*a* (FIG. 17B), the lip 96 contacts the contact surface 120 of the ratchet 118*a*. The TE band 16 is caused to move generally downwards causing a contact of the TE band with the step 133 of the support ledge 34.

In the fully open position (FIG. 17C), the TE band 16 and the ratchet 118 engage with step 133 of the support ledge 34 and the TE bead 28, respectively. This serves to position the TE band 16 and the ratchet 118 relative to the neck 24, providing a counterforce to the lip 96 pushing into the contact surface 120 of the ratchet 118, causing retention of the cap body 14 in the fully open position.

The closure device 10, including the cap body 14, the TE band 16 and the retaining mechanism 22, have a one-piece construction.

Alternative Embodiment (Embodiment 5)

A further embodiment of the closure device 10 is illustrated in FIGS. 18-22. Like the embodiment of FIGS. 1 and 2, the closure device 10 of FIGS. 18-22 comprises the cap body 14 frangibly attached to the tamper evidence band (TE band) 16 and moveable between the closed configuration 18 (FIGS. 18- and 19) and the open configuration 20 (FIGS. 20-21). Locked (FIGS. 18A and B) and unlocked modes (FIG. 19) are possible in the closed configuration 18. In the open configuration 20, the cap body 14 is moveable between a number of different open positions ranging from partially open to the fully open position seen in FIG. 21. The retaining mechanism 22 is arranged to retain the cap body 14 in the fully open position.

The cap body 14 is generally cylindrical in shape and has the closed first end 42 and the open second end 44. The cap body 14 is arranged to be received over the open end 26 of the container 12.

The closure device 10 is arranged to be retained in the closed configuration 18 by means of the threaded interface with the neck 24 of the container 12. The inner surface 50 of the cap body 14 has threads 52 defined therein which are arranged to cooperate with threads 54 on the outer surface of the neck 24 of the container 12. The threads 54 have been omitted from FIGS. 20-22.

The outer surface 60 of the cap body 14 is textured to facilitate gripping of the cap body 14. As seen in FIGS. 18 and 19, the texturing comprises the plurality of ribs 62 (also known as "knurls") extending in a direction between the first and second ends 42, 44 of the cap body 14. It should be noted that the sizing and the pattern of the plurality of ribs 62 is not limited to those depicted herein. It is also noted that in alternative embodiments of the present technology, the plurality of ribs 62 can be omitted altogether.

The cap body 14 is frangibly connected to the TE band 16 by the plurality of links (bridges) 64 which are frangible. The links 64 are arranged to be severed when the cap body 14 and the TE band 16 are rotatably moved relative to one another. The tensile strength of the links 64 are lower than the tensile strength of the TE band 16, which means that the links 64 will be severed before tensile damage to the TE band 16.

In use, in the locked closed configuration (FIG. 18), the cap body 14 is retained over the open end 26 of the container 12, adjacent the TE band 16, and connected thereto by one or more of the links 64 when they are intact, and the retaining mechanism 22.

In the unlocked closed configuration (FIG. 19), the links 64 are severed and the cap body 14 is connected to the TE band 16 by means of the retaining mechanism 22 only. The links 64 are arranged to be severed by a rotary movement of the cap body 14 relative to the TE band 16. In this respect, the retaining mechanism 22 is arranged to permit sufficient rotary movement of the cap body 14 relative to the TE band 16 to sever the links 64. The cap body 14 is moveable between the closed configuration 18 (in the unlocked mode) to the open configuration 20 through a hinged movement about a pivot region of the retaining mechanism 22.

Turning now to the retaining mechanism 22 which enables retention of the cap body 14 on the container 12 in the closed and open configurations 18, 20, and enables retention of the cap body 14 at the fully open position of the open configuration.

As best seen in FIGS. 18A and 19, the retaining mechanism 22 comprises the first hinge 72 and the second hinge 74 defined on the cap body 14, and the tongue 78 extending from the cap body 14 between the first hinge 72 and the second hinge 74. Unlike the embodiment of FIGS. 1-6, in the embodiment of FIGS. 18-22, there are provided two leashes: a first leash 76*a*, and a second leash 76*b*. The first leash 76*a* connects the TE band 16 to the first hinge 72, and the second leash 76*b* connects the TE band 16 to the second hinge 74. The first leash 76*a* is connected to the TE band 16 at the first connection point 75 and the second leash 76*b* is connected to the TE band 16 at the second connection point 77. The first and second connections points 75, 77 are positioned one on either side of the first and second hinges 72, 74. A distance between the first and second connection points 75, 77 in the embodiment of FIGS. 18-22 is greater than a distance between the connection points 75, 77 of the embodiment of FIG. 1-6. It can thus be said that a total leash length of the closure device of the embodiment of FIGS. 18-22 (a length of the first leash 76*a* and a length of the second leash 76*b*) is greater than a total leash length in the embodiment of FIGS. 1-6. A length of the first leash 76*a* and the second leash 76*b* is sufficient to enable the removal of the cap body 14 from the neck 24.

The first and second hinges 72, 74 are spaced from one another circumferentially around the second end 44 of the cap body 14. Each of the first and second hinges 72, 74 comprises the hinge body 80 extending from the second end 44 of the cap body 14. Each hinge body 80 has the hinged end 82 which is hingedly connected to the cap body 14, and the leash end 84 which is connected to the respective first leash 76*a* or second leash 76*b*. By hingedly connected is meant that the hinge body 80 is moveably connected to the cap body 14 in a manner that allows relative axial movement. This is also referred to as a "flip-top" arrangement. The connection between the leash end 84 of the hinge body 80 and the leash 76 is not a hinged connection.

The hinged end 82 of each of the first and second hinges 72, 74 is positioned inwardly of the rim 86 of the second open end 44 of the cap body 14, towards the first closed end 42 of the cap body 14. The leash end 84 of each of the first and second hinges 72, 74 protrudes further than the rim 86 of the cap body 14, such that the leash end 84 of each of the first and second hinges 72, 74 are respectively positioned beyond the rim 86 of the second open end 44 of the cap body 14, away from the second end 44 of the cap body 14.

Unlike the embodiment of FIGS. 1-6, the TE band 16 has a protruding portion 150 extending towards the tongue 78. When compared with the embodiment of FIGS. 1-6, the protruding portion can be considered as a mid-portion of the leash which has been made integral with the TE band 16, and the leash 76 converted to the first leash 76*a* and the second leash 76*b*, with the protruding portion 150 positioned between free ends of the first leash 76*b* and the second leash 76*b* when the cap body 14 is the closed and locked configuration. The arrangement of the tongue 78 relative to the protruding portion 150 defines a gap 87 allowing relative movement between the tongue 78 and the protruding portion 150. The leash 76 allows separation of the cap body 14 from the TE band 16 during opening (i.e. from the locked mode to the unlocked mode of the closed configuration 18), whilst remaining connected to the TE band 16. The first leash 76*a* and the second leash 76*b* are sized and shaped to allow the cap body 14 a degree of rotational freedom sufficient to disengage the threaded interface 52, 54.

During rotational actuation from the locked mode to the unlocked mode of the closure device 10, a separation between the tongue 78 and the protruding portion 150 is created, defining therein a foothold opening 90*a* between the tongue 78 and the protruding portion 150. The foothold opening 90*a* is sized and shaped to allow an un-interfered rotation of the tongue 78 relative to the protruding portion 150.

The lengths of the leashes 76*a*, 76*b* allow a degree of rotational movement of the cap body 14 to break the frangible links 64, positioned between the TE band 16 and the leashes 76*a*, 76*b*, respectively, and to disengage the threads 54.

As best seen in FIGS. 20 and 21, the engagement of the protruding portion 150 against the TE bead 28, and the contact of the tongue 78 against the protruding portion 150 serves to retain the position of the TE band 16 relative to the neck 24 of the container 12, during movement of the cap body 14 between the different open positions.

As before, the tongue 78 comprises the tongue body 92 having the free end 94 with the lip 96 formed thereon. The free end 94 of the tongue 78 does not protrude further than the rim 86 of the cap body 14 and is aligned with the rim 86 of the cap body 14. Unlike the embodiment of FIGS. 1-6, the lip 96 of the embodiment of FIGS. 18-22 extends further than the lip 96 of FIGS. 1-6. A length of the lip 96 of the embodiment of FIGS. 18-22 is about 1 mm to about 2 mm, compared to a length of about 0.7 mm to about 1.5 mm for the lip 96 of the embodiment of FIGS. 1-6. This increases a contact area between the tongue 78 and the protruding portion 150 for increased stability in the open configuration. It can also provide a larger opening angle. As can clearly be seen from a comparison of FIG. 3 and FIG. 20, the embodiments of FIGS. 18-22 allow a maximum retained opening angle of about 180°, compared to a maximum opening angle of about 120° in the embodiments of FIGS. 1-6. Also, the increased leash 76*a*, 76*b* and lip 96 sizes enables the cap body 14 to be spaced further from the neck and to provide a sound signal (e.g. a click) as will be described below.

The functioning of the retaining mechanism 22 will be described in more detail with reference to FIGS. 21A, B and C. When actuating the cap body 14 towards the fully open position, movement of the cap body 14 away from the open end 26 of the container 12, causes an orientation of the lip 96 of the tongue 78 relative to the protruding portion 150 to change. The cap body 14 hinges about the hinged end 82 of the first and second hinges 70, 72, respectively. In turn, the first leash 76*a* and the second 76*b* are respectively pushed against the supporting ledge 34.

Figure 21B:
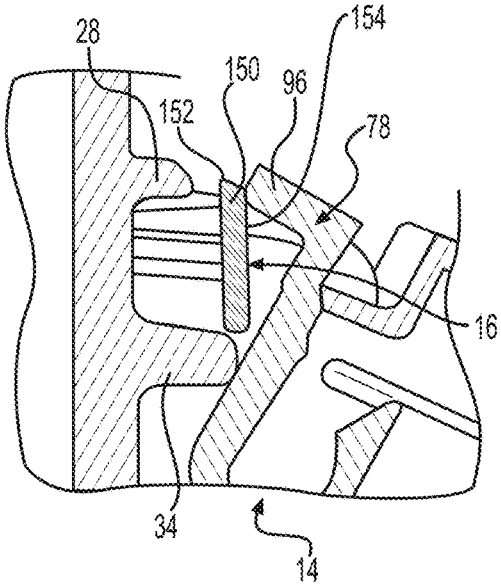
Figure 21C:
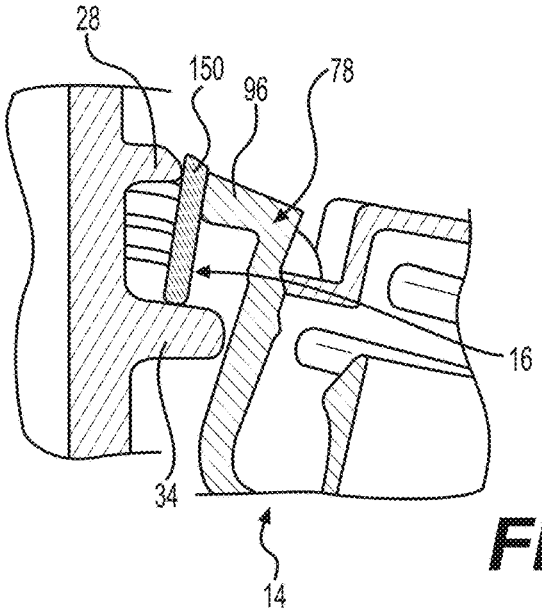

As the fully open position is approached, the lip 96 contacts a top surface 152 of the protruding portion 150, with the TE band 16 resting on the support ledge 34 and the protruding portion 150 spaced from the TE bead 28 (FIG. 21A). As the cap body 14 continues to be rotated away from the open end 26 of the container 12, the lip 96 slides off the top surface 152 of the protruding portion 150 and along an outer surface 154 of the protruding portion 150 (FIG. 21B). In the fully open position, and once the cap body 14 is released, the lip 96 rests against the outer surface of the protruding portion and the protruding portion 150 rests against the TE bead 28 (FIG. 21C). An audible sound is produced as the protruding portion 150 is brought into contact with the TE bead 28 on release of the cap body 14. Without being held to any theory, it is thought that this is caused by the release of potential energy in the TE band 16 deriving from an extension of the TE band 16 away from the neck 24 of the container 12 during opening. The audible sound is a click or the like. In other words, direct interaction of the first leash 76*a*, the second leash 76*b*, the protruding portion 150, the tongue 78 and the neck 24 enables retention of the cap body 14 in the fully open position. The first hinge 72 and the second hinge 74 define the first pivotal axis 100. The second pivotal axis 102 is defined by pivotal points at the connection points 75, 77.

As such, it can be said that the first and second leashes 76*a*, 76*b* function to retain a position of the closure device 10 during opening and/or closing; and that the tongue 78 and the protruding portion 150 function to maintain the closure device 10 in the fully open position.

The embodiment of the closure device 10 of FIG. 22 differs from that of FIGS. 18-21, in that three ribs 180 are provided on the TE band 16. Each rib 180 is elongate and extends along an outer surface of the TE band 16. Each rib 180 extends outwardly from the outer surface to create an embossed portion. The ribs 180 are of generally rectangular form and extend across the TE band 16 in a direction from the TE band 16 to the cap body 14. The three ribs 180 are substantially parallel to one another, and spaced from one another. The ribs 180 extend from a lower end of the TE band 16 and stop short of an upper end of the TE band 16. Although illustrated as being of similar or same configuration, the ribs 180 may have a different configuration to one another. Instead of three ribs 180, the TE band may have a single rib, two ribs or any other number of ribs. The ribs 180 may have a non-rectangular configuration. The purpose of the ribs is to provide a raised contact surface for the lip 96 when the cap body 14 is in the open configuration, which in certain embodiments creates a pre-load effect.

In certain embodiments, the ribs 180 ensure that the TE band 16 and the lip 96 are engaging in an upper portion of the TE band 16, close to a position of the neck pilfer proof. In addition, the ribs, in certain embodiments, ensure that a rotation point is above the ribs 180 on the TE band which can provide a robustness to the open position.

Alternative Embodiment (Embodiment 6)

A further embodiment of the closure device 10 is illustrated in FIGS. 23-33. Like the embodiment of FIGS. 18-22, the closure device 10 comprises the cap body 14 frangibly attached to the tamper evidence band (TE band) 16 and moveable between the closed configuration 18 (FIGS. 23-27) and the open configuration 20 (FIGS. 28-33). Locked and unlocked modes are possible in the closed configuration 18. In the open configuration 20, the cap body 14 is moveable between a number of different open positions ranging from partially open to the fully open position seen in FIGS. 33A, B and C. The retaining mechanism 22 is arranged to retain the cap body 14 to the TE band during opening, and to retain the cap body 14 in the fully open position.

The cap body 14 is generally cylindrical in shape and has the closed first end 42 and the open second end 44. The cap body 14 is arranged to be received over the open end 26 of the container 12.

The closure device 10 is arranged to be retained in the closed configuration 18 by means of the threaded interface with the neck 24 of the container 12. The inner surface 50 of the cap body 14 has threads 52 defined therein which are arranged to cooperate with threads 54 on the outer surface of the neck 24 of the container 12 (FIG. 26).

The outer surface 60 of the cap body 14 is textured to facilitate gripping of the cap body 14. As seen in FIGS. 23-25, the texturing comprises the plurality of ribs 62 (also known as "knurls") extending in a direction between the first and second ends 42, 44 of the cap body 14. It should be noted that the sizing and the pattern of the plurality of ribs 62 is not limited to those depicted herein. It is also noted that in alternative embodiments of the present technology, the plurality of ribs 62 can be omitted altogether.

The cap body 14 is frangibly connected to the TE band 16 by the plurality of links (bridges) 64 which are frangible. The links 64 are arranged to be severed when the cap body 14 and the TE band 16 are rotatably moved relative to one another. The tensile strength of the links 64 are lower than the tensile strength of the TE band 16, which means that the links 64 will be severed before tensile damage to the TE band 16.

In use, in the locked closed configuration (FIGS. 23-26), the cap body 14 is retained over the open end 26 of the container 12, adjacent the TE band 16, and connected thereto by one or more of the links 64 when they are intact, and the retaining mechanism 22.

In the unlocked closed configuration (FIGS. 27A and B), the links 64 are severed and the cap body 14 is connected to the TE band 16 by means of the retaining mechanism 22 only. The links 64 are arranged to be severed by a rotary movement of the cap body 14 relative to the TE band 16. In this respect, the retaining mechanism 22 is arranged to permit sufficient rotary movement of the cap body 14 relative to the TE band 16 to sever the links 64. The cap body 14 is moveable between the closed configuration 18 (in the unlocked mode) to the open configuration 20 through a hinged movement about a pivot region of the retaining mechanism 22.

Turning now to the retaining mechanism 22, which enables one or both of: (i) retention of the cap body 14 on the container 12 in the closed and open configurations 18, 20, and (ii) retention of the cap body 14 at the fully open position of the open configuration.

As best seen in FIGS. 23 and 24, and similarly to the embodiment of FIGS. 18-22, the retaining mechanism 22 comprises the first hinge 72 and the second hinge 74 defined on the cap body 14, the tongue 78 extending from the cap body 14 between the first hinge 72 and the second hinge 74, a first leash 76*a* connecting the TE band 16 to the first hinge 72, a second leash 76*b* connecting the TE band 16 to the second hinge 74. The first leash 76*a* is connected to the TE band 16 at the first connection point 75 and the second leash 76*b* is connected to the TE band 16 at the second connection point 77. The first and second connections points 75, 77 are positioned one on either side of the first and second hinges 72, 74. A distance between the first and second connection points 75, 77 in the embodiment of FIGS. 23-33 is about the same as the distance between the connection points 75, 77 of the embodiment of FIG. 18-22.

The first and second hinges 72, 74 are spaced from one another circumferentially around the second end 44 of the cap body 14. Each of the first and second hinges 72, 74 comprises the hinge body 80 extending from the second end 44 of the cap body 14. Each hinge body 80 has the hinged end 82 which is hingedly connected to the cap body 14, and the leash end 84 which is connected to the respective first leash 76*a* or the second leash 76*b*. By hingedly connected is meant that the hinge body 80 is moveably connected to the cap body 14 in a manner that allows relative axial movement. This is also referred to as a "flip-top" arrangement. The connection between the leash end 84 of the hinge body 80 and the leash 76 is not a hinged connection in certain embodiments.

The hinged end 82 of each of the first and second hinges 72, 74 is positioned inwardly of the rim 86 of the second open end 44 of the cap body 14, towards the first closed end 42 of the cap body 14. The leash end 84 of each of the first and second hinges 72, 74 protrudes further than the rim 86 of the cap body 14, such that the leash end 84 of each of the first and second hinges 72, 74 are respectively positioned beyond the rim 86 of the second open end 44 of the cap body 14, away from the second end 44 of the cap body 14.

The tongue 78 comprises the tongue body 92 having the free end 94 with the lip 96 formed thereon. The free end 94 of the tongue 78 does not protrude further than the rim 86 of the cap body 14 and is aligned with the rim 86 of the cap body 14. Like the embodiment of FIGS. 18-22, the lip 96 of the embodiment of FIGS. 23-33 extends further than the lip 96 of FIGS. 1-6. A length of the lip 96 of the embodiment of FIGS. 23-33 is about 1 mm to about 2 mm, compared to a length of about 0.7 mm to about 1.5 mm for the lip 96 of the embodiment of FIGS. 1-6.

The TE band 16 has a protruding portion 150 extending towards the tongue 78. The TE band 16 on either side of the protruding portion 150 is cut-out to accommodate the leash 76*a* and the leash 76*b*. The arrangement of the tongue 78 relative to the protruding portion 150 defines a gap 87 allowing relative movement between the tongue 78 and the protruding portion 150. During rotational actuation from the locked mode to the unlocked mode of the closure device 10, a separation between the tongue 78 and the protruding portion 150 is created, defining therein a foothold opening 90*a* between the tongue 78 and the protruding portion 150. The foothold opening 90*a* is sized and shaped to allow an un-interfered rotation of the tongue 78 relative to the protruding portion 150.

Unlike the embodiment of FIGS. 18-22, in the embodiment of FIGS. 23-33, the first and second leashes 76*a*, 76*b* are extendible as will be described below. Furthermore, the retaining mechanism 22 further comprises a groove 190 defined in an outer surface 192 of the cap body 14 and extending at least partially circumferentially around the cap body 14 and positioned above the tongue 78, and at least one rib 180 extending along the TE band 16.

Turning first to the extendible leashes, each leash 76*a*, 76*b* is provided with a fold 160 in an elongate leash body 162. The fold 160 is positioned about midway along the elongate leash body 162. The leashes 76*a*, 76*b*, can be considered to have an extendible configuration, by means of the respective fold 160, as will be explained below. In certain embodiments, the leashes 76*a*, 76*b* can be considered to have a resiliently extendible configuration, with the leashes resiliently biased to a non-extended form. This is the case, in certain embodiments, as long as the extent of deformation of the leashes 76*a*, 76*b* are within an elastic range of the leashes 76*a*, 76*b*, with no plastic deformation.

The fold 160 has a substantially U shaped configuration comprising a first fold arm 164 spaced from a second fold arm 166. The first fold arm 164 is moveably connected to the second fold arm 166. In other words, the first fold arm 164 and the second fold arm 166 are moveable relative to one another. The elongate leash body 162 has a one piece construction. Hence, the first fold arm 164 and the second fold arm 166 are one piece also.

At least a portion of the fold 160 (i.e. at least a lower end of the U configuration) extends into a correspondingly shaped cut-out 176 in the TE band 16. Portions of the leash body 76*a* and 76*b* which do not include the fold 160 extend generally circumferentially around a portion of the TE band 16, and substantially parallel to the rim 86, when the cap body 14 is in the closed configuration 18.

The fold 160 has a first fold distance 168 and a first fold angle 170 between the first fold arm 164 and the second fold arm 166 when the closure device 10 is in the closed configuration 18 (FIG. 24). This relates to a non-extended configuration of the leashes 76*a*, 76*b*. In the open configuration of the closure device 10, the fold 160 has a second fold distance 172 and a second fold angle 174, which is greater than the first fold distance 168 and the first fold angle 168 (best seen in FIG. 27B). This relates to an extended configuration of the leashes 76*a*, 76*b* in which a length 178 of the respective first leash 76*a* and the second leash 76*b* is increased. The length 178 of the first leash 76*a* can be considered as a distance from the connection point 75 to the hinge 82. The length 178 of the leash 76*b* can be considered as the length 178 from the connection point 77 to the hinge 82.

In other words, during opening of the closure device 10, the leashes 76*a*, 76*b* move from the non-extended configuration to the extended configuration. A distance between the first fold arm 164 and the second fold arm 166 is increased which extends the length 178 of the leash 76*a*, 76*b* connecting the cap body 16 to the TE band 16. In the closed configuration 18 of the closure device 10, with the leashes 76*a*, 76*b* in the non-extended configuration, the first fold angle 170 is zero as the first fold arm 164 is substantially parallel to the second fold arm 166. In the extended configuration of the leashes 76*a*, 76*b*, the fold 160 has a "V" configuration instead of a "U" configuration, with the second fold angle 174 being greater than zero.

In certain embodiments, due to elastic properties of the material used to make the container device and the configuration of the fold 90, the leashes 76*a*, 76*b*, have a certain amount of resilience, allowing the length 178 of the leash 76*a*, 76*b* to recover once an extending force is released. In the fully open position, the leashes 76*a*, 76*b* are stretched and due to an elastic behaviour of the leashes 76*a*, 76*b*, they spring back a certain extent hence releasing a clamping force.

The increased length 178 of the leashes 76*a*, 76*b* during opening increases a potential separation between the lip 94 and the TE band 16. This can allow for case of rotation of the cap body 14 during opening, as well as allow for over-rotation which can help for retention in the open position. In considering the amount of the additional extension required on the leashes 76*a*, 76*b*, a protrusion distance of the lip 96 from the tongue 78 can be taken into account to account for clearance required during opening. As will be described further below in relation to FIGS. 32A and 32B, the extendible leashes 76*a*, 76*b* permit rotation of the cap body 14 during opening to a degree further than the stable open configuration, as well as allowing the cap body 14 a degree of rotational freedom sufficient to disengage the threaded interface 52, 54.

Turning now to the at least one rib 180, as can be seen from FIGS. 23-33, two ribs 180 are provided. Each rib 180 extends from an outer surface of the protruding portion 150 of the TE band to create an embossed portion of the protruding portion 150. The ribs 180 are of generally rectangular form and extend across the TE band 16 in a direction from the TE band 16 to the cap body 14. The two ribs 180 are substantially parallel to one another, and spaced from one another. The ribs 180 extend from a lower end of the TE band 16 and stop short of an upper end of the TE band 16. Although illustrated as being of similar or same configuration, the ribs 180 may have a different configuration to one another. Instead of two ribs 180, the TE band may have a single rib. Alternatively, more than two ribs 180 may be provided. The ribs 180 may have a non-rectangular configuration. The purpose of the ribs is to provide a raised contact surface for the lip 96 when the cap body 14 is in the open configuration, which in certain embodiments creates a preload effect.

Turning now to the groove 190 defined in an outer surface 192 of the cap body 14. In certain embodiments, the groove 190 is annular and extends fully around the cap body 14. In other embodiments, the groove may extend partially around the cap body. The groove 190 is arranged to interact with the annular flange 28 when the cap body 14 is in the fully open position. In this respect, in certain embodiments, the groove 190 has a profile corresponding to a profile of the annular flange 28.

As best seen in FIGS. 33A-33C, when the cap body 14 is actuated to the fully open configuration, the lip 96 is engaged against the ribs 180, and the annular flange 28 is received in the groove 190, which helps to retain the open configuration of the cap body 14 relative to the neck 24 of the container 12.

As can be seen from FIG. 33A-C, a maximum retained opening angle of about 180° can be achieved. Also, the increased leash 76*a*, 76*b* and lip 96 sizes enables the cap body 14 to be spaced further from the neck and to provide a sound signal (e.g. a click) as will be described below.

The functioning of the retaining mechanism 22 will be described in more detail with reference to FIGS. 27-33. As seen in FIGS. 27A and 27B, and FIGS. 28A and 28B, twisting of the cap body 14 relative to the TE band 16 breaks the frangible links 64, and allows the separation of the cap body 14 from the TE band 16. Separation and rotation of the cap body 14 causes an extension of the leashes 76*a*, 76*b* by an opening of the fold 160 (increasing distance 168 and angle 170 between the first fold arm 164 and the second fold arm 166). As the cap body 14 continues to move towards the fully open position, the TE band is prevented from lifting off the free end of the container by the TE bead 28. When actuating the cap body 14 towards the fully open position, movement of the cap body 14 away from the open end 26 of the container 12, causes an orientation of the lip 96 of the tongue 78 relative to the protruding portion 150 to change.

As best seen in FIGS. 29A and 29B, as the cap body 14 is brought to an open position which is about 120° from the closed position in certain embodiments, the lip 96 contacts the protruding portion 150 at a top end 194. With continued rotation of the cap body 14, a contact point between the lip 96 and the protruding portion 150 moves downwardly and onto the ribs 180 (FIG. 30A, 30B, 31A, 31B). In other words, as the cap body 14 is rotated, the lip 96 contacts the ribs 180.

As best seen in FIG. 31A, when the cap body 14 is at an 180° open position, the support ledge 34 engages with the knurls 62 on the outer surface 60 of the cap body. Further rotation of the cap body to more than 180°, causes the groove 190 to engage with the support ledge 34 (FIG. 32A, 32B). Subsequent release of the cap body 14 causes the cap body 14 to settle at an 180° open position in a stable manner. At this point, the folds 160 are resiliently biased to the non-extended configuration which allows for the retention of the support ledge 34 in the groove 190.

As for the embodiment of FIG. 18-22, the cap body 14 hinges about the hinged end 82 of the first and second hinges 70, 72, respectively.

An audible sound is produced as the support ledge 34 clicks into the groove 160. The audible sound is a click or the like.

As such, it can be said that certain features of the retaining mechanism function to retain a position of the closure device 10 during opening and/or closing (such as the first and second leashes 76*a*, 76*b*), and to maintain the closure device 10 in the fully open position (such as the tongue 78, the lip 96, the protruding portion 150, the ribs 180, and the groove 190).

In certain other embodiments (not shown), the closure device 10 differs from that of FIGS. 23-33, in that the closure device 10 includes the extendible leashes 76*a*, 76*b* with the folds 160, but does not include the groove 190, nor the ribs 180. The extendible leashes 76*a*, 76*b* provide the increased separation of the cap body 14 from the TE band which can facilitate the opening of the closure device 10. In certain embodiments, the closure device 10 also includes the groove 190, which in combination with the extendible leashes 76*a*, 76*b* can allow for the positioning of the cap body 14 in such a way as to enable engagement of the groove 190 with the support ledge 34.

In certain other embodiments (not shown), the closure device 10 differs from that of FIGS. 23-33, in that the closure device 10 includes the ribs 180, but not the extendible leashes 76*a*, 76*b* with the folds 160, nor the groove 190. The ribs can provide a preloading effect.

In certain other embodiments (not shown), the closure device 10 differs from that of FIGS. 23-33, and 34, in that the closure device 10 includes the groove 190, but does not include extendible leashes 76*a*, 76*b* with the folds 160, nor the ribs 180. The groove can help to retain the cap body 14 in the open position.

Referring now FIGS. 34A and 34B, in which an alternative embodiment of the leashes 76*a*, 76*b* of FIGS. 22-33 are illustrated. The leashes 76*a*, 76*b* of FIGS. 34A and 34B have a fold 160' which is oriented substantially transversely to the fold 160 of FIGS. 22-33. As before, the fold 160' has a first fold arm 164 and a second fold arm 166. However, the fold 160' is not positioned centrally along the elongate leash body 162, but at an end thereof, with one of the first and second fold arms 164, 166 being connected to the TE band 16 at the connection point 75, 77.

In certain embodiments, the closure device 10 is made by injection molding using a mold adapted to form the closure device 10. The mold is positionable, in use, within an injection molding machine (not depicted). Injection molding machines are well known in the art and, as such, will not be described here at any length. A detailed description of these known injection molding machines may be referenced, at least in part, in the following reference books (for example): (i) "Injection Molding Handbook" authored by OSSWALD/TURNG/GRAMANN (ISBN: 3-446-21669-2), (ii) "Injection Molding Handbook" authored by ROSATO AND ROSATO (ISBN: 0-412-10581-3), (iii) "Injection Molding Systems" 3rd Edition authored by JOHANNABER (ISBN 3-446-17733-7) and/or (iv) "Runner and Gating Design Handbook" authored by BEAUMONT (ISBN 1-446-22672-9).

A mold assembly for making the closure device 10 comprises a molding cavity defined, at least in part, by a female cavity piece and a male core piece (as well as, optionally, a number of additional molding components) mounted respectively on a cavity plate and a core plate of a mold. The molding cavity is arranged to receive heated molding material for making the closure device (in this embodiment PET pellets) injected under pressure in a molten state.

The cavity plate and the core plate are urged together and are held together by clamp force, the clamp force being sufficient enough to keep the cavity and the core pieces together against the pressure of the injected molding material. The molding cavity has a shape that substantially corresponds to a final cold-state shape of the closure device. The so-injected molding material is then cooled to a temperature sufficient to enable ejection of the so-formed closure device from the mold. When cooled, the molded closure device shrinks inside of the molding cavity and, as such, when the cavity and core plates are urged apart, the molded article can be demolded, i.e. ejected off of the core piece. Ejection structures are known to assist in removing the molded articles from the core halves. Examples of the ejection structures include stripper plates, ejector pins, etc.

The mold assembly is comprised of several plates, each plate housing a component of the mold assembly. More specifically, the mold assembly includes a cavity plate housing one or more cavity inserts and a core plate housing one or more cavity inserts. In certain embodiments, the mold assembly further includes a stripper assembly, which in case of the preform mold, may house one or more neck rings. The mold assembly may further include one or more plates associated with the hot runner, such as a manifold plate, a backing plate and the like.

For the embodiments of the closure device 10 illustrated in FIGS. 23-33, slides are provided that are laterally moveable during demolding. Bosses on the slide that outline the molding surfaces for the extensions are near parallel to the central axis. As the leashes 76*a*, 76*b* with their respective folds 160 are closer to the central axis of movement of the slide, this can make them less prone to deformation, in certain embodiments, as the slide opens.

It should be expressly understood that various technical effects mentioned throughout the description above need not be enjoyed in each and every embodiment of the present technology. As such, it is anticipated that in some implementations of the present technology, only some of the above-described technical effects may be enjoyed. While in other implementations of the present technology, none of the above enumerated technical effects may be present, while other technical effects not specifically enumerated above may be enjoyed. It should be expressly understood that the above enumerated technical effects are provided for illustration purposes only, to enable those skilled in the art to better appreciate embodiments of the present technology and by no means are provided to limit the scope of the present technology or of the claims appended herein below.

It is noted that the foregoing has outlined some of the more pertinent non-limiting embodiments. It will be clear to those skilled in the art that modifications to the disclosed non-embodiment(s) can be effected without departing from the spirit and scope thereof. As such, the described non-limiting embodiment(s) ought to be considered to be merely illustrative of some of the more prominent features and applications. Other beneficial results can be realized by applying the non-limiting embodiments in a different manner or modifying them in ways known to those familiar with the art. This includes the mixing and matching of features, elements and/or functions between various non-limiting embodiment(s) is expressly contemplated herein so that one of ordinary skill in the art would appreciate from this disclosure that features, elements and/or functions of one embodiment may be incorporated into another embodiment as skill in the art would appreciate from this disclosure that features, elements and/or functions of one embodiment may be incorporated into another embodiment as appropriate, unless described otherwise, above. Although the description is made for particular arrangements and methods, the intent and concept thereof may be suitable and applicable to other arrangements and applications.

CLAUSES

1. A closure device (10) for a container (12), the container (12) having a neck (24) including an annular flange (28) along an outer surface (30) of the neck (24), the closure device (10) comprising:
   a cap body (14);
   a tamper evident (TE) band (16), the TE band (16) defined such that, when assembled onto the container (12), the TE band (16) is positioned below the annular flange (28) for cooperation therewith;
   a first hinge (72) and a second hinge (74) defined on the cap body (14);
   a leash (76) connected to the TE band (16), the first hinge (72) and the second hinge (74); the leash (76) allowing for the cap body (14) to be separated from the TE band (16) during opening, but to remain connected thereto via the leash (76);
   a tongue (78) protruding from the cap body (14) between the first hinge (72) and the second hinge (74);
   when the cap body (14) is actuated from a closed configuration (18) relative to the neck (24) to a fully open position (20):
   the leash (76) is configured to retain the cap body (14) to the TE band (16);
   an interaction of the tongue (78) and the neck (24) is configured to retain the cap body (14) in the fully open position (20).
2. The closure device (10) of clause 1, wherein the interaction of the tongue (78) and the neck (24) is direct.
3. The closure device (10) of clause 2, wherein the interaction is between a lip (96) at a free end (94) of the tongue (78) and the annular flange (28).
4. The closure device (10) of clause 1, wherein the interaction of the tongue (78) and the neck (24) is indirect via a ratchet (118) defined on the TE band (16).
5. The closure device (10) of clause 4, wherein the ratchet (118) is located on the TE band (16), between the first hinge (72) and the second hinge (74).

6. The closure device (10) of any of clauses 1-5, wherein the cap body (14) and the TE band (16) are implemented in a flip top arrangement via the first hinge (72) and the second hinge (74).
7. The closure device (10) of any of clauses 1-6, wherein after the cap body (14) is actuated from the closed configuration (18) relative to the neck (24) to the fully open position (20), the cap body (14) is configured to be actuated back to the closed configuration (18) and be retained in the closed configuration (18).
8. The closure device (10) of clause 7, wherein the cap body (14) is retained in the closed configuration (18) by means of a threaded interface with the neck (24).
9. The closure device (10) of clause 8, wherein the leash (76) is sized to allow the cap body (14) a degree of rotational freedom sufficient to disengage the threaded interface.
10. The closure device (10) of any of clauses 1-9, wherein the cap body (14) is initially connected to the TE band (16) by means of a frangible link (64).
11. The closure device (10) of clause 10, wherein the frangible link (64) is more fragile than the leash (76).
12. The closure device (10) of clause 10, wherein there are a plurality of frangible links (64) positioned outwardly of the first hinge (72) and the second hinge (74).
13. The closure device (10) of any of clauses 1-12, wherein the annular flange (28) and the TE band (16) are sized such that the annular flange (28) retains the TE band (16) after the cap body (14) is actuated from the closed configuration (18) relative to the neck (24) to the fully open position (20).
14. The closure device (10) of any of clauses 1-13, wherein the leash (76) is configured to allow the cap body (14) a rotational degree of freedom to separate the cap body (14) from the neck (24) while retaining the cap body (14) to the TE band (16).
15. The closure device (10) of any of clauses 1-14, wherein the interaction is an interaction of the tongue (78) with the leash (76) at an upper portion (98) of the annular flange (28).
16. The closure device (10) of any of clauses 1-15, wherein:

the first hinge (72) and the second hinge (74) define a first pivotal axis (100);

the leash (76) originates from a pivotal point (104) on the TE band (76), the pivotal point (104) defining a second pivotal axis (102).

17. A closure device (10) for a container (12), the container (12) having a neck (24) including an annular flange (28) along an outer surface of the neck (24), the closure device (10) comprising:

a cap body (14);

a tamper evident (TE) band (16), the TE band (16) defined such that, when assembled onto the container (12), the TE band (16) is positioned below the annular flange (28) for cooperation therewith;

a first hinge (72) and a second hinge (74) defined on the cap body (14);

a first leash (76*a*) and a second leash (76*b*) connecting the cap body (14) to the TE band (16), the first leash (76*a*) interconnecting the first hinge (72) and the TE band (16), and the second leash (76*a*) interconnecting the second hinge (74) and the TE band (16); the first leash (76*a*) and the second leash (76*b*) originating from separate locations on the TE band (16);

a tongue (78) protruding from the cap body (14) between the first hinge (72) and the second hinge (74);

when the cap body (14) is actuated from a closed configuration (18) relative to the neck (24) to a fully open position (20):

the first leash (76*a*) and the second leash (76*b*) are configured to be separated from the TE band (16) during opening, but to remain connected thereto to retain the cap body (14) to the TE band (16);

an interaction of the tongue (78) and the TE band (16) is configured to retain the cap body (14) in the fully open position (20).

18. The closure device (10) of clause 17, further comprising a protruding portion (150) extending from the TE band (16) towards the tongue (78), wherein an interaction of the tongue (78) and the protruding portion (150) is configured to retain the cap body (14) in the fully open position (20).
19. The closure device (10) of clause 17 or claim 18, wherein the tongue (78) comprises a lip (96) extending outwardly from a free end (94) of the tongue (78), a length of the lip (96) being sufficient to allow rotation of the cap body (14) by more than 180° from the closed configuration (18) to the fully open position (20).
20. The closure device (10) of clause 18 or clause 19, wherein the first leash (76*a*) and the second leash (76*b*) each have a length sufficient to permit the TE band (16) to be spaced from the neck (24) whilst rotating the cap body (14) from the closed configuration (18) towards the fully open position (20), and to cause the protruding portion (150) to contact the neck (24) when the cap body (14) is released in the fully open position (20) to cause an audible signal, and optionally wherein there is provided at least one rib on the TE band proximate the protruding portion.
21. A closure device (10) for a container (12), the container (12) having a neck (24) including an annular flange (28) along an exterior surface of the neck (24), the closure device (10) comprising:

a cap body (14);

a tamper evident (TE) band (16), the TE band (16) defined such that, when assembled onto the container (12), the TE band (16) is positioned below the annular flange (28) for cooperation therewith;

at least one hinge (72, 74) defined on the cap body (14);

at least one leash (76*a*, 76*b*) connected to the TE band (16) and the at least one hinge (72, 74), the at least one leash (76*a*, 76*b*) allowing for the cap body (14) to be separated from the TE band (16) during opening, but to remain connected thereto via the at least one leash (76*a*, 76*b*);

a tongue (78) protruding from the cap body (14) adjacent the at least one hinge (72, 74), the tongue (78) having a lip (96) extending therefrom;

at least one rib (180) on the TE band (16) and positioned below the tongue (78) when the cap body (14) is in a closed configuration (18) relative to the neck (24), wherein, when the cap body (14) is actuated from the closed configuration (18) to a fully open position (20):

the at least one leash (76*a*, 76*b*) is configured to retain the cap body (14) to the TE band (16); and the lip (96) is arranged to interact with the at least one rib (180) when the cap body (14) is in the fully open position (20).

22. The closure device (10) of clause 21, wherein the at least one rib (180) extends in a direction from the TE band (16) to the cap body (14).

23. The closure device (10) of clause 21 or clause 22, wherein the at least one rib (180) extends from a lower end of the TE band (14) and stops short of an upper end of the TE band (16).
24. The closure device (10) of any of clauses 21-23, wherein the at least one rib (180) comprises two ribs (180), spaced from one another and extending substantially parallel to one another, on the TE band (16).
25. The closure device (10) of any of clauses 21-24, wherein a connection point (75, 77) of the at least one leash (76*a*, 76*b*) to the TE band (16) is circumferentially spaced from a connection point of the at least one leash (76*a*, 76*b*) to the at least one hinge (72, 74).
26. The closure device (10) of any of clauses 21-25, wherein the at least one leash (76*a*, 76*b*) has an elongate leash body (162) extending generally circumferentially around a portion of the TE band (16) and having a fold (160) in the elongate leash body (162).
27. The closure device (10) of clause 26, wherein the fold (160) has a fold angle which can be increased during opening to extend a length of the leash (76*a*, 76*b*).
28. The closure device (10) of any of clauses 21-27, wherein the length of the leash (76*a*, 76*b*) is resiliently extendible.
29. The closure device (10) of any of clauses 26-28, wherein the fold (160) is positioned about midway along the elongate leash body (162).
30. The closure device (10) of any of clauses 26-29, wherein when the cap body (14) is in the closed configuration, a portion of the elongate leash body (162) not including the fold (160) extends in a manner substantially parallel to a rim (86) of the cap body (14).
31. The closure device (10) of any of clauses 26-30, wherein the fold (160) comprises a first fold arm (164) moveably connected to a second fold arm (166), the first fold arm (164) and the second fold arm (166) being positioned substantially transversely to the portion of the elongate leash body (162) not including the fold (160).
32. The closure device (10) of any of clauses 26-31, wherein when the cap body (14) is in the closed configuration (18), a portion of the fold (160) extends into a correspondingly shaped cut-out in the TE band (16).
33. The closure device (10) of any of clauses 21-32, wherein the at least one leash (76*a*, 76*b*) comprises two leashes (76*a*, 76*b*), and the at least one hinge (72, 74) comprises two hinges (72, 74), each leash (76*a*, 76*b*) of the two leashes (76*a*, 76*b*) being connected to the TE band (16) and a given hinge (72, 74), the tongue (78) protruding from the cap body (14) between the two hinges (72, 74).
34. The closure device (10) of any of clauses 21-33, further comprising a groove (190) defined in an outer surface of the cap body (14) and extending at least partially circumferentially around the cap body (14) and positioned above the tongue (78), such that when the cap body (14) is in the fully open position (20), the groove (190) is arranged to interact with a support ledge (34) on the outer surface of the neck (24) to retain the cap body (14) in the fully open position.
35. The closure device (10) of clause 34, wherein the groove (190) is annular.
36. The closure device (10) of any of clauses 21-35, wherein a free end of the lip (96) has a distance of extension from the tongue (78) which is greater than a distance of extension of the rib (180) from the TE band (16).
37. The closure device (10) of any of clauses 21-36, wherein the tongue (78) protrudes downwardly from the cap body (14), and the lip (96) extends substantially transversely from a free end of the tongue (78), such that a profile of the tongue (78) and the lip (96) is "L" shaped.
38. A closure device (10) for a container (12), the container (12) having a neck (24) including an annular flange along an exterior surface of the neck, the closure device comprising:
    a cap body;
    a tamper evident (TE) band, the TE band defined such that, when assembled onto the container, the TE band is positioned below the annular flange for cooperation therewith;
    at least one hinge (72, 74) defined on the cap body;
    at least one leash (76*a*, 76*b*) connected to the TE band, the at least one leash allowing for the cap body to be separated from the TE band during opening, but to remain connected thereto via the at least one leash; the at least one leash having an elongate leash body (162) extending generally circumferentially around a portion of the TE band and having a fold (160) in the elongate leash body (162);
    wherein, when the cap body is actuated from a closed configuration to the fully open position:
    the at least one leash is configured to retain the cap body to the TE band; and
    a fold angle of the fold of the at least one leash increases to increase a distance between the cap body and the TE band.
39. The closure device (10) of clause 38, wherein the leash is arranged such that the length of the leash is resiliently extendible.
40. The closure device (10) of clause 38 or clause 39, wherein the fold (160) is positioned about midway along the elongate leash body (162).
41. The closure device (10) of any of clauses 38-40, wherein when the cap body (14) is in the closed configuration, a portion of the elongate leash body (162) not including the fold (160) extends in a manner substantially parallel to a rim of the cap body.
42. The closure device (10) of any of clauses 38-41, wherein the fold comprises a first fold arm moveably connected to a second fold arm, the first fold arm and the second fold arm being positioned substantially transversely to the portion of the elongate leash body (162) not including the fold.
43. The closure device (10) of any of clauses 38-42, wherein when the cap body is in the closed configuration, a portion of the fold extends into a correspondingly shaped cut-out in the TE band (16).
44. The closure device (10) of clause 46, wherein a connection point (75, 77) of the at least one leash (76*a*, 76*b*) to the TE band (16) is circumferentially spaced from a connection point (75, 77) of the at least one leash to the at least one hinge (72, 74).
45. The closure device of any of clauses 38-44, wherein the at least one leash comprises two leashes (76*a*, 76*b*), and the at least one hinge comprises two hinges (72, 74), each hinge of the two leashes being connected to the TE band (16) and a given hinge.
46. The closure device (10) of clause 45, further comprising a tongue (78) protruding from the cap body (14)

between the two leashes (76*a*, 76*b*), the tongue having a lip (96) extending therefrom.

47. The closure device (10) of any of clauses 38-45, further comprising a tongue (78) protruding from the cap body (14) adjacent the at least one hinge, the tongue having a lip (96) extending therefrom.

48. The closure device (10) of clause 46 or clause 47, wherein the tongue (78) protrudes downwardly from the cap body, and the lip (96) extends substantially transversely from a free end of the tongue, such that a profile of the tongue and the lip is "L" shaped.

49. The closure device (10) of any of clauses 38-48, further comprising a groove (190) defined in an outer surface of the cap body (14) and extending at least partially circumferentially around the cap body and positioned above the tongue (78), such that when the cap body is in the fully open position, the groove (190) is arranged to interact with a support ledge (34) on the outer surface of the neck to retain the cap body in the fully open position.

50. The closure device (10) of clause 49, wherein the groove (190) is annular.

51. The closure device (10) of any of clauses 38-50, further comprising at least one rib (180) on the TE band (16) and positioned below the tongue (78) when the cap body (14) is in the closed configuration relative to the neck, wherein, when the cap body is actuated from the closed configuration to the fully open position: the lip (96) is arranged to interact with the at least one rib (180) in the fully open position.

52. The closure device (10) of clause 51, wherein the at least one rib (180) extends in a direction from the TE band (16) to the cap body (14).

53. The closure device (10) of clause 51 or clause 52, wherein the at least one rib (180) extends from a lower end of the TE band and stops short of an upper end of the TE band.

54. The closure device (10) of any of clauses 51-52, wherein the at least one rib (180) comprises two ribs (180), spaced from one another and extending substantially parallel to one another, on the TE band (16).

55. The closure device (10) of any of clauses 51-54, wherein a free end of the lip (96) has a distance of extension from the tongue (78) which is greater than a distance of extension of the rib (180) from the TE band (16).

56. A closure device (10) for a container, the container having a neck including an annular flange along an exterior surface of the neck, the closure device comprising:

a cap body (14);

a tamper evident (TE) band (16), the TE band defined such that, when assembled onto the container, the TE band is positioned below the annular flange for cooperation therewith;

at least one hinge (72, 74) defined on the cap body;

at least one leash (76*a*, 76*b*) connected to the TE band and the at least one hinge, the at least one leash allowing for the cap body to be separated from the TE band during opening, but to remain connected thereto via the at least one leash;

a tongue (78) protruding from the cap body adjacent the at least one hinge, the tongue having a lip (96) extending outwardly therefrom;

a groove (190) defined in an outer surface of the cap body and extending at least partially circumferentially around the cap body and positioned above the tongue, wherein, when the cap body is actuated from a closed configuration to a fully open position: the at least one leash is configured to retain the cap body to the TE band;

the lip is arranged to interact with an outer surface of the TE band when the cap body is in the fully open position; and the groove (190) is arranged to interact with the annular flange and to retain the cap body in the fully open position.

57. The closure device (10) of clause 56, wherein the groove (190) extends partially around a circumference of the cap body.

58. The closure device (10) of clause 56 or clause 57, wherein the at least one leash has an elongate leash body (162) extending generally circumferentially around a portion of the TE band (16) and a fold (160) is provided in the elongate leash body (162); wherein, when the cap body is actuated from the closed configuration to the fully open position:

the at least one leash (76*a*, 76*b*) is configured to retain the cap body to the TE band; and a fold angle of the fold (160) of the at least one leash increases such that a length of the at least one leash increases.

59. The closure device (10) of clause 66, wherein the at least one leash (76*a*, 76*b*) is arranged such that the length of the at least one leash is resiliently extendible.

60. The closure device (10) of any of clauses 58-59, wherein the fold (160) is positioned about midway along the elongate leash body (162).

61. The closure device (10) of any of clauses 58-60, wherein when the cap body is in the closed configuration, a portion of the elongate leash body (162) not including the fold (160) extends in a manner substantially parallel to a rim of the cap body.

62. The closure device (10) of any of clauses 58-61, wherein the fold (160) comprises a first fold arm (162) moveably connected to a second fold arm (164), the first fold arm and the second fold arm being positioned substantially transversely to the portion of the elongate leash body (162) not including the fold.

63. The closure device (10) of any of clauses 58-62, wherein when the cap body is in the closed configuration, a portion of the fold (160) extends into a correspondingly shaped cut-out in the TE band.

64. The closure device (10) of any of clauses 56-63, wherein a connection (25, 27) point of the at least one leash (76*a*, 76*b*) to the TE band is circumferentially spaced from a connection point (25, 27) of the at least one leash to the at least one hinge.

65. The closure device (10) of any of clauses 56-64, wherein the at least one leash comprises two leashes (76*a*, 76*b*), and the at least one hinge comprises two hinges, each hinge of the two leashes being connected to the TE band and a given hinge.

66. The closure device (10) of any of clauses 56-65, wherein the tongue (78) protrudes downwardly from the cap body (14), and the lip (96) extends substantially transversely from a free end of the tongue (78), such that a profile of the tongue and the lip is "L" shaped.

67. The closure device (10) of any of clauses 56-66, further comprising at least one rib (180) on the TE band and positioned below the tongue when the cap body is in the closed configuration relative to the neck, wherein, when the cap body is actuated from the closed configuration to the fully open position, the lip is arranged to interact with the at least one rib in the fully open position.

68. The closure device (10) of clause 67, wherein the at least one rib extends in a direction from the TE band (16) to the cap body (14).

69. The closure device (10) of clause 67 or clause 68, wherein the at least one rib extends from a lower end of the TE band and stops short of an upper end of the TE band.

70. The closure device (10) of any of claims 67-69, wherein the at least one rib comprises two ribs, spaced from one another and extending substantially parallel to one another, on the TE band.

71. The closure device (10) of clause 67-70, wherein a free end of the lip (96) has a distance of extension from the tongue which is greater than a distance of extension of the rib (180) from the TE band (16).

72. A mold for forming a closure device by injection molding, the mold comprising a female cavity piece and a male core piece, the female cavity piece and the male core piece defining a molding cavity configured to form the closure device of any one of clauses 21 to 37, 38 to 55, and 56 to 71.

What is claimed is:

1. A closure device for a container, the container having a neck including an annular flange along an outer surface of the neck, the closure device comprising:

a cap body;

a tamper evident (TE) band, the TE band defined such that, when assembled onto the container, the TE band is positioned below the annular flange for cooperation therewith;

a first hinge and a second hinge defined on the cap body;

a first leash and a second leash connecting the cap body to the TE band, the first leash interconnecting the first hinge and the TE band, and the second leash interconnecting the second hinge and the TE band; the first leash and the second leash originating from separate locations on the TE band that are positioned one on either side of the first and second hinges; and a tongue protruding from the cap body between the first hinge and the second hinge and towards the TE band when the cap body is in a closed configuration relative to the neck;

the closure device being characterized by:

a protruding portion extending from the TE band towards the tongue;

wherein when the cap body is actuated from the closed configuration relative to the neck to a fully open configuration:

the first leash and the second leash are configured to be separated from the TE band during opening, but to remain connected thereto to retain the cap body to the TE band; and an interaction of the tongue and the protruding portion extending from the TE band is configured to retain the cap body in the fully open configuration.

2. The closure device of claim 1, wherein the tongue comprises a lip extending outwardly from a free end of the tongue, a length of the lip being sufficient to allow rotation of the cap body by more than 180° from the closed configuration to the fully open configuration.

3. The closure device of claim 2, wherein the first leash and the second leash each have a length sufficient to permit the TE band to be spaced from the neck whilst rotating the cap body from the closed configuration towards the fully open configuration, and to cause the protruding portion to contact the neck when the cap body is released in the fully open configuration to cause an audible signal.

4. The closure device of claim 2, wherein the lip extends substantially transversely from a free end of the tongue, such that a profile of the tongue and the lip is "L" shaped.

5. The closure device of claim 1, further comprising at least one rib on the TE band.

6. The closure device of claim 5, further comprising a lip extending from the tongue and the at least one rib on the TE band is positioned below the tongue when the cap body is in a closed configuration relative to the neck, wherein, when the cap body is actuated from the closed configuration to the fully open configuration the lip is arranged to interact with the at least one rib when the cap body is in the fully open configuration.

7. The closure device of claim 6, wherein the at least one rib extends in a direction from the TE band to the cap body.

8. The closure device of claim 6, wherein the at least one rib comprises two ribs, spaced from one another and extending substantially parallel to one another, on the TE band.

9. The closure device of claim 1, wherein each leash has an elongate leash body extending generally circumferentially around a portion of the TE band and having a fold in the elongate leash body; wherein, when the cap body is actuated from a closed configuration to the fully open position a fold angle of the fold of the at least one leash increases to increase a distance between the cap body and the TE band.

10. The closure device of claim 9, wherein the leash is arranged such that the length of the leash is resiliently extendible.

11. The closure device of claim 9, wherein the fold comprises a first fold arm moveably connected to a second fold arm, the first fold arm and the second fold arm being positioned substantially transversely to the portion of the elongate leash body not including the fold.

12. The closure device of claim 1, further comprising a lip extending outwardly from the tongue and a groove defined in an outer surface of the cap body and extending at least partially circumferentially around the cap body and positioned above the tongue, wherein, when the cap body is actuated from a closed configuration to a fully open configuration the lip is arranged to interact with an outer surface of the TE band when the cap body is in the fully open configuration; and the groove is arranged to interact with the annular flange and to retain the cap body in the fully open configuration.

13. The closure device of claim 12, wherein the groove extends partially around a circumference of the cap body.

14. The closure device of claim 2, wherein a length of the lip extending outwardly from the free end of the tongue is between approximately 1 mm and 2 mm.

15. The closure device of claim 2, wherein a length of the lip extending outwardly from the free end of the tongue is greater than 1.5 mm.

16. A mold for forming a closure device by injection molding, the mold comprising a female cavity piece and a male core piece, the female cavity piece and the male core piece defining a molding cavity configured to form the closure device of claim 1.

* * * * *